US011623124B2

(12) United States Patent
Parsons et al.

(10) Patent No.: US 11,623,124 B2
(45) Date of Patent: Apr. 11, 2023

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Michael R. Nicolette, Scottsdale, AZ (US); Bradley D. Schweigert, Cave Creek, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 17/178,989

(22) Filed: Feb. 18, 2021

(65) Prior Publication Data

US 2021/0197037 A1 Jul. 1, 2021

Related U.S. Application Data

(63) Continuation of application No. 16/789,167, filed on Feb. 12, 2020, now Pat. No. 10,933,286, and a (Continued)

(51) Int. Cl.
*A63B 53/04* (2015.01)
*A63B 60/02* (2015.01)

(Continued)

(52) U.S. Cl.
CPC ..... *A63B 53/0466* (2013.01); *A63B 1/00* (2013.01); *A63B 53/04* (2013.01); *A63B 60/02* (2015.10);

(Continued)

(58) Field of Classification Search
CPC ..... A63B 53/0466; A63B 60/54; A63B 53/04; A63B 53/045; A63B 53/0475;

(Continued)

(56) References Cited

U.S. PATENT DOCUMENTS 723,258 A 3/1903 Felton
1,133,129 A 3/1915 Govan (Continued)

FOREIGN PATENT DOCUMENTS

DE 29715997 U1 2/1998
DE 29715997 U1 * 3/1998 ..... A63B 53/04

(Continued)

OTHER PUBLICATIONS

Machine language translation of DE29715997U1, titled "Golf Club Head With Good Shock Absorption Properties", Inventor Linphone, retrieved from Espacenet on Nov. 30, 2021. (Year: 2021).*

(Continued)

*Primary Examiner* — Sebastiano Passaniti

(57) ABSTRACT

Embodiments of golf club heads, golf clubs, and methods to manufacture golf club heads and golf clubs are generally described herein. In one example, a golf club head may include a body portion having an interior cavity, a front portion, a rear portion, a toe portion, a heel portion, a sole portion, and a top portion. A face portion may be coupled to the front portion and may include a front surface having a plurality of grooves with each groove extending in a first direction, and a back surface having a plurality of channels with each channel having a length and a width being substantially smaller than the length. A filler material may at least partially fill the interior cavity. The length of at least one channel of the plurality of channels may extend in a second direction different from the first direction. Each channel may be at least partially filled with the filler material and may be configured to engage the filler material to adhere the filler material to the back surface of the face portion. Other examples and embodiments may be described and claimed.

16 Claims, 26 Drawing Sheets

Related U.S. Application Data continuation-in-part of application No. 17/038,195, filed on Sep. 30, 2020, now Pat. No. 11,173,359, which is a continuation of application No. 16/365,343, filed on Mar. 26, 2019, now Pat. No. 10,821,340, which is a continuation of application No. 15/841,022, filed on Dec. 13, 2017, now Pat. No. 10,265,590, which is a continuation of application No. 15/701,131, filed on Sep. 11, 2017, now abandoned, which is a continuation-in-part of application No. 15/685,986, filed on Aug. 24, 2017, now Pat. No. 10,279,233, which is a continuation of application No. 15/628,251, filed on Jun. 20, 2017, now abandoned, which is a continuation of application No. 15/209,364, filed on Jul. 13, 2016, now Pat. No. 10,293,229, which is a continuation of application No. PCT/US2015/016666, filed on Feb. 19, 2015, said application No. 15/209,364 is a continuation of application No. 14/618,501, filed on Feb. 10, 2015, now Pat. No. 9,427,634, which is a continuation of application No. 14/589,277, filed on Jan. 5, 2015, now Pat. No. 9,421,437, which is a continuation of application No. 14/513,073, filed on Oct. 13, 2014, now Pat. No. 8,961,336, which is a continuation of application No. 14/498,603, filed on Sep. 26, 2014, now Pat. No. 9,199,143, application No. 17/178,989, filed on Feb. 18, 2021, which is a continuation-in-part of application No. 16/376,868, filed on Apr. 5, 2019, now abandoned, which is a continuation of application No. 15/478,542, filed on Apr. 4, 2017, now Pat. No. 10,286,267, which is a continuation of application No. 14/709,195, filed on May 11, 2015, now Pat. No. 9,649,542, application No. 17/178,989, filed on Feb. 18, 2021, which is a continuation-in-part of application No. 16/929,552, filed on Jul. 15, 2020, now Pat. No. 11,117,030, which is a continuation of application No. 15/683,564, filed on Aug. 22, 2017, now Pat. No. 10,716,978, which is a continuation of application No. 15/598,949, filed on May 18, 2017, now Pat. No. 10,159,876, which is a continuation of application No. 14/711,596, filed on May 13, 2015, now Pat. No. 9,675,853, application No. 17/178,989, filed on Feb. 18, 2021, which is a continuation-in-part of application No. 16/376,863, filed on Apr. 5, 2019, now abandoned, which is a continuation of application No. 15/958,288, filed on Apr. 20, 2018, now abandoned, which is a continuation of application No. 15/947,383, filed on Apr. 6, 2018, now abandoned, which is a continuation of application No. 15/842,632, filed on Dec. 14, 2017, now Pat. No. 10,029,159, which is a continuation of application No. 15/263,018, filed on Sep. 12, 2016, now Pat. No. 9,878,220, which is a continuation of application No. 15/043,090, filed on Feb. 12, 2016, now Pat. No. 9,468,821, application No. 17/178,989, filed on Feb. 18, 2021, which is a continuation-in-part of application No. 17/038,155, filed on Sep. 30, 2020, now Pat. No. 11,141,633, which is a continuation of application No. 16/351,143, filed on Mar. 12, 2019, now Pat. No. 10,821,339, which is a continuation of application No. 15/842,583, filed on Dec. 14, 2017, now Pat. No. 10,232,235, which is a continuation of application No. 15/631,610, filed on Jun. 23, 2017, now abandoned, which is a continuation of application No. 15/360,707, filed on Nov. 23, 2016, now Pat. No. 10,029,158, which is a continuation of application No. 15/043,106, filed on Feb. 12, 2016, now Pat. No. 9,533,201, application No. 17/178,989, filed on Feb. 18, 2021, which is a continuation-in-part of application No. 16/785,336, filed on Feb. 7, 2020, now abandoned, which is a continuation of application No. 15/703,639, filed on Sep. 13, 2017, now Pat. No. 10,596,424, which is a continuation-in-part of application No. 15/484,794, filed on Apr. 11, 2017, now Pat. No. 9,814,952, application No. 17/178,989, filed on Feb. 18, 2021, which is a continuation-in-part of application No. 16/774,449, filed on Jan. 28, 2020, now Pat. No. 10,926,142, which is a continuation of application No. 16/179,406, filed on Nov. 2, 2018, now Pat. No. 10,583,336, application No. 17/178,989, filed on Feb. 18, 2021, which is a continuation-in-part of application No. 17/099,362, filed on Nov. 16, 2020, which is a continuation of application No. 16/820,136, filed on Mar. 16, 2020, now Pat. No. 10,874,919, which is a continuation of application No. 16/590,105, filed on Oct. 1, 2019, now Pat. No. 10,632,349.

(60) Provisional application No. 61/942,515, filed on Feb. 20, 2014, provisional application No. 61/945,560, filed on Feb. 27, 2014, provisional application No. 61/948,839, filed on Mar. 6, 2014, provisional application No. 61/952,470, filed on Mar. 13, 2014, provisional application No. 62/021,415, filed on Jul. 7, 2014, provisional application No. 62/058,858, filed on Oct. 2, 2014, provisional application No. 62/137,494, filed on Mar. 24, 2015, provisional application No. 62/118,403, filed on Feb. 19, 2015, provisional application No. 62/159,856, filed on May 11, 2015, provisional application No. 61/992,555, filed on May 13, 2014, provisional application No. 62/010,836, filed on Jun. 11, 2014, provisional application No. 62/011,859, filed on Jun. 13, 2014, provisional application No. 62/032,770, filed on Aug. 4, 2014, provisional application No. 62/041,538, filed on Aug. 25, 2014, provisional application No. 62/209,780, filed on Aug. 25, 2015, provisional application No. 62/277,636, filed on Jan. 12, 2016, provisional application No. 62/275,443, filed on Jan. 6, 2016, provisional application No. 62/276,358, filed on Jan. 8, 2016, provisional application No. 62/321,652, filed on Apr. 12, 2016, provisional application No. 62/581,456, filed on Nov. 3, 2017, provisional application No. 62/908,467, filed on Sep. 30, 2019, provisional application No. 62/903,467, filed on Sep. 20, 2019, provisional application No. 62/877,934, filed on Jul. 24, 2019, provisional application No. 62/877,915, filed on Jul. 24, 2019, provisional application No. 62/865,532, filed on Jun. 24, 2019, provisional application No. 62/826,310, filed on Mar. 29, 2019, provisional application No. 62/814,959, filed on Mar. 7, 2019.

(51) Int. Cl.

| | |
|---|---|
| ***A63B 60/54*** | (2015.01) |
| ***A63B 60/00*** | (2015.01) |
| ***A63B 1/00*** | (2006.01) |

(52) U.S. Cl.

CPC ..... *A63B 53/045* (2020.08); *A63B 53/0408* (2020.08); *A63B 53/0412* (2020.08); *A63B 53/0433* (2020.08); *A63B 53/0437* (2020.08);

*A63B 53/0475* (2013.01); *A63B 60/002* (2020.08); *A63B 60/54* (2015.10); *A63B 2053/0491* (2013.01); *A63B 2209/00* (2013.01)

(58) Field of Classification Search
CPC ..... A63B 2053/0491; A63B 53/0458; A63B 53/0462; A63B 53/0454; A63B 53/0445
USPC ..... 473/324–350, 287–292
See application file for complete search history.

(56) References Cited

U.S. PATENT DOCUMENTS 1,534,600 A 4/1925 Mattern
1,538,312 A 5/1925 Neish
D138,438 S 8/1944 Link
3,020,048 A 2/1962 Carroll
3,266,805 A 8/1966 Bulla
D215,101 S 9/1969 Sabat
D229,431 S 11/1973 Baker
3,843,122 A 10/1974 Florian
D234,609 S 3/1975 Raymont
D239,550 S 4/1976 Timbrook
D240,748 S 7/1976 Bock et al.
4,085,934 A 4/1978 Churchward
D253,778 S 12/1979 Madison
4,502,687 A 3/1985 Kochevar
4,523,759 A 6/1985 Igarashi
4,545,580 A 10/1985 Tomita et al.
4,591,160 A 5/1986 Piragino
4,635,941 A * 1/1987 Yoneyama ..... A63B 60/00 473/331
D294,617 S 3/1988 Perkins
4,754,977 A 7/1988 Sahm
4,803,023 A 2/1989 Enomoto et al.
4,824,116 A 4/1989 Nagamoto et al.
4,928,972 A 5/1990 Nakanishi et al.
4,930,781 A * 6/1990 Allen ..... A63B 53/0466 473/346
4,988,104 A 1/1991 Shiotani et al.
5,028,049 A 7/1991 McKeighen
5,074,563 A * 12/1991 Gorman ..... A63B 60/00 473/350
5,090,702 A 2/1992 Viste
5,106,094 A 4/1992 Desbiolles et al.
5,158,296 A 10/1992 Lee
5,176,384 A 1/1993 Sata et al.
5,184,823 A 2/1993 Desboilles et al.
5,213,328 A 5/1993 Long et al.
D336,672 S 6/1993 Gorman
5,244,211 A 9/1993 Lukasiewicz
5,282,624 A * 2/1994 Viste ..... A63B 60/00 473/342
5,290,036 A 3/1994 Fenton et al.
5,306,450 A 4/1994 Okumoto et al.
5,348,302 A 9/1994 Sasamoto et al.
D351,883 S 10/1994 Solheim et al.
5,351,958 A 10/1994 Helmstetter
5,362,055 A * 11/1994 Rennie ..... A63B 53/0466 473/346
5,385,348 A * 1/1995 Wargo ..... A63B 53/0466 473/338
5,397,126 A * 3/1995 Allen ..... A63B 53/0466 473/324
5,419,559 A 5/1995 Melanson et al.
5,419,560 A 5/1995 Bamber
5,421,577 A 6/1995 Kobayashi
5,425,535 A 6/1995 Gee
D361,358 S 8/1995 Simmons
5,447,311 A 9/1995 Viollaz et al.
5,451,056 A 9/1995 Manning
D362,885 S 10/1995 Blough et al.
5,467,983 A 11/1995 Chen
5,485,998 A 1/1996 Kobayashi
5,518,243 A 5/1996 Redman
5,540,437 A 7/1996 Bamber
5,595,548 A 1/1997 Beck
D378,111 S 2/1997 Parente et al.
5,611,742 A * 3/1997 Kobayashi ..... A63B 53/04 473/345
5,637,045 A 6/1997 Igarashi
5,647,808 A 7/1997 Hosokawa
5,649,873 A 7/1997 Fuller
5,665,013 A * 9/1997 Kobayashi ..... A63B 60/00 473/331
5,669,830 A 9/1997 Bamber
5,676,605 A * 10/1997 Kobayashi ..... A63B 53/04 473/331
5,681,227 A * 10/1997 Sayrizi ..... A63B 60/50 473/327
5,711,722 A * 1/1998 Miyajima ..... A63B 53/04 473/346
5,718,641 A * 2/1998 Lin ..... A63B 53/04 473/224
5,735,755 A * 4/1998 Kobayashi ..... A63B 53/04 473/342
5,766,091 A 6/1998 Humphrey et al.
5,766,092 A 6/1998 Mimeur et al.
5,769,735 A 6/1998 Hosokawa
5,772,527 A 6/1998 Liu
5,788,584 A 8/1998 Parente et al.
5,797,807 A 8/1998 Moore
D398,687 S * 9/1998 Miyajima ..... D21/747
5,827,132 A 10/1998 Bamber
5,899,821 A 5/1999 Hsu et al.
5,908,357 A * 6/1999 Hsieh ..... A63B 53/0466 473/327
5,935,016 A 8/1999 Antonious
5,961,394 A * 10/1999 Minabe ..... A63B 60/00 473/305
6,012,990 A 1/2000 Nishizawa
D421,080 S 2/2000 Chen
6,064,568 A 5/2000 Schmitt
D426,276 S 6/2000 Besnard et al.
6,077,171 A 6/2000 Yoneyama
6,093,116 A * 7/2000 Hettinger ..... A63B 53/047 473/332
6,162,133 A 12/2000 Peterson
6,165,081 A 12/2000 Chou
6,203,449 B1 * 3/2001 Kenmi ..... A63B 53/0466 473/346
D442,659 S 5/2001 Kubica et al.
6,231,458 B1 5/2001 Cameron et al.
6,238,302 B1 5/2001 Helmstetter et al.
D445,862 S 7/2001 Ford
6,290,609 B1 9/2001 Takeda
6,299,548 B1 * 10/2001 Lin ..... A63B 53/04 473/331
6,386,990 B1 5/2002 Reyes et al.
D469,833 S 2/2003 Roberts et al.
D475,107 S 5/2003 Madore
D478,140 S 8/2003 Burrows
D478,952 S * 8/2003 Greene ..... D21/759
6,607,451 B2 8/2003 Kosmatka et al.
D481,432 S * 10/2003 Greene ..... D21/748
6,638,182 B2 10/2003 Kosmatka
6,695,714 B1 2/2004 Bliss et al.
6,702,693 B2 3/2004 Bamber
D490,129 S * 5/2004 Greene ..... D21/748
6,780,123 B2 8/2004 Hasebe
6,811,496 B2 11/2004 Wahl et al.
6,830,519 B2 12/2004 Reed et al.
6,840,872 B2 * 1/2005 Yoneyama ..... A63B 53/0466 473/345
6,855,067 B2 2/2005 Solheim et al.
D502,975 S 3/2005 Schweigert et al.
D503,204 S 3/2005 Nicolette et al.
D508,545 S 8/2005 Roberts et al.
D508,969 S 8/2005 Hasebe
6,923,733 B2 8/2005 Chen
D511,553 S * 11/2005 Madore ..... D21/759
D512,474 S * 12/2005 Madore ..... D21/759
D512,475 S * 12/2005 Madore ..... D21/759
D514,183 S 1/2006 Schweigert et al.
6,984,180 B2 1/2006 Hasebe

(56) References Cited

U.S. PATENT DOCUMENTS

D516,152 S * 2/2006 Madore ..... D21/759
D517,629 S * 3/2006 Madore ..... D21/759
D523,501 S 6/2006 Nicolette et al.
7,121,956 B2 10/2006 Lo
7,128,663 B2 10/2006 Bamber
7,153,222 B2 12/2006 Gilbert et al.
D534,595 S 1/2007 Hasebe
7,156,751 B2 1/2007 Wahl et al.
7,169,057 B2 1/2007 Wood et al.
7,182,698 B2 2/2007 Tseng
D539,862 S * 4/2007 Nunez ..... D21/748
7,207,899 B2 4/2007 Imamoto
7,207,900 B2 4/2007 Nicolette et al.
D543,601 S 5/2007 Kawami
7,281,991 B2 10/2007 Gilbert et al.
D555,219 S 11/2007 Lin
7,303,486 B2 12/2007 Imamoto
7,351,164 B2 4/2008 Schweigert et al.
7,387,579 B2 * 6/2008 Lin ..... A63B 53/04 473/332
7,396,299 B2 7/2008 Nicolette et al.
7,553,241 B2 6/2009 Park et al.
7,575,523 B2 * 8/2009 Yokota ..... A63B 53/0466 473/332
7,582,024 B2 9/2009 Shear
7,588,502 B2 9/2009 Nishino
7,594,862 B2 9/2009 Gilbert
7,611,424 B2 11/2009 Nagai et al.
7,658,686 B2 2/2010 Soracco
D618,293 S 6/2010 Foster et al.
7,744,484 B1 6/2010 Chao
7,744,486 B2 6/2010 Hou et al.
7,744,487 B2 6/2010 Tavares et al.
7,749,100 B2 7/2010 Tavares et al.
7,785,212 B2 8/2010 Lukasiewicz et al.
7,794,333 B2 9/2010 Wallans et al.
7,794,335 B2 * 9/2010 Cole ..... A63B 53/04 473/342
7,798,917 B2 9/2010 Nguyen et al.
7,803,068 B2 9/2010 Clausen et al.
7,815,521 B2 10/2010 Ban et al.
7,846,040 B2 12/2010 Ban
7,914,394 B2 * 3/2011 Cole ..... A63B 60/52 473/332
7,938,738 B2 5/2011 Roach
8,012,040 B2 9/2011 Takechi
8,062,150 B2 11/2011 Gilbert et al.
8,088,025 B2 1/2012 Wahl et al.
8,092,319 B1 1/2012 Cackett et al.
8,105,180 B1 1/2012 Cackett et al.
8,221,262 B1 7/2012 Cackett et al.
8,235,842 B2 * 8/2012 Cole ..... A63B 53/047 473/332
8,246,487 B1 8/2012 Cackett et al.
8,257,196 B1 9/2012 Abbott et al.
8,262,506 B2 9/2012 Watson et al.
8,277,337 B2 10/2012 Shimazaki
8,328,662 B2 12/2012 Nakamura et al.
8,376,878 B2 2/2013 Bennett et al.
8,393,976 B2 3/2013 Soracco et al.
D681,142 S 4/2013 Fossum et al.
8,414,422 B2 4/2013 Peralta et al.
8,449,406 B1 5/2013 Frame et al.
8,475,293 B2 7/2013 Morin et al.
8,506,420 B2 8/2013 Hocknell et al.
8,535,176 B2 9/2013 Bazzel et al.
8,545,343 B2 10/2013 Boyd et al.
8,574,094 B2 11/2013 Nicolette et al.
8,616,998 B2 * 12/2013 Cole ..... A63B 53/047 473/329
8,657,700 B2 2/2014 Nicolette et al.
8,663,026 B2 3/2014 Blowers et al.
8,690,710 B2 4/2014 Nicolette et al.
8,753,230 B2 6/2014 Stokke et al.
8,790,196 B2 7/2014 Solheim et al.
8,827,832 B2 9/2014 Breier et al.
8,827,833 B2 9/2014 Amano et al.
8,845,455 B2 9/2014 Ban et al.
8,858,362 B1 10/2014 Leposky et al.
D722,351 S 2/2015 Parsons et al.
D722,352 S 2/2015 Nicolette et al.
D723,120 S 2/2015 Nicolette
8,961,336 B1 2/2015 Parsons et al.
D724,164 S 3/2015 Schweigert et al.
D725,208 S 3/2015 Schweiger
D726,265 S 4/2015 Nicolette
D726,846 S 4/2015 Schweiger
9,005,056 B2 4/2015 Pegnatori
D729,892 S 5/2015 Nicolette et al.
D733,234 S 6/2015 Nicolette
9,044,653 B2 6/2015 Wahl et al.
D738,449 S 9/2015 Schweiger
D739,487 S 9/2015 Schweiger
9,192,830 B2 11/2015 Parsons et al.
9,192,832 B2 11/2015 Parsons et al.
9,199,143 B1 12/2015 Parsons et al.
D746,927 S 1/2016 Parsons et al.
D748,214 S 1/2016 Nicolette et al.
D748,215 S 1/2016 Parsons et al.
D748,749 S 2/2016 Nicolette et al.
D753,251 S 4/2016 Schweigert et al.
D753,252 S 4/2016 Schweiger
D755,319 S 5/2016 Nicolette et al.
D756,471 S 5/2016 Nicolette et al.
9,345,938 B2 5/2016 Parsons et al.
9,346,203 B2 5/2016 Parsons et al.
9,352,197 B2 5/2016 Parsons et al.
D759,178 S 6/2016 Nicolette
D760,334 S 6/2016 Schweigert et al.
9,364,727 B2 6/2016 Parsons et al.
9,399,158 B2 7/2016 Parsons et al.
9,421,437 B2 8/2016 Parsons et al.
9,427,634 B2 8/2016 Parsons et al.
9,440,124 B2 9/2016 Parsons et al.
9,468,821 B2 10/2016 Parsons et al.
9,517,393 B2 12/2016 Cardani et al.
9,533,201 B2 1/2017 Parsons et al.
9,550,096 B2 1/2017 Parsons et al.
9,610,481 B2 4/2017 Parsons et al.
9,630,070 B2 4/2017 Parsons et al.
9,636,554 B2 5/2017 Parsons et al.
9,649,540 B2 5/2017 Parsons et al.
9,649,542 B2 5/2017 Nicolette
9,662,547 B2 5/2017 Parsons et al.
9,675,853 B2 6/2017 Parsons et al.
9,750,993 B2 9/2017 Ritchie et al.
9,764,194 B2 9/2017 Parsons et al.
9,782,643 B2 10/2017 Parsons et al.
9,795,842 B1 10/2017 Parsons et al.
9,795,843 B2 10/2017 Parsons et al.
9,814,952 B2 11/2017 Parsons et al.
10,449,428 B2 10/2019 Parsons et al.
10,583,336 B2 3/2020 Parsons et al.
2001/0055996 A1 12/2001 Iwata et al.
2002/0004427 A1 1/2002 Cheng et al.
2002/0019265 A1 * 2/2002 Allen ..... A63B 53/04 473/346
2002/0037775 A1 3/2002 Keelan
2002/0094884 A1 7/2002 Hocknell et al.
2002/0107087 A1 8/2002 Fagot
2003/0139226 A1 7/2003 Cheng et al.
2003/0176231 A1 9/2003 Hasebe
2003/0194548 A1 10/2003 Mcleod et al.
2004/0082401 A1 4/2004 Takeda
2004/0092331 A1 5/2004 Best
2004/0116208 A1 6/2004 De Shiell et al.
2004/0204263 A1 10/2004 Fagot et al.
2004/0266550 A1 12/2004 Gilbert et al.
2005/0009632 A1 1/2005 Schweigert et al.
2005/0014573 A1 1/2005 Lee
2005/0043117 A1 2/2005 Gilbert et al.
2005/0054462 A1 3/2005 Breier et al.
2005/0119066 A1 6/2005 Stites et al.

(56) References Cited

U.S. PATENT DOCUMENTS

| | | | | |
|---|---|---|---|---|
| 2005/0192116 | A1 | 9/2005 | Imamoto | |
| 2005/0239569 | A1 | 10/2005 | Best et al. | |
| 2005/0255936 | A1 | 11/2005 | Huang | |
| 2005/0277485 | A1 | 12/2005 | Hou et al. | |
| 2005/0278931 | A1 | 12/2005 | Deshmukh et al. | |
| 2006/0073906 | A1* | 4/2006 | Chen | A63B 53/0466 473/345 |
| 2006/0111200 | A1 | 5/2006 | Poynor | |
| 2006/0111201 | A1* | 5/2006 | Nishio | A63B 53/0466 473/346 |
| 2006/0229141 | A1 | 10/2006 | Galloway | |
| 2006/0240909 | A1 | 10/2006 | Breier et al. | |
| 2007/0032308 | A1 | 2/2007 | Fagot et al. | |
| 2007/0037633 | A1* | 2/2007 | Thielen | A63B 53/0466 473/346 |
| 2007/0129166 | A1 | 6/2007 | Shimazaki et al. | |
| 2007/0225084 | A1 | 9/2007 | Schweigert et al. | |
| 2008/0022502 | A1* | 1/2008 | Tseng | A63B 53/0475 29/428 |
| 2008/0058113 | A1 | 3/2008 | Nicolette et al. | |
| 2008/0076595 | A1* | 3/2008 | Lai | A63B 53/04 473/332 |
| 2008/0188322 | A1 | 8/2008 | Anderson et al. | |
| 2008/0300065 | A1 | 12/2008 | Schweiger | |
| 2008/0318705 | A1 | 12/2008 | Clausen et al. | |
| 2008/0318706 | A1 | 12/2008 | Larson | |
| 2009/0011858 | A1 | 1/2009 | Binette et al. | |
| 2009/0029790 | A1 | 1/2009 | Nicolette et al. | |
| 2009/0280923 | A1 | 11/2009 | Park et al. | |
| 2010/0130306 | A1 | 5/2010 | Schweiger | |
| 2010/0178999 | A1 | 7/2010 | Nicolette et al. | |
| 2010/0323812 | A1 | 12/2010 | Boyd et al. | |
| 2011/0028240 | A1 | 2/2011 | Wahl et al. | |
| 2011/0111883 | A1 | 5/2011 | Cackett | |
| 2011/0165963 | A1 | 7/2011 | Cackett et al. | |
| 2011/0269567 | A1 | 11/2011 | Ban et al. | |
| 2011/0294596 | A1 | 12/2011 | Ban | |
| 2012/0196702 | A1 | 8/2012 | Shimazaki | |
| 2012/0283036 | A1* | 11/2012 | Stites | A63B 60/00 473/329 |
| 2013/0137532 | A1 | 5/2013 | Deshmukh et al. | |
| 2013/0225319 | A1 | 8/2013 | Kato | |
| 2013/0281226 | A1 | 10/2013 | Ban | |
| 2013/0288823 | A1 | 10/2013 | Hebreo | |
| 2013/0303303 | A1 | 11/2013 | Ban | |
| 2013/0310192 | A1 | 11/2013 | Wahl et al. | |
| 2013/0316842 | A1 | 11/2013 | Demkowski et al. | |
| 2014/0045605 | A1 | 2/2014 | Fujiwara et al. | |
| 2014/0080621 | A1 | 3/2014 | Nicolette et al. | |
| 2014/0128175 | A1 | 5/2014 | Jertson et al. | |
| 2014/0274441 | A1 | 9/2014 | Greer | |
| 2014/0274442 | A1 | 9/2014 | Honea et al. | |
| 2014/0274451 | A1 | 9/2014 | Knight et al. | |
| 2014/0364248 | A1 | 12/2014 | Wahl et al. | |
| 2015/0192116 | A1 | 7/2015 | Haug et al. | |
| 2015/0231454 | A1 | 8/2015 | Parsons et al. | |
| 2015/0231806 | A1 | 8/2015 | Parsons et al. | |
| 2016/0045793 | A1 | 2/2016 | Cardani et al. | |
| 2016/0296804 | A1 | 10/2016 | Parsons et al. | |
| 2016/0317883 | A1 | 11/2016 | Parsons et al. | |
| 2017/0239533 | A1 | 8/2017 | Cole et al. | |
| 2017/0340928 | A1 | 11/2017 | Parsons et al. | |
| 2018/0028882 | A1 | 2/2018 | Hebreo et al. | |
| 2018/0028883 | A1 | 2/2018 | Morin et al. | |
| 2018/0050243 | A1 | 2/2018 | Parsons et al. | |
| 2018/0140910 | A1 | 5/2018 | Parsons et al. | |
| 2018/0318673 | A1 | 11/2018 | Parsons et al. | |

FOREIGN PATENT DOCUMENTS

| | | | |
|---|---|---|---|
| GB | 2249031 | A | 4/1992 |
| JP | 0284972 | U | 7/1990 |
| JP | H08257181 | A | 10/1996 |
| JP | H10127832 | A | 5/1998 |
| JP | H10277187 | A | 10/1998 |
| JP | 2001346924 | A | 12/2001 |
| JP | 2002143356 | A | 5/2002 |
| JP | 2004313777 | A | 11/2004 |
| JP | 2005218510 | A | 8/2005 |
| JP | 2013043091 | A | 3/2013 |
| WO | 9215374 | A1 | 9/1992 |

OTHER PUBLICATIONS

Kozuchowski, Zak, "Callaway Mack Daddy 2 PM Grind Wedges" (http://goltwrz.com/276203/callaway-mack-daddy-2-om-grind-wedges/), www.golfwrx.com, Goltwrx Holdings, LLC, Published Jan. 21, 2015.

PCT/US16/42075: International Search Report and Written Opinion dated Sep. 22, 2016 (13 Pages).

PCT/US19/17464: International Search Report and Written Opinion dated Apr. 29, 2019 (9 Pages).

PCT/US19/54104: International Search Report and Written Opinion dated Dec. 30, 2019 (10 Pages).

PCT/US2015/016666: International Search Report and Written Opinion dated May 14, 2015 (8 Pages).

PCT/US2018/023617: International Search Report and Written Opinion dated Oct. 10, 2019 (10 Pages).

Rocketbladez Press Release, "Golfballed", http://golfballed.com/index.php?option=com_content&view=article&id=724:taylormade- . . . Oct. 13, 2017, Published Jan. 3, 2013.

Taylor Made Golf Company, Inc., https://taylormadegolf.com/on/demandware.static/-/sites-tmag-library/default/v1459859109590/docs/productspecs/tm_s2013_catalog18.pdf., Published Jan. 2013.

U.S. Appl. No. 29/512,313, Nicolette, "Golf Club Head," filed Dec. 18, 2014.

Wall, Jonathan, "Details: Phil's Prototype Mack Daddy PM-Grind Wedge," (http://www.pgatour.com/equipmentreport/2015/01/21/callaway-wedge.html),www.pgatour.com, PGA Tour, Inc., Published Jan. 21, 2015.

* cited by examiner

GOLF CLUB HEADS AND METHODS TO MANUFACTURE GOLF CLUB HEADS

CROSS REFERENCE

This application is a continuation of application Ser. No. 16/789,167, filed Feb. 12, 2020. This application is a continuation-in-part of application Ser. No. 17/038,195 filed Sep. 30, 2020, which is a continuation of application Ser. No. 16/365,343, filed Mar. 26, 2019, now U.S. Pat. No. 10,821,340, which is a continuation of application Ser. No. 15/841,022, filed Dec. 13, 2017, now U.S. Pat. No. 10,265,590, which is a continuation of application Ser. No. 15/701,131, filed Sep. 11, 2017, now abandoned, which is a continuation-in-part of application Ser. No. 15/685,986, filed Aug. 24, 2017, now U.S. Pat. No. 10,279,233, which is a continuation of application Ser. No. 15/628,251, filed Jun. 20, 2017, now abandoned, which is a continuation of application Ser. No. 15/209,364, filed on Jul. 13, 2016, now U.S. Pat. No. 10,293,229, which is a continuation of International Application No. PCT/US15/16666, filed Feb. 19, 2015, which claims the benefit of U.S. Provisional Application No. 61/942,515, filed Feb. 20, 2014, U.S. Provisional Application No. 61/945,560, filed Feb. 27, 2014, U.S. Provisional Application No. 61/948,839, filed Mar. 6, 2014, U.S. Provisional Application No. 61/952,470, filed Mar. 13, 2014, U.S. Provisional Application No. 61/992,555, filed May 13, 2014, U.S. Provisional Application No. 62/010,836, filed Jun. 11, 2014, U.S. Provisional Application No. 62/011,859, filed Jun. 13, 2014, and U.S. Provisional Application No. 62/032,770, filed Aug. 4, 2014.

U.S. application Ser. No. 15/209,364, filed on Jul. 13, 2016, now U.S. Pat. No. 10,293,229, is also a continuation of application Ser. No. 14/618,501, filed Feb. 10, 2015, now U.S. Pat. No. 9,427,634, which is a continuation of application Ser. No. 14/589,277, filed Jan. 5, 2015, now U.S. Pat. No. 9,421,437, which is a continuation of application Ser. No. 14/513,073, filed Oct. 13, 2014, now U.S. Pat. No. 8,961,336, which is a continuation of application Ser. No. 14/498,603, filed Sep. 26, 2014, now U.S. Pat. No. 9,199,143, which claims the benefits of U.S. Provisional Application No. 62/041,538, filed Aug. 25, 2014."

This application is a continuation-in-part of application Ser. No. 16/376,868, filed Apr. 5, 2019, which is a continuation of application Ser. No. 15/478,542, filed Apr. 4, 2017, now U.S. Pat. No. 10,286,267, which is a continuation of application Ser. No. 14/709,195, filed May 11, 2015, now U.S. Pat. No. 9,649,542, which claims the benefit of U.S. Provisional Application No. 62/021,415, filed Jul. 7, 2014, U.S. Provisional Application No. 62/058,858, filed Oct. 2, 2014, and U.S. Provisional Application No. 62/137,494, filed Mar. 24, 2015.

This application is a continuation-in-part of application Ser. No. 16/929,552, filed Jul. 15, 2020, which is a continuation of application Ser. No. 15/683,564, filed Aug. 22, 2017, now U.S. Pat. No. 10,716,978, which is a continuation of application Ser. No. 15/598,949, filed May 18, 2017, now U.S. Pat. No. 10,159,876, which is a continuation of application Ser. No. 14/711,596, filed May 13, 2015, now U.S. Pat. No. 9,675,853, which claims the benefit of U.S. Provisional Application No. 62/118,403, filed Feb. 19, 2015, U.S. Provisional Application No. 62/159,856, filed May 11, 2015, U.S. Provisional Application No. 61/992,555, filed May 13, 2014, U.S. Provisional Application No. 62/010,836, filed Jun. 11, 2014, U.S. Provisional Application No. 62/011,859, filed Jun. 13, 2014, U.S. Provisional Application No. 62/032,770, filed Aug. 4, 2014, and U.S. Provisional Application No. 62/041,538, filed Aug. 25, 2014.

This application is a continuation-in-part of application Ser. No. 16/376,863, filed Apr. 5, 2019, which is a continuation of application Ser. No. 15/958,288, filed Apr. 20, 2018, now abandoned, which is a continuation of application Ser. No. 15/947,383, filed Apr. 6, 2018, now abandoned, which is a continuation of application Ser. No. 15/842,632, filed Dec. 14, 2017, now U.S. Pat. No. 10,029,159, which is a continuation of application Ser. No. 15/263,018, filed Sep. 12, 2016, now U.S. Pat. No. 9,878,220, which is a continuation of application Ser. No. 15/043,090, filed Feb. 12, 2016, now U.S. Pat. No. 9,468,821, which claims the benefit of U.S. Provisional Application No. 62/209,780, filed Aug. 25, 2015, and U.S. Provisional Application No. 62/277,636, filed Jan. 12, 2016.

This application is a continuation-in-part of application Ser. No. 17/038,155, filed Sep. 30, 2020, which is a continuation of application Ser. No. 16/351,143, filed Mar. 12, 2019, now U.S. Pat. No. 10,821,339, which is a continuation of Ser. No. 15/842,583, filed Dec. 14, 2017, now U.S. Pat. No. 10,232,235, which is a continuation of application Ser. No. 15/631,610, filed Jun. 23, 2017, now abandoned, which is a continuation of application Ser. No. 15/360,707, filed Nov. 23, 2016, now U.S. Pat. No. 10,029,158, which is a continuation of application Ser. No. 15/043,106, filed Feb. 12, 2016, now U.S. Pat. No. 9,533,201, which claims the benefit of U.S. Provisional Application No. 62/275,443, filed Jan. 6, 2016, and U.S. Provisional Application No. 62/276,358, filed Jan. 8, 2016.

This application is a continuation-in-part of application Ser. No. 16/785,336, filed Feb. 7, 2020, which is a continuation of application Ser. No. 15/703,639, filed Sep. 13, 2017, now U.S. Pat. No. 10,596,424, which is a continuation-in-part of application Ser. No. 15/484,794, filed Apr. 11, 2017, now U.S. Pat. No. 9,814,952, which claims the benefit of U.S. Provisional Application No. 62/321,652, filed Apr. 12, 2016.

This application is a continuation-in-part of application Ser. No. 16/774,449, filed Jan. 28, 2020, which is a continuation of application Ser. No. 16/179,406, filed Nov. 2, 2018, now U.S. Pat. No. 10,583,336, which claims the benefit of U.S. Provisional Application No. 62/581,456, filed Nov. 3, 2017.

This application is a continuation-in-part of application Ser. No. 17/099,362, filed Nov. 16, 2020, which is a continuation of application Ser. No. 16/820,136, filed Mar. 16, 2020, now U.S. Pat. No. 10,874,919, which is a continuation of application Ser. No. 16/590,105, filed Oct. 1, 2019, now U.S. Pat. No. 10,632,349, which claims the benefit of U.S. Provisional Application No. 62/908,467, filed Sep. 30, 2019, U.S. Provisional Application No. 62/903,467, filed Sep. 20, 2019, U.S. Provisional Application No. 62/877,934, filed Jul. 24, 2019, U.S. Provisional Application No. 62/877,915, filed Jul. 24, 2019, U.S. Provisional Application No. 62/865,532, filed Jun. 24, 2019, U.S. Provisional Application No. 62/826,310, filed Mar. 29, 2019, and U.S. Provisional Application No. 62/814,959, filed Mar. 7, 2019.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

Figure 1:
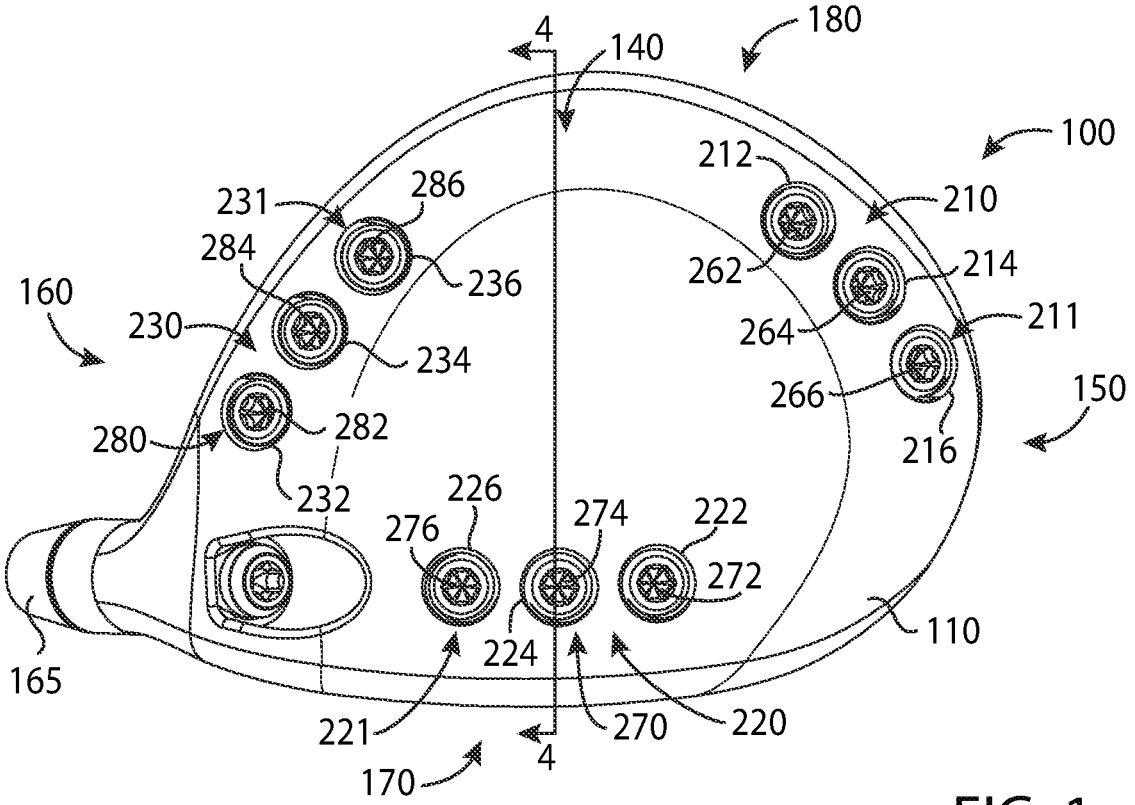
FIGS. 1, 2, 3, and 4 depict a bottom perspective view, a toe-side perspective view, a heel-side perspective view, and a cross-sectional perspective view (along line 4-4 of FIG. 1), respectively, of a golf club head according to an embodiment of the apparatus, methods, and articles of manufacture described herein.
Figure 2:
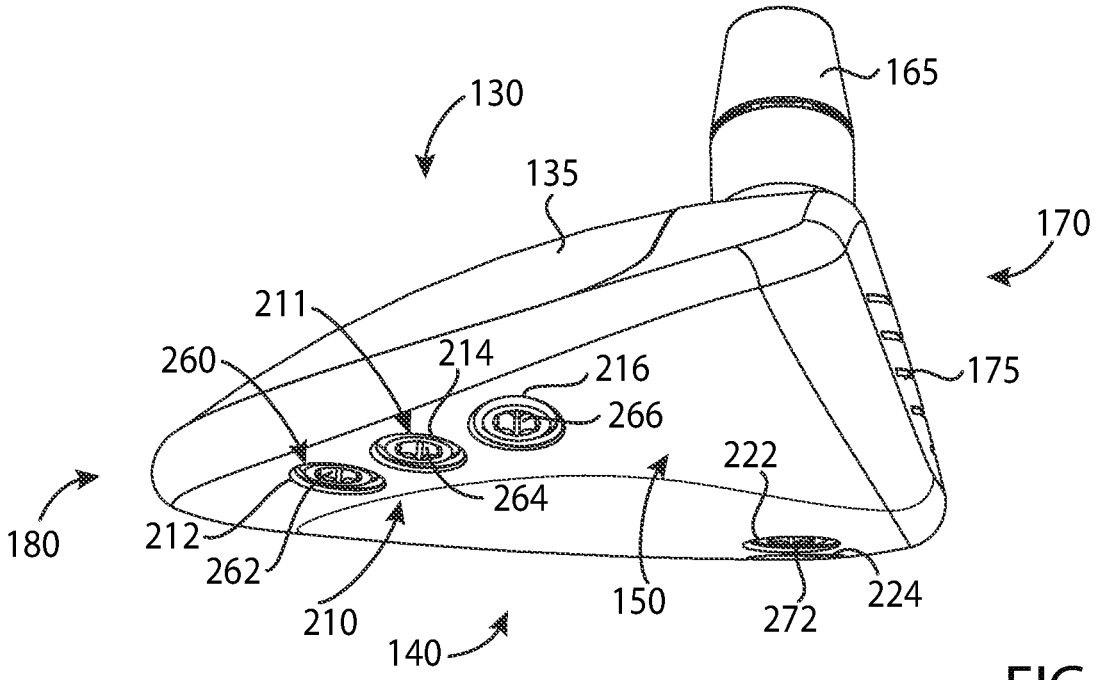
Figure 3:
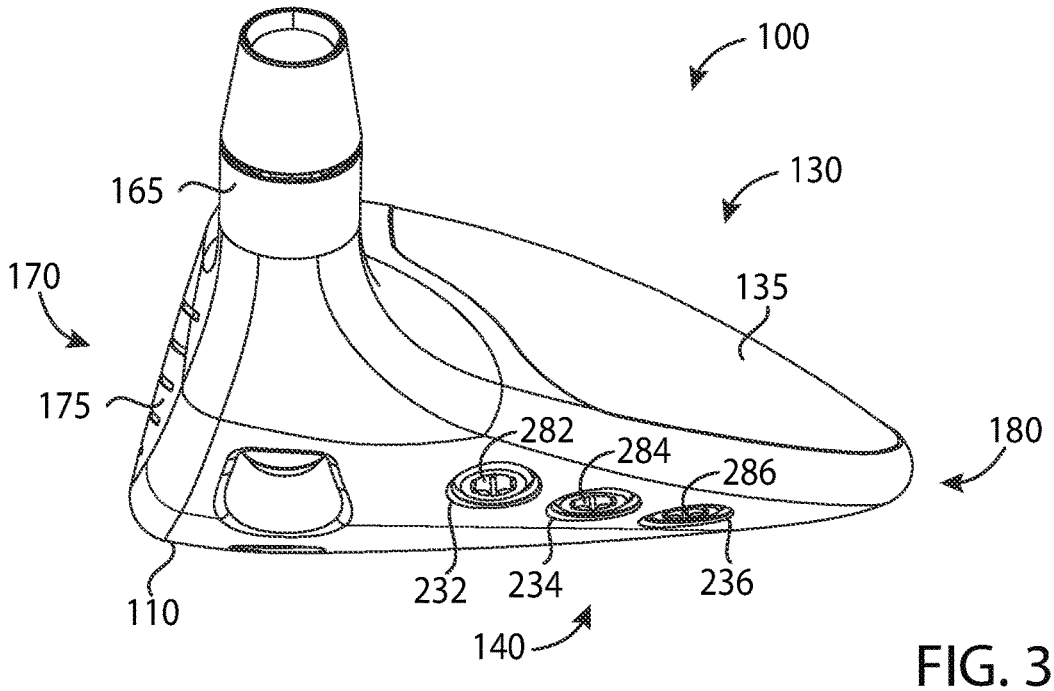

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads, golf clubs, and methods to manufacture golf club heads and golf clubs are described herein. The following U.S. Patents and Patent Applications, which are collectively referred to herein as "the incorporated by reference applications," are incorporated by reference herein in their entirety: U.S. Pat. Nos. 8,961,336; 9,199,140; 9,199,143; 9,352,197; 9,399,158; 9,468,821; 9,533,201; 9,550,096; 9,610,481; 9,630,070; 9,669,270; 9,675,853; 9,782,643; 9,795,842; 9,814,952; 9,821,201; 9,833,667; 9,861,867; 9,981,160; 10,213,659; 10,413,787; and U.S. patent application Ser. No. 15/209,364, filed Jul. 13, 2016; U.S. patent application Ser. No. 15/462,281, filed Mar. 17, 2017; U.S. patent application Ser. No. 15/785,001, filed Oct. 16, 2017; U.S. patent application Ser. No. 15/876,877, filed Jan. 22, 2018; U.S. patent application Ser. No. 15/934,579, filed Mar. 23, 2018; U.S. patent application Ser. No. 16/039,496, filed Jul. 19, 2018; U.S. patent application Ser. No. 16/179,406, filed Nov. 2, 2018; U.S. patent application Ser. No. 16/205,583, filed Nov. 30, 2018; U.S. patent application Ser. No. 16/422,661, filed May 24, 2019; and U.S. patent application Ser. No. 16/590,105, filed Oct. 1, 2019. The apparatus, methods, and articles of manufacture described herein are not limited in this regard.

Figure 56:
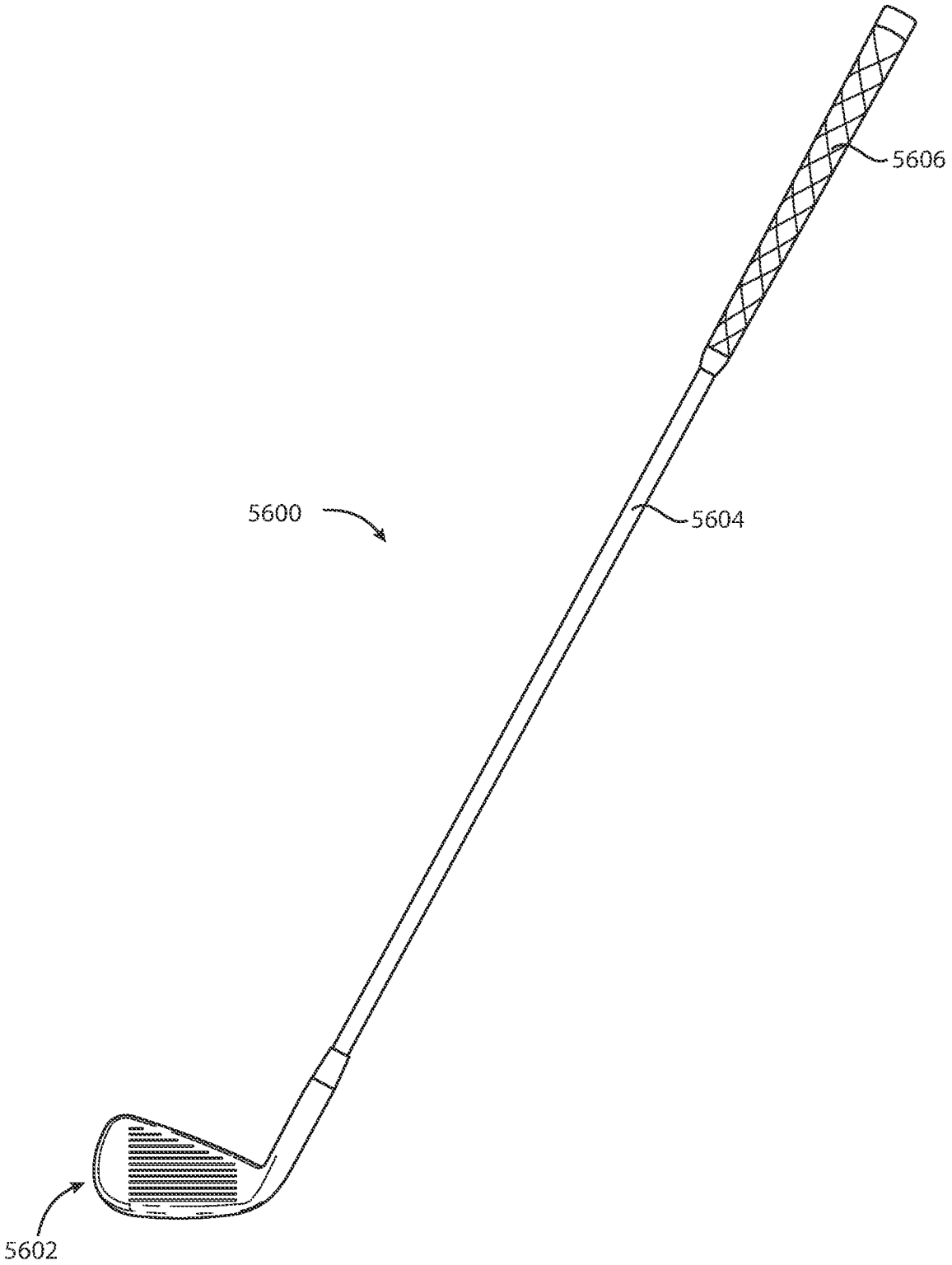
FIG. 56 depicts a golf club according to an embodiment of the apparatus, methods, and articles of manufacture described herein.

In the example of FIGS. 1-4, a golf club head 100 may include a body portion 110 with a top portion 130 having a crown portion 135, a bottom portion 140, a toe portion 150, a heel portion 160, a front portion 170, and a rear portion 180. The crown portion 135 may be a separate piece that may be attached to the top portion 130 and constructed from a composite material. The bottom portion 140 may include a skirt portion (not shown) defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The front portion 170 may include a face portion 175 to engage a golf ball (not shown). The golf club head 100 may have a neutral axis 401. The neutral axis 401 may be perpendicular to the face portion 175 and may intersect a center of the face portion 175. The body portion 110 may also include a hosel portion 165 for receiving a shaft (an example golf club 5600 having a golf club head 5602, a shaft 5604, and a grip 5606 is shown in FIG. 56). Alternatively, the body portion 110 may include a bore instead of the hosel portion 165. The body portion 110 may be made from any one or a combination of materials described herein or described in any of the incorporated by reference applications. A maximum front-to-rear distance of the golf club head 100 may be greater than a maximum heel-to-toe distance of the golf club head 100. Although FIGS. 1-4 may depict a particular type of golf club head (e.g., driver-type club head), the apparatus methods, and articles of manufacture described herein may be applicable to other types of club heads (e.g., a fairway wood-type club head, a hybrid-type club head, an iron-type club head, a putter-type club head). The apparatus, methods, and articles of manufacture described herein are not limited in this regard.

The bottom portion 140 may include a plurality of port regions, which are shown for example as a first port region 210 with a first set of ports 211 (generally shown as ports 212, 214, and 216) near the toe portion 150, a second port region 220 with a second set of ports 221 (generally shown as ports 222, 224, and 226) near the front portion 170, and a third port region 230 with a third set of ports 231 (generally shown as ports 232, 234, and 236) near the heel portion 160. Although FIGS. 1-4 show a certain configuration of port regions and ports, the number of port regions, the number and configuration of ports in each region, and the location of the ports may be similar to any of the golf club heads described herein on in any of the incorporated by reference applications. The body portion 110 may also include a plurality of mass portions, shown as a first set of mass portions 260 (generally shown as mass portions 262, 264, and 266), a second set of mass portions 270 (generally shown as mass portions 272, 274, and 276), and a third set of mass portions 280 (generally shown as mass portions 282, 284 and 286). Each port may interchangeably receive any of the mass portions. The masses of the first set of mass portion 260, the second set of mass portions 270 and/or the third set of mass portions 280 may be similar or different. Accordingly, by using mass portions having similar or different masses in each of the ports of the port regions 210, 220 and/or 230, the overall mass in each port region and/or the mass distribution in each port region may be adjusted as described herein and in any of the incorporated by reference applications to generally optimize and/or adjust the swing weight, center of gravity, moment of inertia, and/or an overall feel of the golf club head for an individual using the golf club head 100. The apparatus, methods, and articles of manufacture described herein are not limited in this regard.

Figure 4:
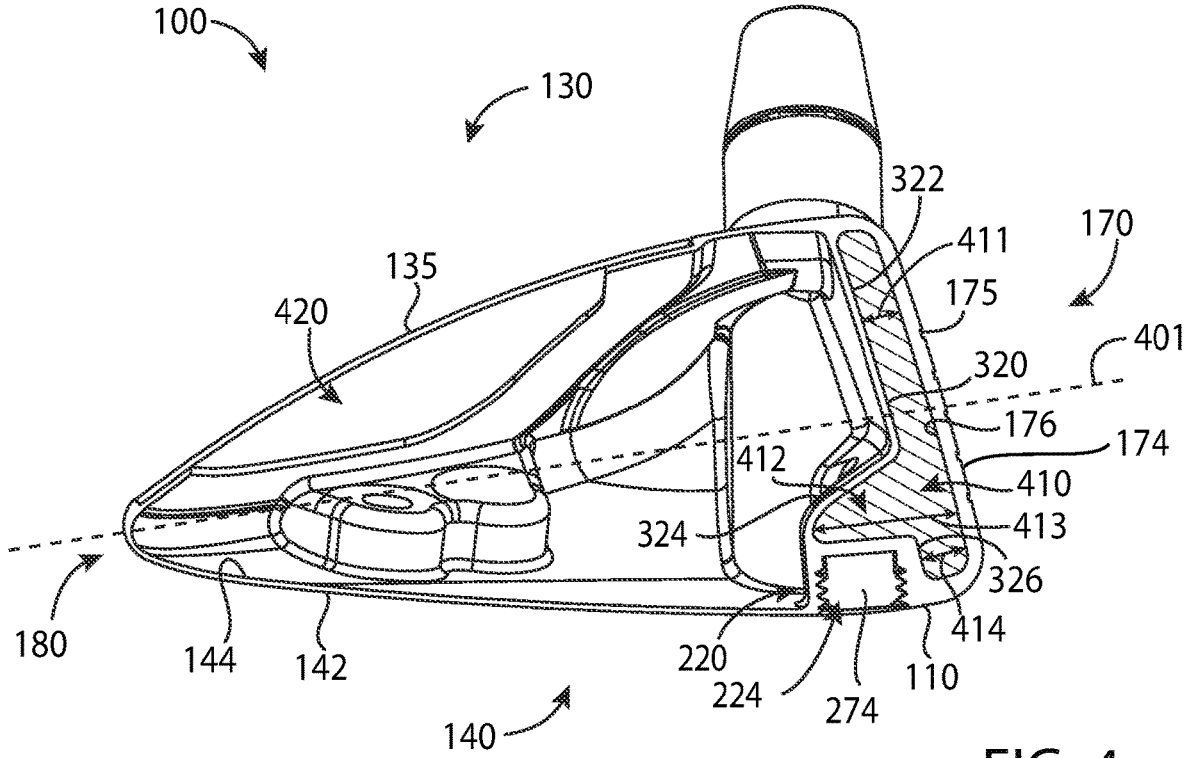

Certain regions of the interior of the body portion 110 may include a polymer material, which may also be referred to herein as the filler material, similar to any of the polymer materials described herein or described in any of the incorporated by reference applications. The filler material may dampen vibration, dampen noise, lower the center of gravity and/or provide a better feel and sound for the golf club head 100 when striking a golf ball (not shown). The golf club head 100, may have one or more interior regions and/or cavities that may include a filler material similar to any of the golf club heads described herein or described in any of the incorporated by reference applications. In one example, as shown in FIG. 4, the body portion 110 may include a cavity wall portion 320. The cavity wall portion 320 may form a first interior cavity portion 410 and a second interior cavity portion 420 within the body portion 110. The first interior cavity portion 410 and the second interior cavity portion 420 may be separated by the cavity wall portion 320. Alternatively, the first interior cavity portion 410 and the second interior cavity portion 420 may be connected through one or more openings in the cavity wall portion 320. The apparatus, methods, and articles of manufacture described herein are not limited in this regard.

As illustrated in FIG. 4, the cavity wall portion 320 may include a first portion 322 extending from a location at or proximate to the top portion 130 toward the bottom portion 140. The first portion 322 may extend toward the bottom portion 140 at a certain angle or orientation relative to the face portion 175. In one example, the first portion 322 may extend toward the bottom portion 140 and away from the face portion 175. Accordingly, a first width 411 (WO of the first interior cavity portion 410 may increase in a direction from the top portion 130 to the bottom portion 140. In another example, the first portion 322 may extend toward the bottom portion 140 and toward the face portion 175. Accordingly, the first width 411 of the first interior cavity portion 410 may decrease in a direction from the top portion 130 to the bottom portion 140. In the illustrated example of FIG. 4, the first portion 322 of the of the cavity wall portion 320 may extend from a location at or proximate to the top portion 130 generally parallel or substantially parallel with the face portion 175. Accordingly, the first width 411 of the first interior cavity portion 410 may be constant or substantially constant. The apparatus, methods, and articles of manufacture described herein are not limited in this regard.

The first interior cavity portion 410 may include an enlarged cavity portion 412 between the top portion 130 and the bottom portion 140. As shown in the illustrated example of FIG. 4, the enlarged cavity portion 412 extends partially or fully over the second port region 220. Accordingly, the enlarged cavity portion 412 may have a second width 413 ($W_{C2}$) of the first interior cavity portion 410 that may be greater than the first width 411 of the first interior cavity portion 410. The second width 413 may be about two times greater than the first width 411. The second width 413 may be at least two times greater than the first width 411. The enlarged cavity portion 412 may be located at least partially below the neutral axis 401 of the golf club head 100. The enlarged cavity portion 412 may be located wholly below a neutral axis 401 of the golf club head 100. The first width 411 may be located above the neutral axis 401. The second width 413 may be located below the neutral axis 401. The enlarged cavity portion 412 may be defined by a second wall portion 324 that may extend from the first wall portion 322 toward the rear portion 180 and the bottom portion 140, and traverse back over the second port region 220. The first interior cavity portion 410 may include a third wall portion 326 that extends from the second wall portion 324 to a location at or proximate to the bottom portion 140. The first interior cavity portion 410 may have a third width 414 ($W_{C3}$) extending from the third wall portion 326 to the back surface 176 of the face portion 175. The third width 414 may be located below the enlarged cavity portion 412. The third width 414 may be located below the second width 413. The third width 414 may be less than the second width 413. The third width 414 may be substantially equal to the first width 411. As shown in the illustrated example of FIG. 4, the third width 414 may be located between the second port region 220 and the face portion 175. The third width 414 may be located proximate to the bottom portion. In another example, the first width 411 may be similar to the second width 413 of the first interior cavity portion 410 (not shown). Accordingly, the first wall portion 322 of the cavity wall portion 320 may be located farther back toward the rear portion 180 than the location of the first wall portion 322 shown in FIG. 4 such that the portion of the first interior cavity portion 410 above the second port region 220 extends over the one or more ports of the second port region 220. In other examples, the first interior cavity portion 410 may be configured similar any of the interior cavities described herein and shown in FIGS. 5-13. The apparatus, methods, and articles of manufacture described herein are not limited in this regard.

In one example, the first interior cavity portion 410 may be unfilled (i.e., empty space). Alternatively, the first interior cavity portion 410 may be partially (i.e., less than 100% filled) or entirely filled with a filler material (i.e., a cavity filling portion) to absorb shock, isolate vibration, dampen noised, and/or provide structural support for the face portion. For example, at least 50% of the first interior cavity portion 410 may be filled with a TPE material to absorb shock, isolate vibration, and/or dampen noise when the golf club head 100 strikes a golf ball via the face portion 175. In one example, the first interior cavity portion 410 may be partially or entirely filled with a filler material through a port (e.g. port 224) located in the bottom portion 140. In one example, as shown in FIG. 4, the port 224 may include an opening that accesses the first interior cavity portion 410. The opening may provide a fluid pathway for filler material to be introduced to the first interior cavity portion 410. The apparatus, methods, and articles of manufacture described herein are not limited in this regard.

When the face portion 175 of the golf club head 100 strikes a golf ball, the face portion 175 and the filler material may deform and/or compress. The kinetic energy of the impact may be transferred to the face portion 175 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 100. The apparatus, methods, and articles of manufacture described herein are not limited in this regard.

With the support of the cavity wall portion 320 to form the first interior cavity portion 410 and filling at least a portion of the first interior cavity portion 410 with a filler material, the face portion 175 may be relatively thin without degrading the structural integrity, sound, and/or feel of the golf club head 100. In one example, the face portion 175 may have a thickness of less than or equal to 0.075 inch (e.g., a distance between a front surface 174 and the back surface 176). In another example, the face portion 175 may have a thickness of less than or equal to 0.2 inch. In another example, the face portion 175 may have a thickness of less than or equal to 0.06 inch. In yet another example, the face portion 175 may have a thickness of less than or equal to 0.05 inch. Further, the face portion 175 may have a thickness of less than or equal to 0.03 inch. In yet another example, a thickness of the face portion 175 may be greater than or equal to 0.03 inch and less than or equal to 0.2 inch. The apparatus, methods, and articles of manufacture described herein are not limited in this regard.

In the illustrated example of FIGS. 1-4, the second interior cavity portion 420 may be unfilled (i.e., empty space). Alternatively (not shown), the second interior cavity portion 420 may be partially or entirely filled with a filler material (i.e., a cavity filling portion), which may include one or more similar or different types of materials described herein and may be different or similar to the filler material used to fill the first interior cavity portion 410. The apparatus, methods, and articles of manufacture described herein are not limited in this regard.

Figure 5:
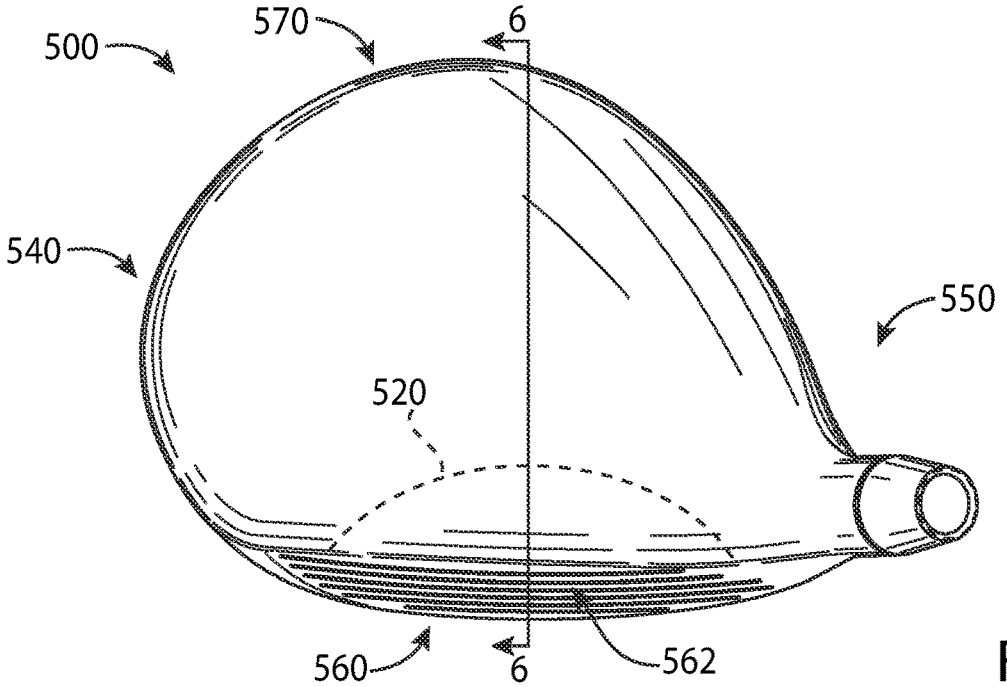
FIGS. 5, 6, and 7 depict a top view, a schematic cross-sectional view (along line 6-6 of FIG. 5), and a front view, respectively, of a golf club head according to another embodiment of the apparatus, methods, and articles of manufacture described herein.
Figure 6:
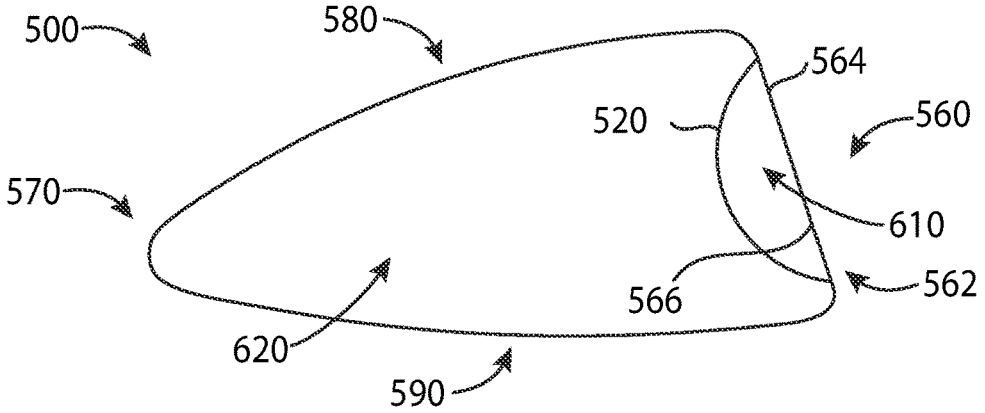
Figure 7:
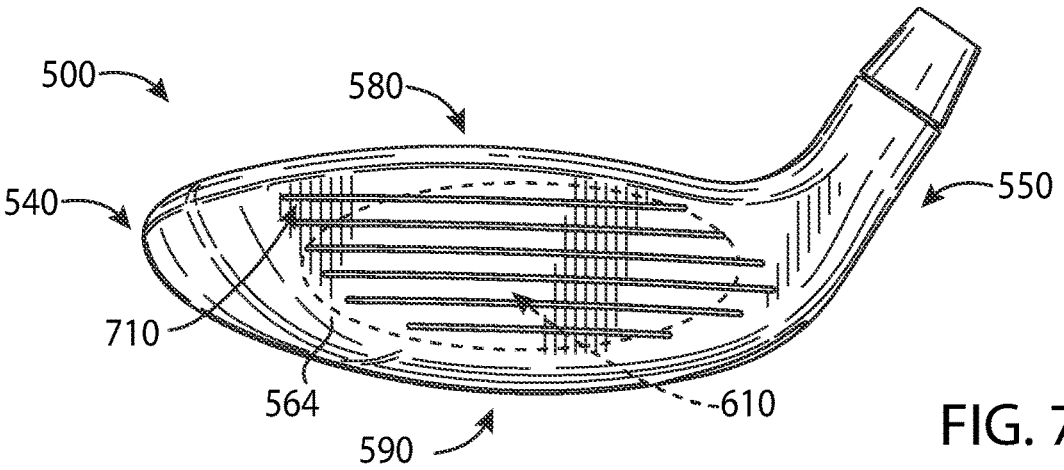

While each of the examples herein may describe a certain type of golf club head, the apparatus, methods, and articles of manufacture described herein may be applicable to other types of golf club heads. Referring to FIGS. 5-7, for example, a golf club head 500 may include a body portion 510 and a cavity wall portion 520. Although FIGS. 5-7 may depict a particular type of club head (e.g., a fairway wood-type club head), the apparatus, methods, and articles of manufacture described herein may be applicable to other types of club head (e.g., a driver-type club head, a hybrid-type club head, an iron-type club head, a putter-type club head, etc.). The apparatus, methods, and articles of manufacture described herein are not limited in this regard.

The body portion 510 may include a toe portion 540, a heel portion 550, a front portion 560, a rear portion 570, a top portion 580 (e.g., a crown portion), and a bottom portion 590 (e.g., a sole portion). The front portion 560 may include a face portion 562 (e.g., a strike face). The face portion 562 may include a front surface 564 and a back surface 566. The front surface 564 may include a plurality of grooves, generally shown as 710 in FIG. 7. The cavity wall portion 520 may form a first interior cavity portion 610 and a second interior cavity portion 620 within the body portion 510. As illustrated in FIG. 6, for example, the cavity wall portion 520 may extend from the back surface 566 of the face portion 562. The cavity wall portion 520 may be a single curved wall section. In particular, the cavity wall portion 520 may have a convex arc profile relative to the back surface 566 (e.g., C shape) to form a dome-like structure with an elliptical base (e.g., FIG. 7) or a circular base on the back surface 566. In another example, the cavity wall portion 520 may form a cone-like structure or a cylinder-like structure with the body portion 510. Alternatively, the cavity wall portion 520 may be a concave arc profile relative to the back surface 566. The apparatus, methods, and articles of manufacture described herein are not limited in this regard.

The first interior cavity portion 610 may be partially or entirely filled with a suitable filler material such as any of the filler materials described herein or described in any of the incorporated by reference applications to absorb shock, isolate vibration, dampen noise, and/or provide structural support. The elastic polymer material may be injected into the first interior cavity portion 610 via an injection molding process via a port on the face portion 562. With the support of the cavity wall portion 520 to form the first interior cavity portion 610 and filling at least a portion of the first interior cavity portion 610 with an elastic polymer material, the face portion 562 may be relatively thin without degrading the structural integrity, sound, and/or feel of the golf club head 500. The apparatus, methods, and articles of manufacture described herein are not limited in this regard.

Figure 8:
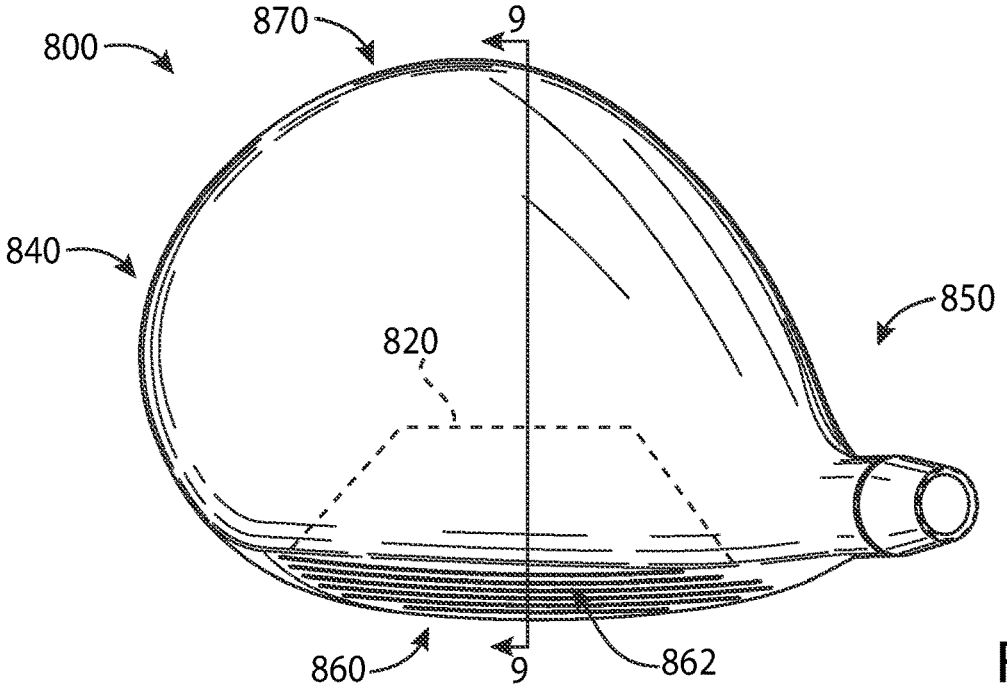
FIGS. 8, 9, and 10 depict a top view, a schematic cross-sectional view (along line 9-9 of FIG. 8), and a front view, respectively, of a golf club head according to another embodiment of the apparatus, methods, and articles of manufacture described herein.
Figure 9:
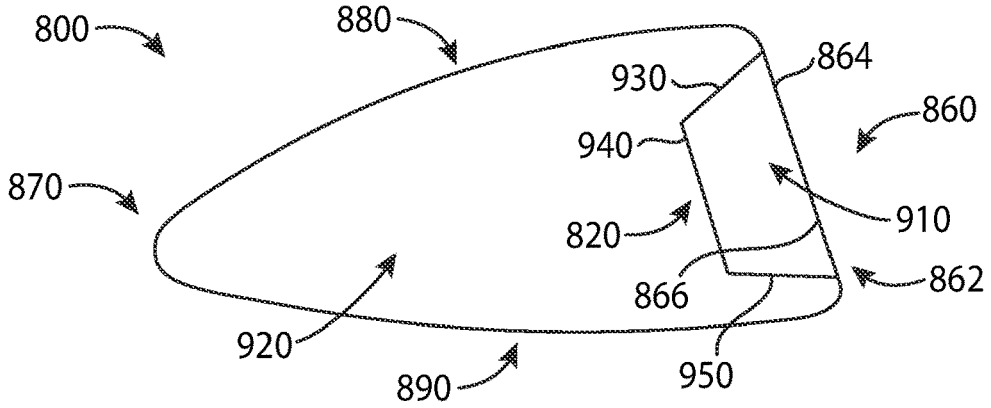
Figure 10:
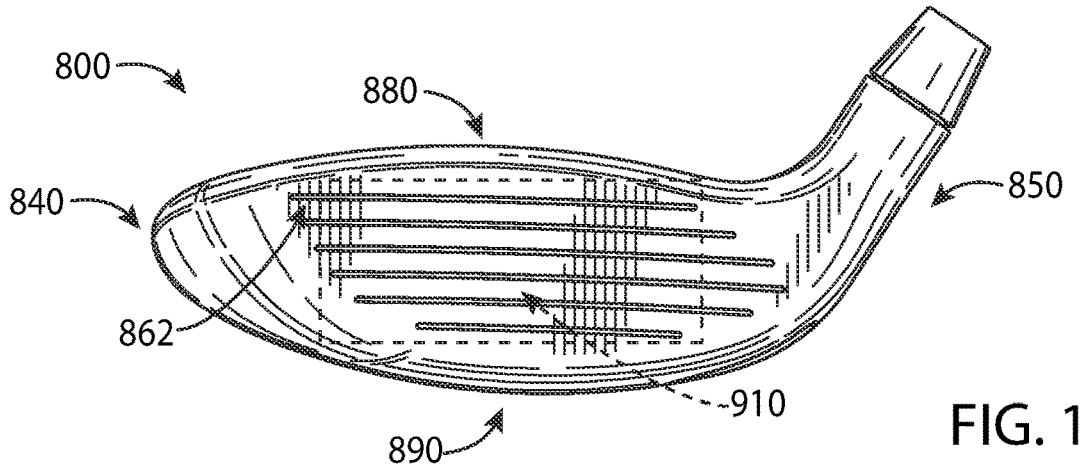

The cavity wall portion 520 may include multiple sections. Turning to FIGS. 8-10, for example, a golf club head 800 may include a body portion 810 and a cavity wall portion 820. The body portion 810 may include a toe portion 840, a heel portion 850, a front portion 860, a rear portion 870, a top portion 880 (e.g., a crown portion), and a bottom portion 890 (e.g., a sole portion). The front portion 860 may include a face portion 862 (e.g., a strike face) with a front surface 864 and a back surface 866. The cavity wall portion 820 may extend from the back surface 866 to form a first interior cavity portion 910 and a second interior cavity portion 920 within the body portion 810. The cavity wall portion 820 may include two or more wall sections, generally shown as 930, 940, and 950 in FIG. 9. Similar to the first interior cavity portion 610 (FIGS. 5-7), the first interior cavity portion 910 may be partially or entirely filled with a filler material. The filler material may be injected into the first interior cavity portion 910 via an injection molding process via a port on the face portion 862. The apparatus, methods, and articles of manufacture described herein are not limited in this regard.

Figure 11:
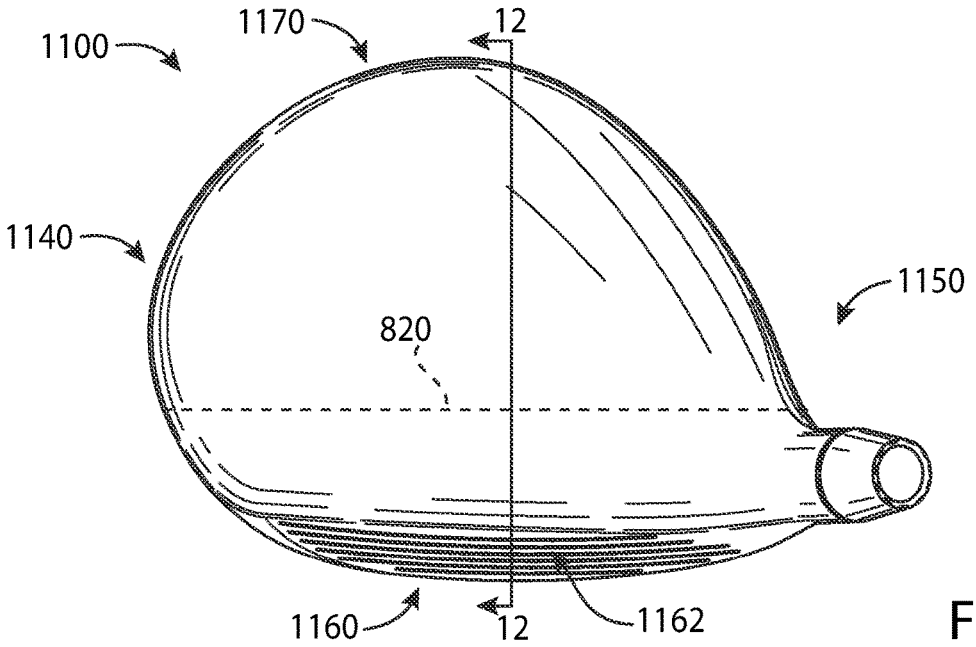
FIGS. 11, 12, and 13 depict a top view, a schematic cross-sectional view (along line 12-12 of FIG. 11), and another schematic cross-sectional view (along line 12-12 of FIG. 11), respectively, of a golf club head according to yet another embodiment of the apparatus, methods, and articles of manufacture described herein.
Figure 12:
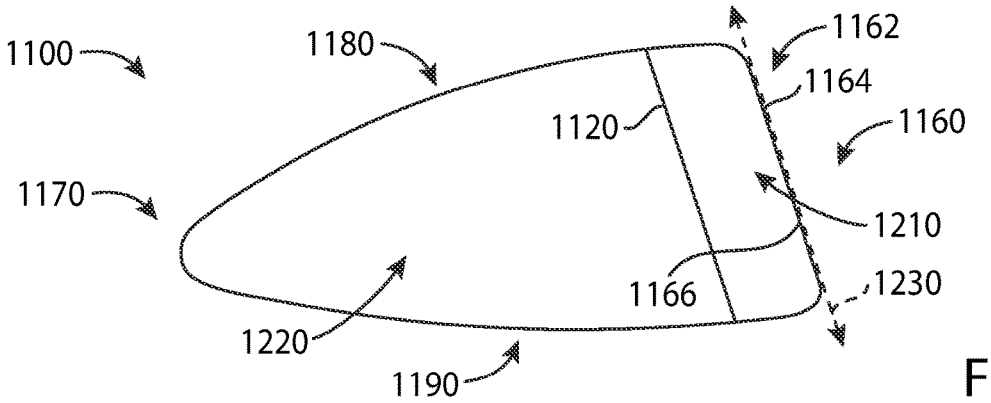
Figure 13:
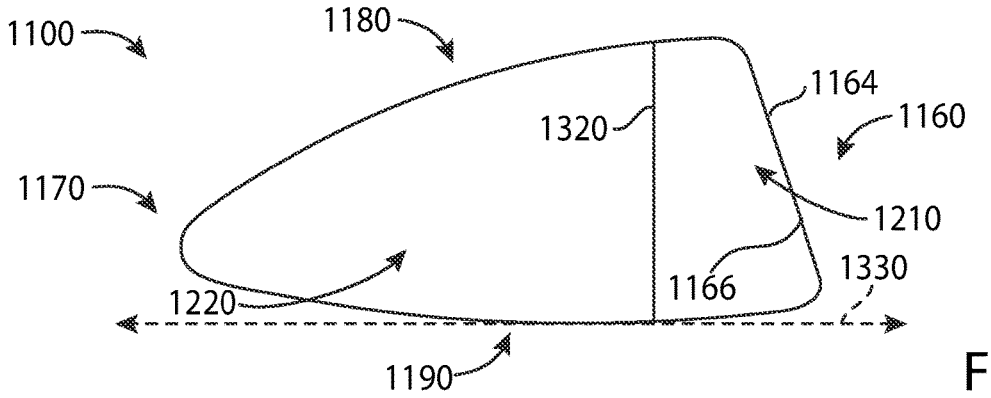

As illustrated in FIGS. 11 and 12, for example, a golf club head 1100 may include a body portion 1110 and a cavity wall portion 1120. The body portion 1110 may include a toe portion 1140, a heel portion 1150, a front portion 1160, a rear portion 1170, a top portion 1180 (e.g., a crown portion), and a bottom portion 1190 (e.g., a sole portion). The front portion 1160 may include a face portion 1162 (e.g., a strike face) with a front surface 1164 and a back surface 1166. The face portion 1162 may be associated with a loft plane 1230 that defines the loft angle of the golf club head 1100. The cavity wall portion 1120 may be a single flat wall section. In particular, the cavity wall portion 1120 may extend between the toe portion 1140 and the heel portion 1150 and between the top portion 1180 and the bottom portion 1190 to form a first interior cavity portion 1210 and a second interior cavity portion 1220 within the body portion 1110. The cavity wall portion 1120 may be parallel or substantially parallel to the loft plane 1230. Alternatively, as shown in FIG. 13, a cavity wall portion 1320 may be perpendicular or substantially perpendicular to a ground plane 1330. Similar to the interior cavity 610 portion (FIGS. 5-7) and interior cavity 910 portion (FIGS. 8-10), the first interior cavity portion 1210 may be partially or entirely filled with an elastic polymer or elastomer material. The elastic polymer material may be injected into the first interior cavity portion 1210 via an injection molding process via a port on the face portion 1162 and/or the bottom portion 1190 as described herein or described in any of the incorporated by reference applications. The apparatus, methods, and articles of manufacture described herein are not limited in this regard.

Alternatively, the cavity wall portion 1120 may extend between the bottom portion 1190 and a top-and-front transition region (i.e., a transition region between the top portion 1180 and the front portion 1160) so that the cavity wall portion 1120 and the loft plane 1230 may not be parallel to each other. In another example, the cavity wall portion 1120 may extend between the top portion 1180 and a bottom-and-front transition region (i.e., a transition region between the bottom portion 1190 and the front portion 1160) so that the cavity wall portion 1120 and the loft plane 1230 may be not parallel to each other. Although FIGS. 11-13, may depict the cavity wall portions 1120 and 1320 being flat or substantially flat, the cavity wall portions 1120 and/or 1320 may be concave or convex relative to the face portion 1162. The apparatus, methods, and articles of manufacture described herein are not limited in this regard.

Figure 14:
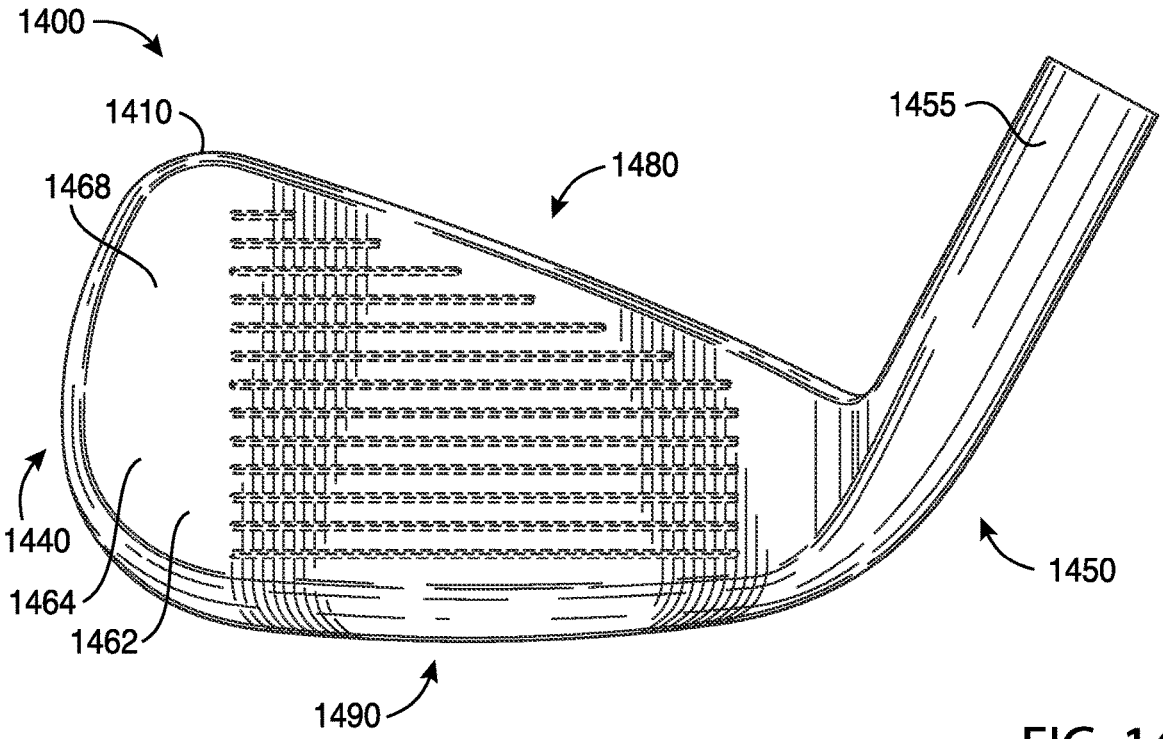
FIG. 14 depicts a front view of a golf club head according to an embodiment of the apparatus, methods, and articles of manufacture described herein.
Figure 15:
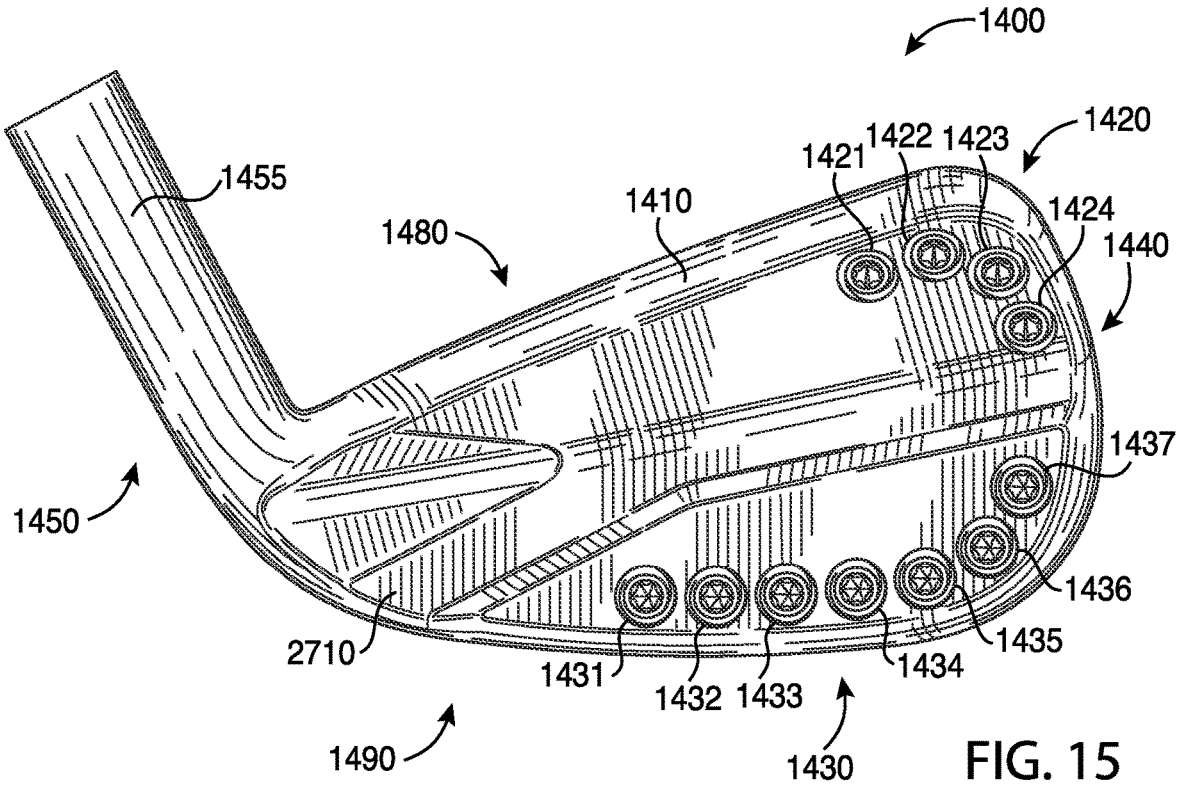
FIG. 15 depicts a rear view of the example golf club head of FIG. 14.
Figure 16:
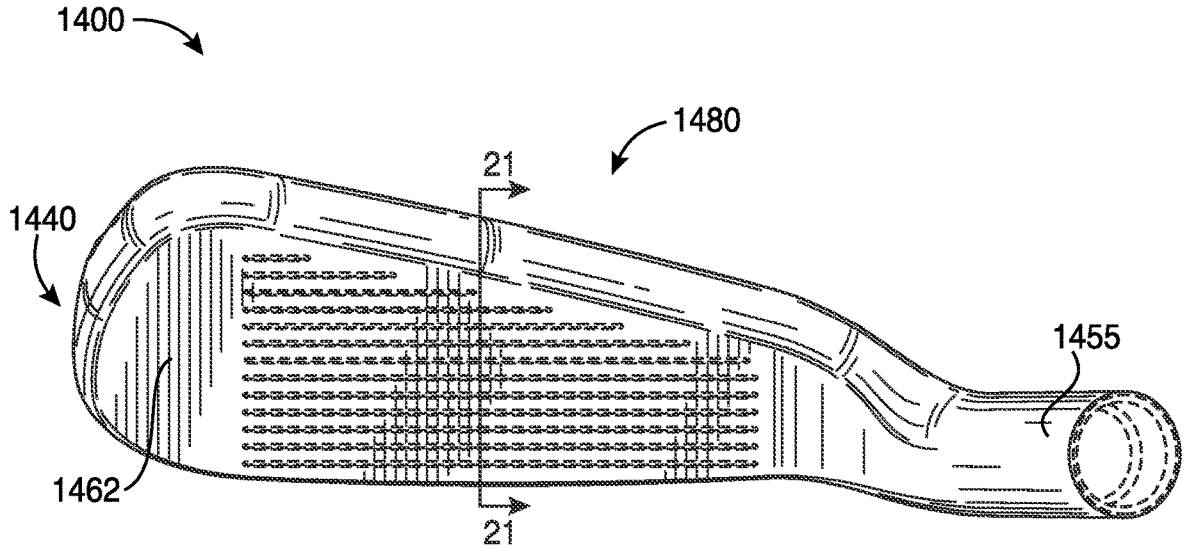
FIG. 16 depicts a top view of the example golf club head of FIG. 14.
Figure 17:
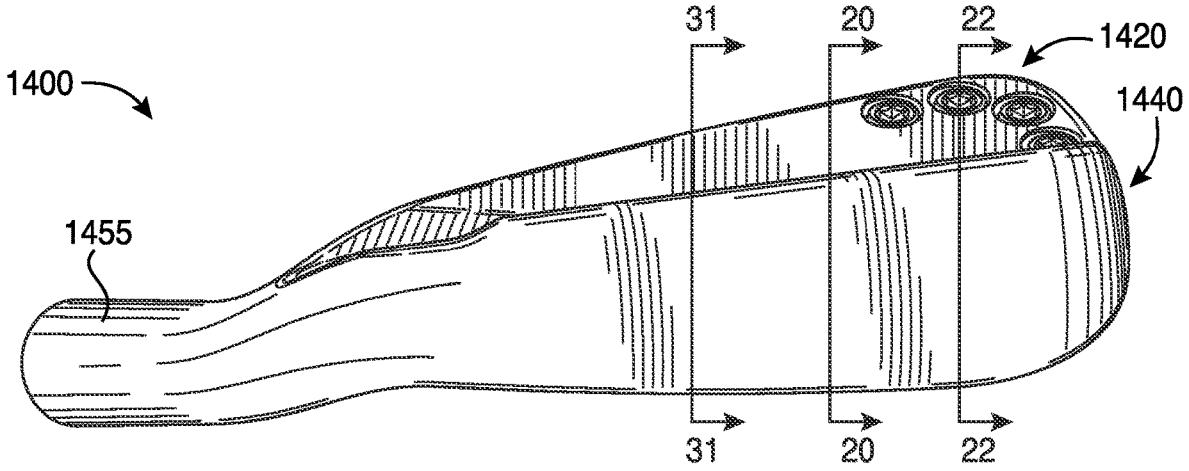
FIG. 17 depicts a bottom view of the example golf club head of FIG. 14.
Figure 18:
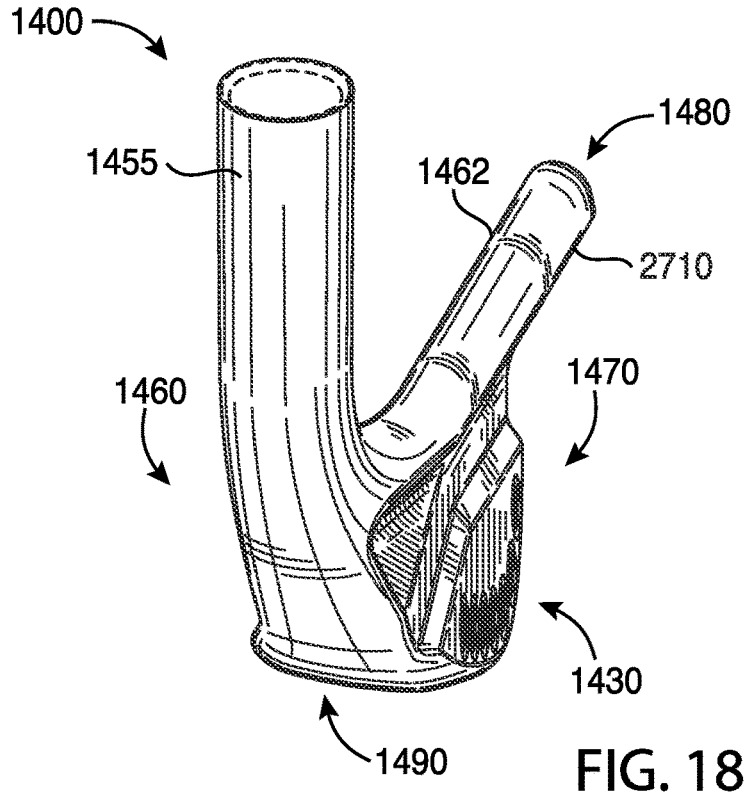
FIG. 18 depicts a left view of the example golf club head of FIG. 14.
Figure 19:
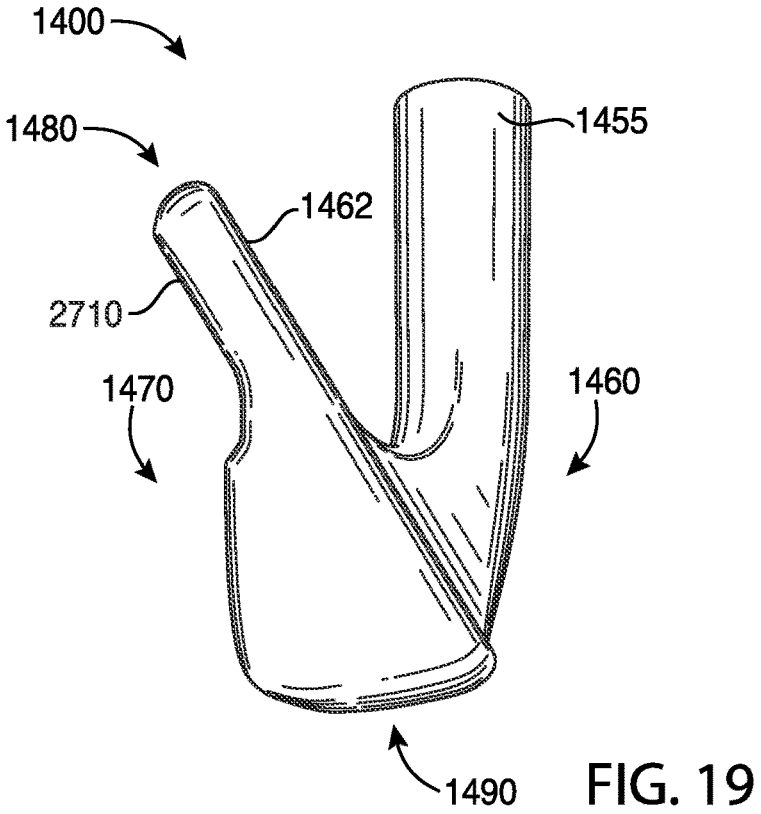
FIG. 19 depicts a right view of the example golf club head of FIG. 14.

In the example of FIGS. 14-27, a golf club head 1400 may include a body portion 1410 (FIG. 14), and two or more weight portions, generally shown as a first set of weight portions 1420 (e.g., shown as weight portions 1421, 1422, 1423, and 1424) and a second set of weight portions 1430 (e.g., shown as weight portions 1431, 1432, 1433, 1434, 1435, 1436, and 1437). The body portion 1410 may include a toe portion 1440, a heel portion 1450, a front portion 1460, a back portion 1470, a top portion 1480, and a sole portion 1490. The body portion 1410 may be made of a first material whereas the first and second sets of weight portions 1420 and 1430, respectively, may be made of a second material. The first and second materials may be similar or different materials. For example, the body portion 1410 may be partially or entirely made of a steel-based material (e.g., 17-4 PH stainless steel, Nitronic® 50 stainless steel, maraging steel or other types of stainless steel), a titanium-based material, an aluminum-based material (e.g., a high-strength aluminum alloy or a composite aluminum alloy coated with a high-strength alloy), any combination thereof, and/or other suitable types of materials. The first and second sets of weight portions 1420 and 1430, respectively, may be partially or entirely made of a high-density material such as a tungsten-based material or other suitable types of materials. Alternatively, the body portion 1410 and/or the first and second sets of weight portions 1420 and 1430, respectively, may be partially or entirely made of a non-metal material (e.g., composite, plastic, etc.). The apparatus, methods, and articles of manufacture are not limited in this regard.

The golf club head 1400 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees (°), 48°, 52°, 56°, 60°, etc.). Although FIGS. 14-27 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The toe portion 1440 and the heel portion 1450 may be on opposite ends of the body portion 1410. The heel portion 1450 may include a hosel portion 1455 configured to receive a shaft (for example the shaft 5604) with a grip (for example the grip 5606) on one end and the golf club head 1400 on the opposite end of the shaft to form a golf club.

The front portion 1460 may include a face portion 1462 (e.g., a strike face). The face portion 1462 may include a front surface 1464 and a back surface 1466. The front surface 1464 may include one or more grooves 1468 extending between the toe portion 1440 and the heel portion 1450. While the figures may depict a particular number of grooves, the apparatus, methods, and articles of manufacture described herein may include more or less grooves. The face portion 1462 may be used to impact a golf ball (not shown). The face portion 1462 may be an integral portion of the body portion 1410. Alternatively, the face portion 1462 may be a separate piece or an insert coupled to the body portion 1410 via various manufacturing methods and/or processes (e.g., a bonding process such as adhesive, a welding process such as laser welding, a brazing process, a soldering process, a fusing process, a mechanical locking or connecting method, any combination thereof, or other suitable types of manufacturing methods and/or processes). The face portion 1462 may be associated with a loft plane that defines the loft angle of the golf club head 1400. The loft angle may vary based on the type of golf club (e.g., a long iron, a middle iron, a short iron, a wedge, etc.). In one example, the loft angle may be between five degrees and seventy-five degrees. In another example, the loft angle may be between twenty degrees and sixty degrees. The apparatus, methods, and articles of manufacture described herein are not limited in this regard.

Figure 27:
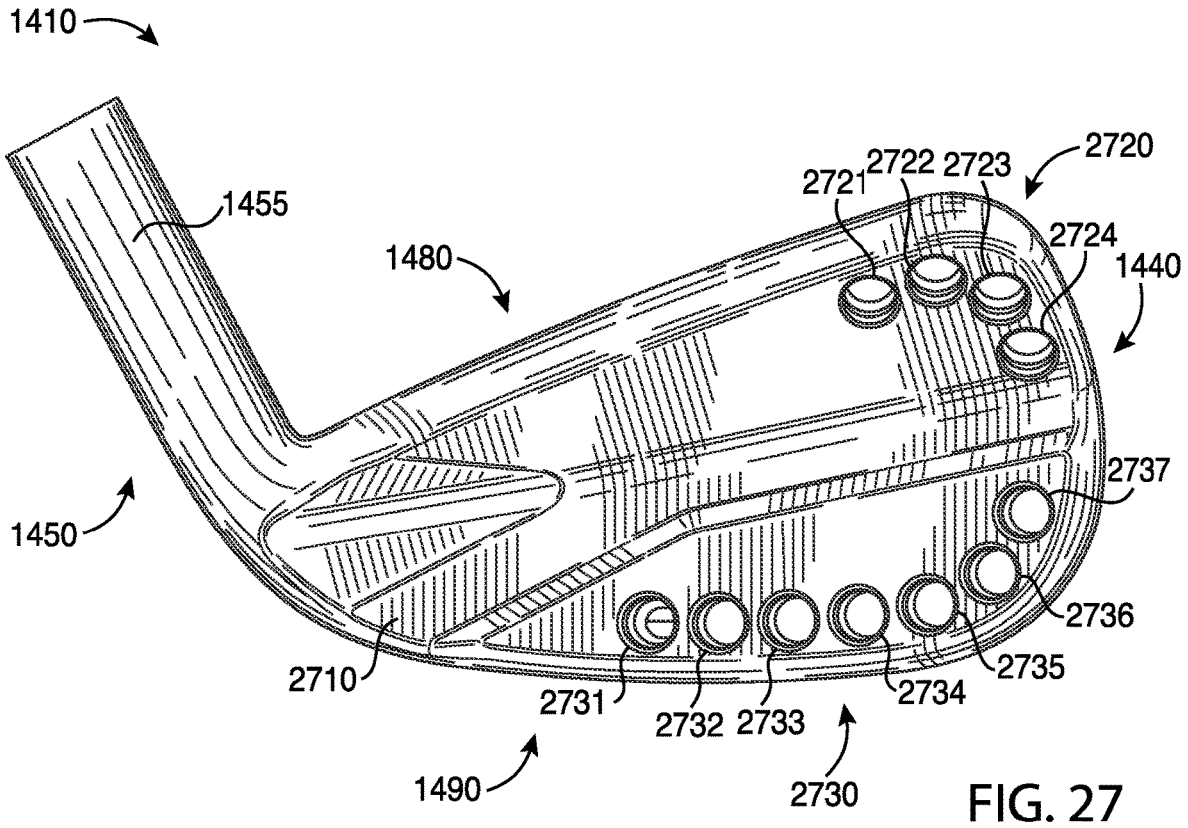
FIG. 27 depicts a rear view of a body portion of the example golf club head of FIG. 14.

As illustrated in FIG. 27, the back portion 1470 may include a back wall portion 2710 with one or more exterior weight ports along a periphery of the back portion 1470, generally shown as a first set of exterior weight ports 2720 (e.g., shown as weight ports 2721, 2722, 2723, and 2724) and a second set of exterior weight ports 2730 (e.g., shown as weight ports 2731, 2732, 2733, 2734, 2735, 2736, and 2737). Each exterior weight port may be associated with a port diameter. In one example, the port diameter may be about 0.25 inch (6.35 millimeters). Any two adjacent exterior weight ports of the first set of exterior weight ports 2720 may be separated by less than the port diameter. In a similar manner, any two adjacent exterior weight ports of the second set of exterior weight ports 2730 may be separated by less than the port diameter. The first and second exterior weight ports 2720 and 2730 may be exterior weight ports configured to receive one or more weight portions. In particular, each weight portion of the first set 1420 (e.g., shown as weight portions 1421, 1422, 1423, and 1424) may be disposed in a weight port located at or proximate to the toe portion 1440 and/or the top portion 1480 on the back portion 1470. For example, the weight portion 1421 may be partially or entirely disposed in the weight port 2721. In another example, the weight portion 1422 may be disposed in a weight port 2722 located in a transition region between the top portion 1480 and the toe portion 1440 (e.g., a top-and-toe transition region). Each weight portion of the second set 1430 (e.g., shown as weight portions 1431, 1432, 1433, 1434, 1435, 1436, and 1437) may be disposed in a weight port located at or proximate to the toe portion 1440 and/or the sole portion 1490 on the back portion 1470. For example, the weight portion 1435 may be partially or entirely disposed in the weight port 2735. In another example, the weight portion 1436 may be disposed in a weight port 2736 located in a transition region between the sole portion 1490 and the toe portion 1440 (e.g., a sole-and-toe transition region). As described in detail below, the first and second sets of weight portions 1420 and 1430, respectively, may be coupled to the back portion 1470 of the body portion 1410 with various manufacturing methods and/or processes (e.g., a bonding process, a welding process, a brazing process, a mechanical locking method, any combination thereof, or other suitable manufacturing methods and/or processes).

Alternatively, the golf club head 1400 may not include (i) the first set of weight portions 1420, (ii) the second set of weight portions 1430, or (iii) both the first and second sets of weight portions 1420 and 1430. In particular, the back portion 1470 of the body portion 1410 may not include weight ports at or proximate to the top portion 1480 and/or the sole portion 1490. For example, the mass of the first set of weight portions 1420 (e.g., 3 grams) and/or the mass of the second set of weight portions 1430 (e.g., 16.8 grams) may be integral part(s) the body portion 1410 instead of separate weight portion(s). The apparatus, methods, and articles of manufacture described herein are not limited in this regard.

Figure 24:
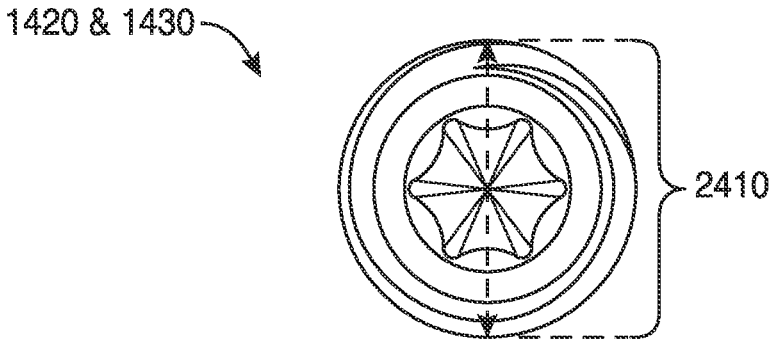
FIG. 24 depicts a top view of a weight portion associated with the example golf club head of FIG. 14.

The first and second sets of weight portions 1420 and 1430, respectively, may have similar or different physical properties (e.g., color, shape, size, density, mass, volume, etc.). As a result, the first and second sets of weight portions 1420 and 1430, respectively, may contribute to the ornamental design of the golf club head 1400. In the illustrated example as shown in FIG. 24, each of the weight portions of the first and second sets 1420 and 1430, respectively, may have a cylindrical shape (e.g., a circular cross section). Alternatively, each of the weight portions of the first set 1420 may have a first shape (e.g., a cylindrical shape) whereas each of the weight portions of the second set 1430 may have a second shape (e.g., a cubical shape). In another example, the first set of weight portions 1420 may include two or more weight portions with different shapes (e.g., the weight portion 1421 may be a first shape whereas the weight portion 1422 may be a second shape different from the first shape). Likewise, the second set of weight portions 1430 may also include two or more weight portions with different shapes (e.g., the weight portion 1431 may be a first shape whereas the weight portion 1432 may be a second shape different from the first shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). While the above examples and figures may depict multiple weight portions as a set of weight portions, each set of the first and second sets of weight portions 1420 and 1430, respectively, may be a single piece of weight portion. In one example, the first set of weight portions 1420 may be a single piece of weight portion instead of a series of four separate weight portions. In another example, the second set of weight portions 1430 may be a single piece of weight portion instead of a series of seven separate weight portions. The apparatus, methods, and articles of manufacture described herein are not limited in this regard.

Figure 25:
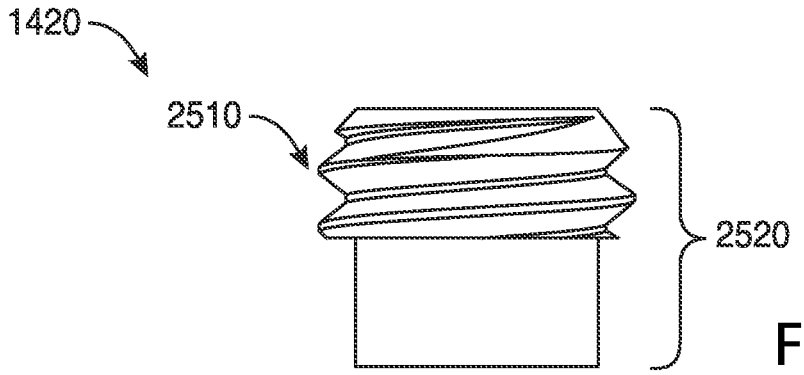
FIG. 25 depicts a side view of a weight portion associated with the example golf club head of FIG. 14.
Figure 26:
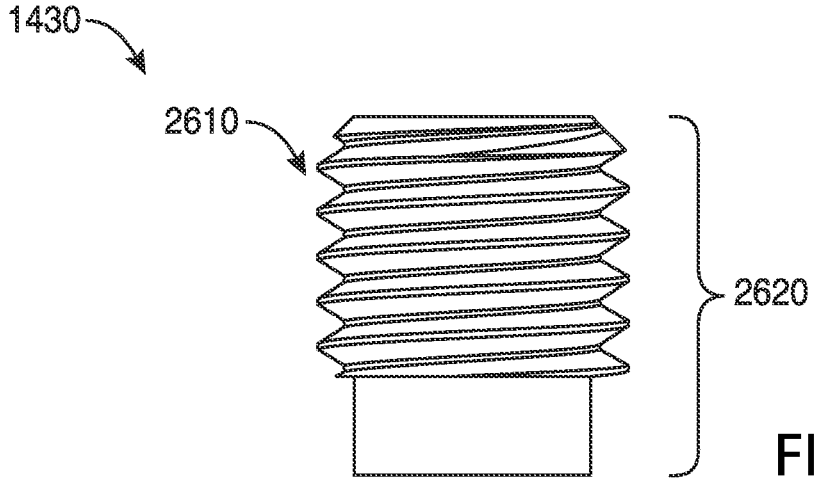
FIG. 26 depicts a side view of another weight portion associated with the example golf club head of FIG. 14.

Referring to FIGS. 25 and 26, for example, the first and second sets of weight portions 1420 and 1430, respectively, may include threads, generally shown as 2510 and 2610, respectively, to engage with correspondingly configured threads in the weight ports to secure in the weight ports of the back portion 1470 (generally shown as 2720 and 2730 in FIG. 27). For example, each weight portion of the first and second sets of weight portions 1420 and 1430, respectively, may be a screw. The first and second sets of weight portions 1420 and 1430, respectively, may not be readily removable from the body portion 1410 with or without a tool. Alternatively, the first and second sets of weight portions 1420 and 1430, respectively, may be readily removable (e.g., with a tool) so that a relatively heavier or lighter weight portion may replace one or more of the weight portions of the first and second sets 1420 and 1430, respectively. In another example, the first and second sets of weight portions 1420 and 1430, respectively, may be secured in the weight ports of the back portion 1470 with epoxy or adhesive so that the first and second sets of weight portions 1420 and 1430, respectively, may not be readily removable. In yet another example, the first and second sets of weight portions 1420 and 1430, respectively, may be secured in the weight ports of the back portion 1470 with both epoxy and threads so that the first and second sets of weight portions 1420 and 1430, respectively, may not be readily removable. The apparatus, methods, and articles of manufacture described herein are not limited in this regard.

As mentioned above, the first and second sets of weight portions 1420 and 1430, respectively, may be similar in some physical properties but different in other physical properties. As illustrated in FIGS. 24-26, for example, each of the weight portions of the first and second sets 1420 and 1430, respectively, may have a diameter 2410 of about 0.25 inch (6.35 millimeters) but the first and second sets of weight portions 1420 and 1430, respectively, may be different in height. In particular, each of the weight portions of the first set 1420 may be associated with a first height 2520 (FIG. 25), and each of the weight portion of the second set 1430 may be associated with a second height 2620 (FIG. 26). The first height 2520 may be relatively shorter than the second height 2620. In one example, the first height 2520 may be about 0.125 inch (3.175 millimeters) whereas the second height 2620 may be about 0.3 inch (7.62 millimeters). In another example, the first height 2520 may be about 0.16 inch (4.064 millimeters) whereas the second height 2620 may be about 0.4 inch (10.16 millimeters). Alternatively, the first height 2520 may be equal to or greater than the second height 2620. The apparatus, methods, and articles of manufacture described herein are not limited in this regard.

Referring back to FIG. 23, for example, the golf club head 1400 may be associated with a ground plane 2310, a horizontal midplane 2320, and a top plane 2330. In particular, the ground plane 2310 may be a tangential plane to the sole portion 1490 of the golf club head 1400 when the golf club head 1400 is at an address position (e.g., the golf club head 1400 is aligned to strike a golf ball). A top plane 2330 may be a tangential plane to the top portion of the 1480 of the golf club head 1400 when the golf club head 1400 is at the address position. The ground and top planes 2310 and 2330, respectively, may be substantially parallel to each other. The horizontal midplane 2320 may be vertically halfway between the ground and top planes 2310 and 2330, respectively.

Figure 23:
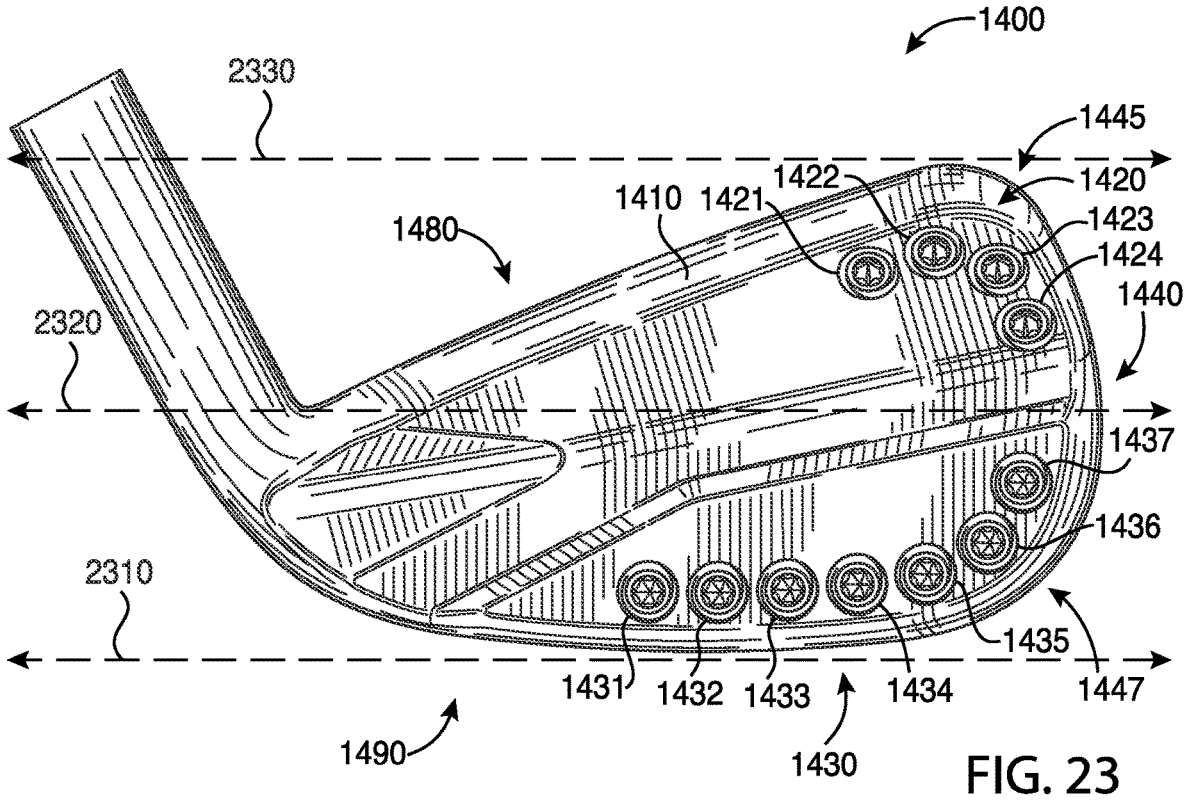
FIG. 23 depicts another rear view of the example golf club head of FIG. 14.

To provide optimal perimeter weighting for the golf club head 1400, the first set of weight portions 1420 (e.g., weight portions 1421, 1422, 1423, and 1424) may be configured to counter-balance the weight of the hosel 1455. For example, as shown in FIG. 23, the first set of weight portions 1420 (e.g., weight portions 1421, 1422, 1423 and 1424) may be located near the periphery of the body portion 1410 and extend from the top portion to a transition region 1445 between the top portion 1480 and the toe portion 1440, and from the transition region 1445 to the toe portion 1440. In other words, the first set of weight portions 1420 may be located on the golf club head 1400 at a generally opposite location relative to the hosel 1455. According to one example, at least a portion of the first set of weight portions 1420 may be located near the periphery of the body portion 1410 and extend through the transition region 1445. According to another example, at least a portion of the first set of weight portions 1420 may extend near the periphery of the body portion 1410 and extend along a portion of the top portion 1480. According to another example, at least a portion of the first set of weight portions 1420 may extend near the periphery of the body portion 1410 and extend along a portion of the toe portion 1440. The first set of weight portions 1420 may be above the horizontal midplane 2320 of the golf club head 1400. At least a portion of the first set of weight portions 1420 may be near the toe portion 1440 to increase the moment of inertia of the golf club head 1400 about a vertical axis of the golf club head 1400 that extends through the center of gravity of the golf club head 1400. Accordingly, the first set of weight portions 1420 may be near the periphery of the body portion 1410 and extend through the top portion 1480, the toe portion 1440 and/or the transition region 1445 to counter-balance the weight of the hosel 1455 and/or increase the moment of inertia of the golf club head 1400. The locations of the first set of weight portions 1420 (i.e., the locations of the first set of exterior weight ports 2720) and the physical properties and materials of construction of the weight portions of the first set of weight portions 1420 may be determined to optimally affect the weight, weight distribution, center of gravity, moment of inertia characteristics, structural integrity and/or or other static and/or dynamic characteristics of the golf club head 1400. The apparatus, methods, and articles of manufacture described herein are not limited in this regard.

The second set of weight portions 1430 (e.g., weight portions 1431, 1432, 1433, 1434, 1435, 1436, and 1437) may be configured to place the center of gravity of the golf club head 1400 at an optimal location and optimize the moment of inertia of the golf club head about a vertical axis that extends through the center of gravity of the golf club head 1400. Referring to FIG. 23, all or a substantial portion of the second set of weight portions 1430 may be generally near the sole portion 1490. For example, the second set of weight portions 1430 (e.g., weight portions 1431, 1432, 1433, 1434, 1435, 1436, and 1437) may be near the periphery of the body portion 1410 and extend from the sole portion 1490 to the toe portion 1440. As shown in the example of FIG. 23, the weight portions 1431, 1432, 1433, and 1434 may be located near the periphery of the body portion 1410 and extend along the sole portion 1490 to lower the center of gravity of the golf club head 1400. The weight portions 1435, 1436 and 1437 may be located near the periphery of the body portion 1410 and extend from the sole portion 1490 to the toe portion 1440 through a transition region 1447 between the sole portion 1490 and the toe portion 1440 to lower the center of gravity and increase the moment of inertia of the golf club head 1400 about a vertical axis that extends through the center of gravity. To lower the center of gravity of the golf club head 1400, all or a portion of the second set of weight portions 1430 may be located closer to the sole portion 1490 than to the horizontal midplane 2320. For example, the weight portions 1431, 1432, 1433, 1434, 1435, and 1436 may be closer to the sole portion 1490 than to the horizontal midplane 2320. The locations of the second set of weight portions 1430 (i.e., the locations of the second set of exterior weight ports 2730) and the physical properties and materials of construction of the weight portions of the second set of weight portions 1430 may be determined to optimally affect the weight, weight distribution, center of gravity, moment of inertia characteristics, structural integrity and/or or other static and/or dynamic characteristics of the golf club head 1400. The apparatus, methods, and articles of manufacture described herein are not limited in this regard.

Figure 20:
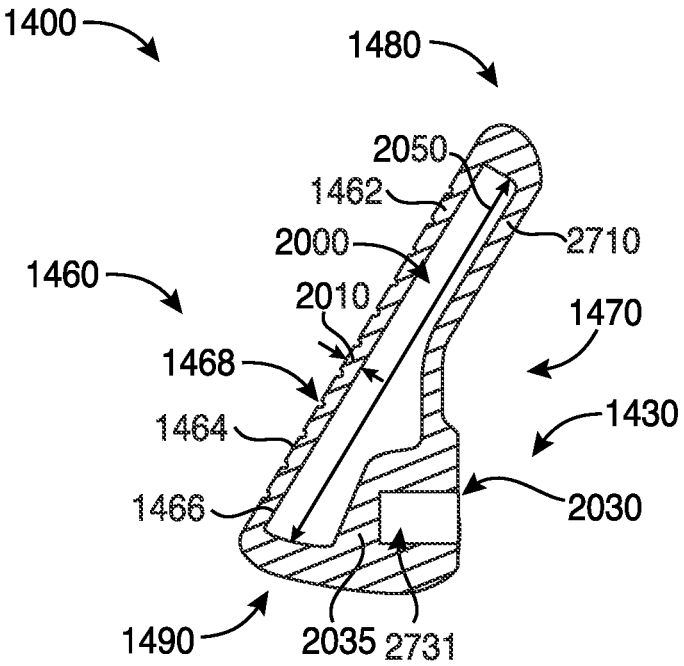
FIG. 20 depicts a cross-sectional view of the example golf club head of FIG. 14 along line 20-20.
Figure 21:
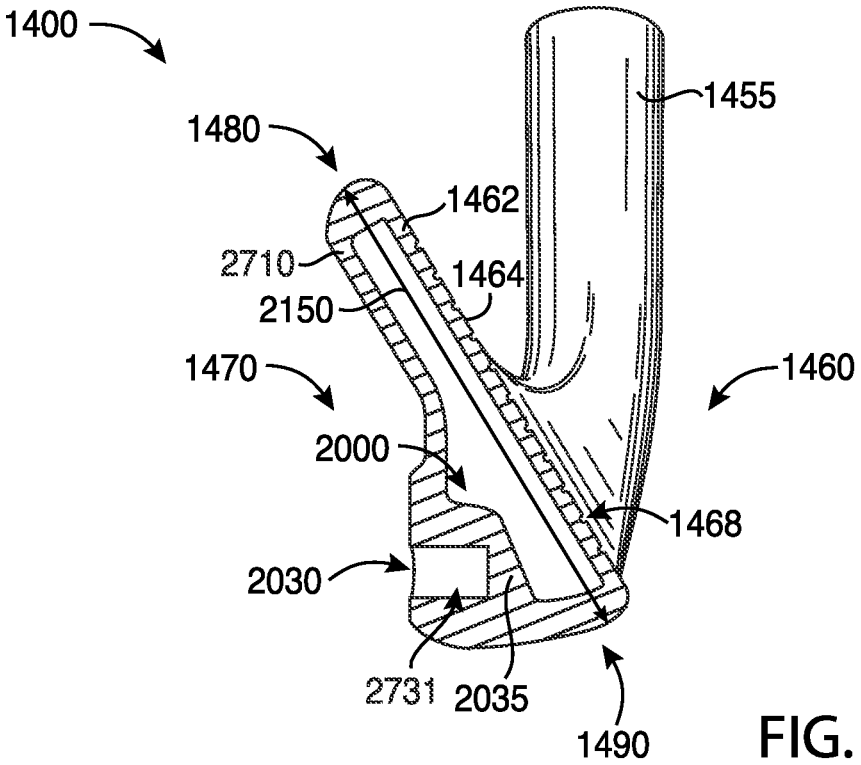
FIG. 21 depicts a cross-sectional view of the example golf club head of FIG. 14 along line 21-21.
Figure 22:
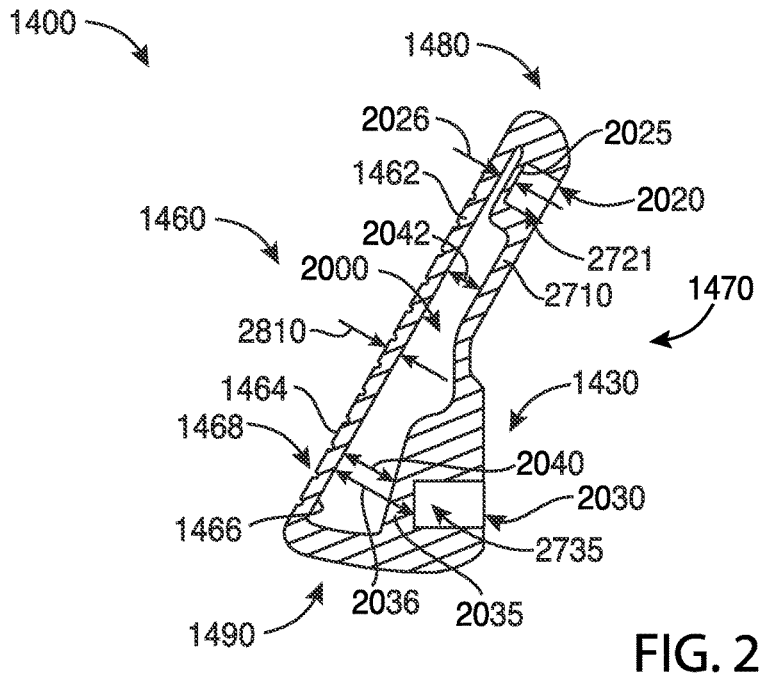
FIG. 22 depicts a cross-sectional view of the example golf club head of FIG. 14 along line 22-22.

Turning to FIGS. 20-22, for example, the first and second sets of weight portions 1420 and 1430, respectively, may be located away from the back surface 1466 of the face portion 1462 (e.g., not directly coupled to each other). That is, the first and second sets of weight portions 1420 and 1430, respectively, and the back surface 1466 may be partially or entirely separated by an interior cavity 2000 of the body portion 1410. As shown in FIG. 27, for example, each exterior weight port of the first and second sets of exterior weight ports 2720 and 2730 may include an opening (e.g., generally shown as 2020 and 2030) and a port wall (e.g., generally shown as 2025 and 2035). The port walls 2025 and 2035 may be integral portions of the back wall portion 2710 (e.g., a section of the back wall portion 2710). Each of the openings 2020 and 2030 may be configured to receive a weight portion such as weight portions 1421 and 1435, respectively. The opening 2020 may be located at one end of the weight port 2721, and the port wall 2025 may be located or proximate to at an opposite end of the weight port 2721. In a similar manner, the opening 2030 may be located at one end of the weight port 2735, and the port wall 2035 may be located at or proximate to an opposite end of the weight port 2735. The port walls 2025 and 2035 may be separated from the face portion 1462 (e.g., separated by the interior cavity 2000). The port wall 2025 may have a distance 2026 from the back surface 1466 of the face portion 1462 as shown in FIG. 22. The port wall 2035 may have a distance 2036 from the back surface 1466 of the face portion 1462. The distances 2026 and 2036 may be determined to optimize the location of the center of gravity of the golf club head 1400 when the first and second sets of weight ports 2720 and 2730, respectively, receive weight portions as described herein. According to one example, the distance 2036 may be greater than the distance 2026 so that the center of gravity of the golf club head 1400 is moved toward the back portion 1470. As a result, a width 2040 of a portion of the interior cavity 2000 below the horizontal midplane 2320 may be greater than a width 2042 of the interior cavity 2000 above the horizontal midplane 2320. The apparatus, methods, and articles of manufacture described herein are not limited in this regard.

As discussed herein, the center of gravity (CG) of the golf club head 1400 may be relatively farther back away from the face portion 1462 and relatively lower towards a ground plane (e.g., one shown as 2310 in FIG. 23) with all or a substantial portion of the second set of weight portions 1430 being closer to the sole portion 1490 than to the horizontal midplane 2320 and the first and second sets of weight portions 1420 and 1430, respectively being away from the back surface 1466 than if the second set of weight portions 1430 were directly coupled to the back surface 1466. The locations of the first and second sets of weight ports 2720 and 2730 and the physical properties and materials of construction of the weight portions of the first and second sets of weight portions 1420 and 1430, respectively, may be determined to optimally affect the weight, weight distribution, center of gravity, moment of inertia characteristics, structural integrity and/or or other static and/or dynamic characteristics of the golf club head 1400. The apparatus, methods, and articles of manufacture described herein are not limited in this regard.

While the figures may depict weight ports with a particular cross-section shape, the apparatus, methods, and articles of manufacture described herein may include weight ports with other suitable cross-section shapes. In one example, the weight ports of the first and/or second sets of weight ports 2720 and 2730 may have U-like cross-section shape. In another example, the weight ports of the first and/or second set of weight ports 2720 and 2730 may have V-like cross-section shape. One or more of the weight ports associated with the first set of weight portions 1420 may have a different cross-section shape than one or more weight ports associated with the second set of weight portions 1430. For example, the weight port 2721 may have a U-like cross-section shape whereas the weight port 2735 may have a V-like cross-section shape. Further, two or more weight ports associated with the first set of weight portions 1420 may have different cross-section shapes. In a similar manner, two or more weight ports associated with the second set of weight portions 1430 may have different cross-section shapes. The apparatus, methods, and articles of manufacture described herein are not limited in this regard.

The first and second sets of weight portions 1420 and 1430, respectively, may be similar in mass (e.g., all of the weight portions of the first and second sets 1420 and 1430, respectively, weigh about the same). Alternatively, the first and second sets of weight portions 1420 and 1430, respectively, may be different in mass individually or as an entire set. In particular, each of the weight portions of the first set 1420 (e.g., shown as 1421, 1422, 1423, and 1424) may have relatively less mass than any of the weight portions of the second set 1430 (e.g., shown as 1431, 1432, 1433, 1434, 1435, 1436, and 1437). For example, the second set of weight portions 1430 may account for more than 50% of the total mass from exterior weight portions of the golf club head 1400. As a result, the golf club head 1400 may be configured to have at least 50% of the total mass from exterior weight portions disposed below the horizontal midplane 2320. The apparatus, methods, and articles of manufacture described herein are not limited in this regard.

In one example, the golf club head 1400 may have a mass in the range of about 220 grams to about 330 grams based on the type of golf club (e.g., a 4-iron versus a lob wedge). The body portion 1410 may have a mass in the range of about 200 grams to about 310 grams with the first and second sets of weight portions 1420 and 1430, respectively, having a mass of about 20 grams (e.g., a total mass from exterior weight portions). Each of the weight portions of the first set 1420 may have a mass of about one gram (1.0 g) whereas each of the weight portions of the second set 1430 may have a mass of about 2.4 grams. The sum of the mass of the first set of weight portions 1420 may be about 3 grams whereas the sum of the mass of the first set of weight portions 1430 may be about 16.8 grams. The total mass of the second set of weight portions 1430 may weigh more than five times as much as the total mass of the first set of weight portions 1420 (e.g., a total mass of the second set of weight portions 1430 of about 16.8 grams versus a total mass of the first set of weight portions 1420 of about 3 grams). The golf club head 1400 may have a total mass of 19.8 grams from the first and second sets of weight portions 1420 and 1430, respectively (e.g., sum of 3 grams from the first set of weight portions 1420 and 16.8 grams from the second set of weight portions 1430). Accordingly, the first set of weight portions 1420 may account for about 15% of the total mass from exterior weight portions of the golf club head 1400 whereas the second set of weight portions 1430 may be account for about 85% of the total mass from exterior weight portions of the golf club head 1400. The apparatus, methods, and articles of manufacture described herein are not limited in this regard.

By coupling the first and second sets of weight portions 1420 and 1430, respectively, to the body portion 1410 (e.g., securing the first and second sets of weight portions 1420 and 1430 in the weight ports on the back portion 1470), the location of the center of gravity (CG) and the moment of inertia (MOI) of the golf club head 1400 may be optimized. In particular, as described herein, the first and second sets of weight portions 1420 and 1430, respectively, may lower the location of the CG towards the sole portion 1490 and further back away from the face portion 1462. Further, the MOI may be higher as measured about a vertical axis extending through the CG (e.g., perpendicular to the ground plane 2310). The MOI may also be higher as measured about a horizontal axis extending through the CG (e.g., extending towards the toe and heel portions 1450 and 1460, respectively, of the golf club head 1400). As a result, the golf club head 1400 may provide a relatively higher launch angle and a relatively lower spin rate than a golf club head without the first and second sets of weight portions 1420 and 1430, respectively. The apparatus, methods, and articles of manufacture described herein are not limited in this regard.

Alternatively, two or more weight portions in the same set may be different in mass. In one example, the weight portion 1421 of the first set 1420 may have a relatively lower mass than the weight portion 1422 of the first set 1420. In another example, the weight portion 1431 of the second set 1430 may have a relatively lower mass than the weight portion 1435 of the second set 1430. With relatively greater mass at the top-and-toe transition region and/or the sole-and-toe transition region, more weight may be distributed away from the center of gravity (CG) of the golf club head 1400 to increase the moment of inertia (MOI) about the vertical axis through the CG.

Although the figures may depict the weight portions as separate and individual parts, each set of the first and second sets of weight portions 1420 and 1430, respectively, may be a single piece of weight portion. In one example, all of the weight portions of the first set 1420 (e.g., shown as 1421, 1422, 1423, and 1424) may be combined into a single piece of weight portion (e.g., a first weight portion). In a similar manner, all of the weight portions of the second set 1430 (e.g., 1431, 1432, 1433, 1434, 1435, 1436, and 1437) may be combined into a single piece of weight portion as well (e.g., a second weight portion). In this example, the golf club head 1400 may have only two weight portions. While the figures may depict a particular number of weight portions, the apparatus, methods, and articles of manufacture described herein may include more or less number of weight portions. In one example, the first set of weight portions 1420 may include two separate weight portions instead of three separate weight portions as shown in the figures. In another example, the second set of weight portions 1430 may include five separate weight portions instead of seven separate weight portions a shown in the figures. Alternatively as mentioned above, the apparatus, methods, and articles of manufacture described herein may not include any separate weight portions (e.g., the body portion 1410 may be manufactured to include the mass of the separate weight portions as integral part(s) of the body portion 1410). The apparatus, methods, and articles of manufacture described herein are not limited in this regard.

Referring back to FIGS. 20-22, for example, the body portion 1410 may be a hollow body including the interior cavity 2000 extending between the front portion 1460 and the back portion 1470. Further, the interior cavity 2000 may extend between the top portion 1480 and the sole portion 1490. The interior cavity 2000 may be associated with a cavity height 2050 (HC), and the body portion 1410 may be associated with a body height 2150 (HB). While the cavity height 2050 and the body height 2150 may vary between the toe and heel portions 1440 and 1450, the cavity height 2050 may be at least 50% of a body height 2150 (HC>0.5*HB). For example, the cavity height 2050 may vary between 70-85% of the body height 2150. With the cavity height 2050 of the interior cavity 2000 being greater than 50% of the body height 2150, the golf club head 1400 may produce relatively more consistent feel, sound, and/or result when the golf club head 1400 strikes a golf ball via the face portion 1462 than a golf club head with a cavity height of less than 50% of the body height. The apparatus, methods, and articles of manufacture described herein are not limited in this regard.

In one example, the interior cavity 2000 may be unfilled (i.e., empty space). The body portion 1410 with the interior cavity 2000 may weigh about 100 grams less than the body portion 1410 without the interior cavity 2000. Alternatively, the interior cavity 2000 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 2000 may be filled with a TPE material to absorb shock, isolate vibration, and/or dampen noise when the golf club head 1400 strikes a golf ball via the face portion 1462.

In another example, the interior cavity 2000 may be partially or entirely filled with a polymer material such as an ethylene copolymer material to absorb shock, isolate vibration, and/or dampen noise when the golf club head 1400 strikes a golf ball via the face portion 1462. In particular, at least 50% of the interior cavity 2000 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

Figure 28:
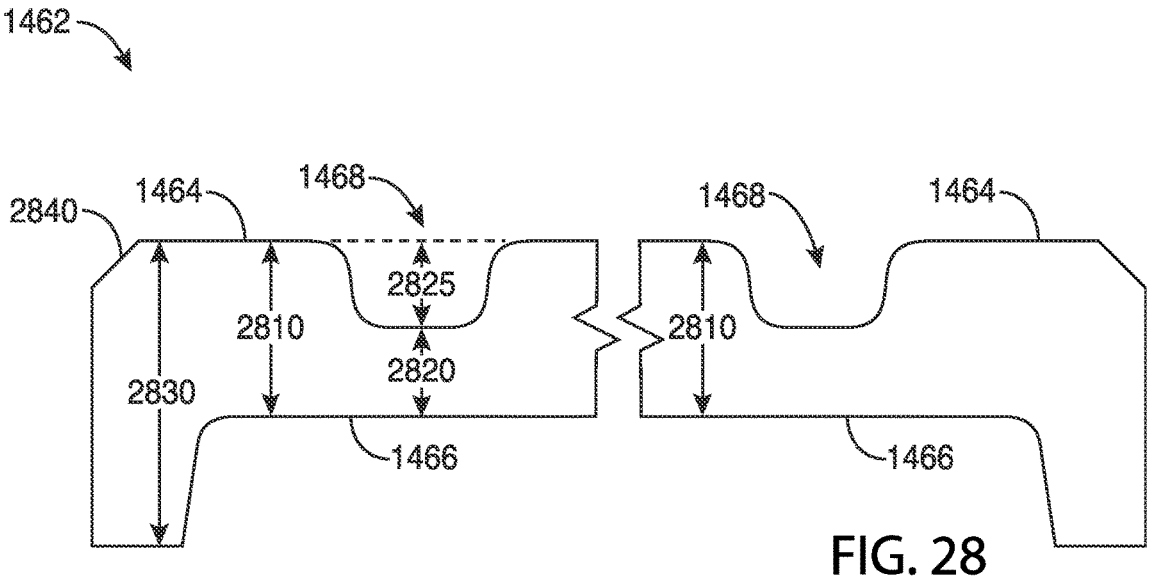
FIG. 28 depicts a cross-sectional view of a face portion of the example golf club head of FIG. 14.

Turning to FIG. 28, for example, the face portion 1462 may include a first thickness 2810 (T1), and a second thickness 2820 (T2). The first thickness 2810 may be a thickness of a section of the face portion 1462 adjacent to a groove 1468 whereas the second thickness 2820 may be a thickness of a section of the face portion 1462 below the groove 1468. For example, the first thickness 2810 may be a maximum distance between the front surface 1464 and the back surface 1466. The second thickness 2820 may be based on the groove 1468. In particular, the groove 1468 may have a groove depth 2825 (Dgroove). The second thickness 2820 may be a maximum distance between the bottom of the groove 1468 and the back surface 1466. The sum of the second thickness 2820 and the groove depth 2825 may be substantially equal to the first thickness 2810 (e.g., T2+Dgroove=T1). Accordingly, the second thickness 2820 may be less than the first thickness 2810 (e.g., T2<T1).

To lower and/or move the CG of the golf club head 1400 further back, weight from the front portion 1460 of the golf club head 1400 may be removed by using a relatively thinner face portion 1462. For example, the first thickness 2810 may be about 0.075 inch (1.905 millimeters) (e.g., T1=0.075 inch). With the support of the back wall portion 2710 to form the interior cavity 2000 and filling at least a portion of the interior cavity 2000 with an elastic polymer material, the face portion 1462 may be relatively thinner (e.g., T1<0.075 inch) without degrading the structural integrity, sound, and/or feel of the golf club head 1400. In one example, the first thickness 2810 may be less than or equal to 0.060 inch (1.524 millimeters) (e.g., T1≤0.060 inch). In another example, the first thickness 2810 may be less than or equal to 0.040 inch (1.016 millimeters) (e.g., T1≤0.040 inch). Based on the type of material(s) used to form the face portion 1462 and/or the body portion 1410, the face portion 1462 may be even thinner with the first thickness 2810 being less than or equal to 0.030 inch (0.762 millimeters) (e.g., T1≤0.030 inch). The groove depth 2825 may be greater than or equal to the second thickness 2820 (e.g., Dgroove≥T2). In one example, the groove depth 2825 may be about 0.020 inch (0.508 millimeters) (e.g., Dgroove=0.020 inch). Accordingly, the second thickness 2820 may be about 0.010 inch (0.254 millimeters) (e.g., T2=0.010 inch). In another example, the groove depth 2825 may be about 0.015 inch (0.381 millimeters), and the second thickness 2820 may be about 0.015 inch (e.g., Dgroove=T2=0.015 inch). Alternatively, the groove depth 2825 may be less than the second thickness 2820 (e.g., Dgroove<T2). Without the support of the back wall portion 2710 and the elastic polymer material to fill in the interior cavity 2000, a golf club head may not be able to withstand multiple impacts by a golf ball on a face portion. In contrast to the golf club head 1400 as described herein, a golf club head with a relatively thin face portion but without the support of the back wall portion 2710 and the elastic polymer material to fill in the interior cavity 2000 (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form the golf club head 1400, the face portion 1462 may include additional material at or proximate to a periphery of the face portion 1462. Accordingly, the face portion 1462 may also include a third thickness 2830, and a chamfer portion 2840. The third thickness 2830 may be greater than either the first thickness 2810 or the second thickness 2820 (e.g., T3>T1>T2). In particular, the face portion 1462 may be coupled to the body portion 1410 by a welding process. For example, the first thickness 2810 may be about 0.030 inch (0.762 millimeters), the second thickness 2820 may be about 0.015 inch (0.381 millimeters), and the third thickness 2830 may be about 0.050 inch (1.27 millimeters). Accordingly, the chamfer portion 2840 may accommodate some of the additional material when the face portion 1462 is welded to the body portion 1410.

Figure 29:
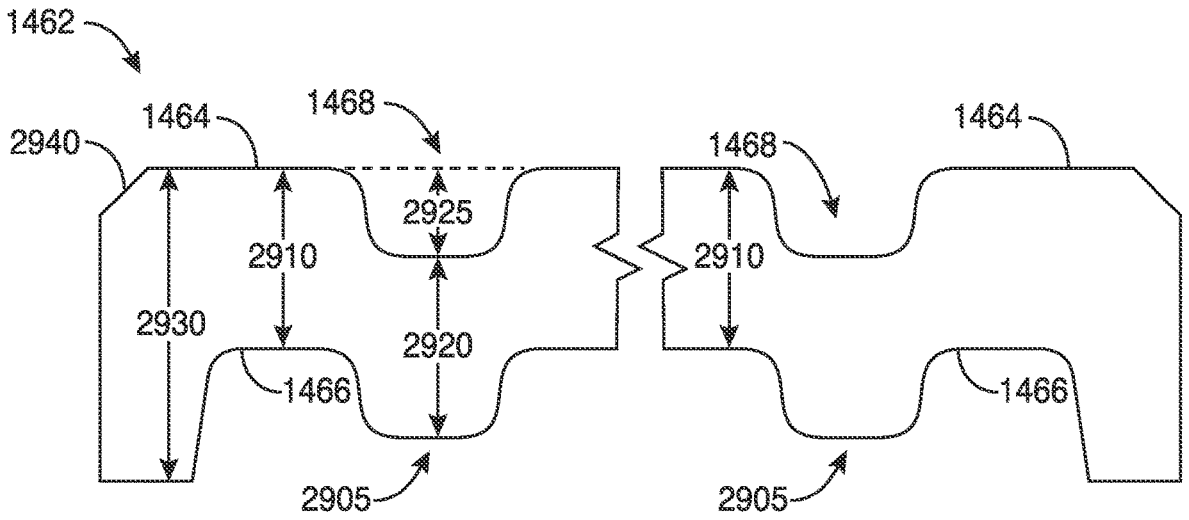
FIG. 29 depicts a cross-sectional view of another face portion of the example golf club head of FIG. 14.

As illustrated in FIG. 29, for example, the face portion 1462 may include a reinforcement section, generally shown as 2905, below one or more grooves 1468. In one example, the face portion 1462 may include a reinforcement section 2905 below each groove. Alternatively, face portion 1462 may include the reinforcement section 2905 below some grooves (e.g., every other groove) or below only one groove. The face portion 1462 may include a first thickness 2910, a second thickness 2920, a third thickness 2930, and a chamfer portion 2940. The groove 1468 may have a groove depth 2925. The reinforcement section 2905 may define the second thickness 2920. The first and second thicknesses 2910 and 2920, respectively, may be substantially equal to each other (e.g., T1=T2). In one example, the first and second thicknesses 2910 and 2920, respectively, may be about 0.030 inch (0.762 millimeters) (e.g., T1=T2=0.030 inch). The groove depth 2925 may be about 0.015 inch (0.381 millimeters), and the third thickness 2930 may be about 0.050 inch (1.27 millimeters). The groove 1468 may also have a groove width. The width of the reinforcement section 2905 may be greater than or equal to the groove width. The apparatus, methods, and articles of manufacture described herein are not limited in this regard.

Alternatively, the face portion 1462 may vary in thickness at and/or between the top portion 1480 and the sole portion 1490. In one example, the face portion 1462 may be relatively thicker at or proximate to the top portion 1480 than at or proximate to the sole portion 1490 (e.g., thickness of the face portion 1462 may taper from the top portion 1480 towards the sole portion 1490). In another example, the face portion 1462 may be relatively thicker at or proximate to the sole portion 1490 than at or proximate to the top portion 1480 (e.g., thickness of the face portion 1462 may taper from the sole portion 1490 towards the top portion 1480). In yet another example, the face portion 1462 may be relatively thicker between the top portion 1480 and the sole portion 1490 than at or proximate to the top portion 1480 and the sole portion 1490 (e.g., thickness of the face portion 1462 may have a bell-shaped contour). The apparatus, methods, and articles of manufacture described herein are not limited in this regard.

Different from other golf club head designs, the interior cavity 2000 of the body portion 1410 and the location of the first and second sets of weight portions 1420 and 1430, respectively, along the perimeter of the golf club head 1400 may result in a golf ball traveling away from the face portion 1462 at a relatively higher ball launch angle and a relatively lower spin rate. As a result, the golf ball may travel farther (i.e., greater total distance, which includes carry and roll distances).

Figure 30:
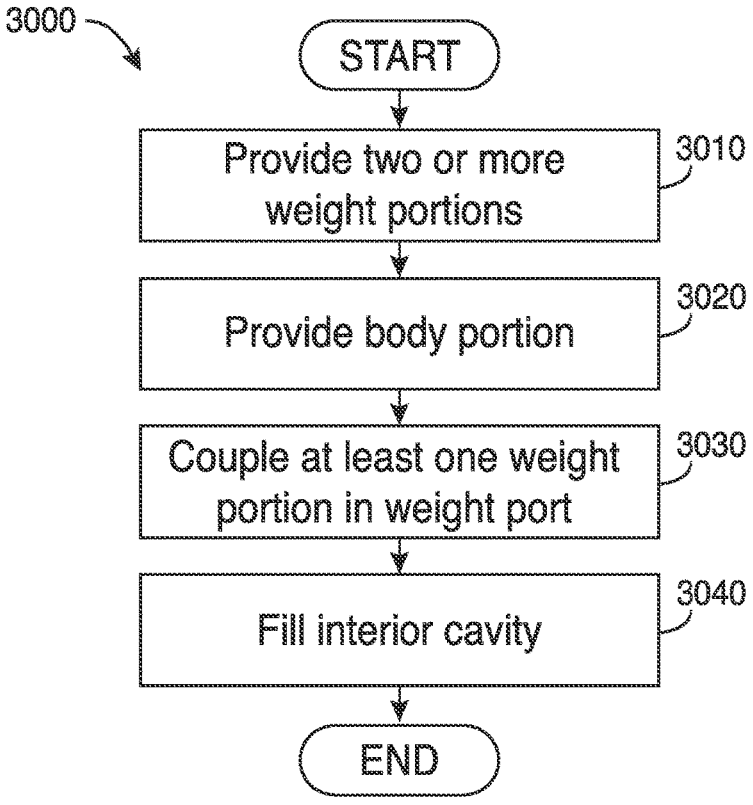
FIG. 30 depicts one manner in which the example golf club head described herein may be manufactured.

FIG. 30 depicts one manner in which the example golf club head described herein may be manufactured. In the example of FIG. 30, the process 3000 may begin with providing two or more weight portions, generally shown as the first and second sets of weight portions 1420 and 1430, respectively (block 3010). The first and second sets of weight portions 1420 and 1430, respectively, may be made of a first material such as a tungsten-based material. In one example, the weight portions of the first and second sets 1420 and 1430, respectively, may be tungsten-alloy screws.

The process 3000 may provide a body portion 1410 having the face portion 1462, the interior cavity 2000, and the back portion 1470 with two or more exterior weight ports, generally shown as 2720 and 2730 (block 3020). The body portion 1410 may be made of a second material, which is different than the first material. The body portion 1410 may be manufacture using an investment casting process, a billet forging process, a stamping process, a computer numerically controlled (CNC) machining process, a die casting process, any combination thereof, or other suitable manufacturing processes. In one example, the body portion 1410 may be made of 17-4 PH stainless steel using a casting process. In another example, the body portion 1410 may be made of other suitable type of stainless steel (e.g., Nitronic® 50 stainless steel manufactured by AK Steel Corporation, West Chester, Ohio) using a forging process. By using Nitronic® 50 stainless steel to manufacture the body portion 1410, the golf club head 1400 may be relatively stronger and/or more resistant to corrosion than golf club heads made from other types of steel. Each weight port of the body portion 1410 may include an opening and a port wall. For example, the weight port 2721 may include the opening 2020 and the port wall 2025 with the opening 2020 and the port wall 2025 being on opposite ends of each other. The interior cavity 2000 may separate the port wall 2025 of the weight port 2721 and the back surface 1466 of the face portion 1462. In a similar manner, the weight port 3135 may include the opening 2030 and the port wall 2035 with the opening 2030 and the port wall 2035 being on opposite ends of each other. The interior cavity 2000 may separate the port wall 2035 of the weight port 2735 and the back surface 1466 of the face portion 1462.

The process 3000 may couple each of the first and second sets of weight portions 1420 and 1430 into one of the two or more exterior weight ports (blocks 3030). In one example, the process 3000 may insert and secure the weight portion 1421 in the exterior weight port 2721, and the weight portion 1435 in the exterior weight portion 2735. The process 3000 may use various manufacturing methods and/or processes to secure the first and second sets of weight portions 1420 and 1430, respectively, in the exterior weight ports such as the weight ports 2721 and 2735 (e.g., epoxy, welding, brazing, mechanical lock(s), any combination thereof, etc.).

Figure 31:
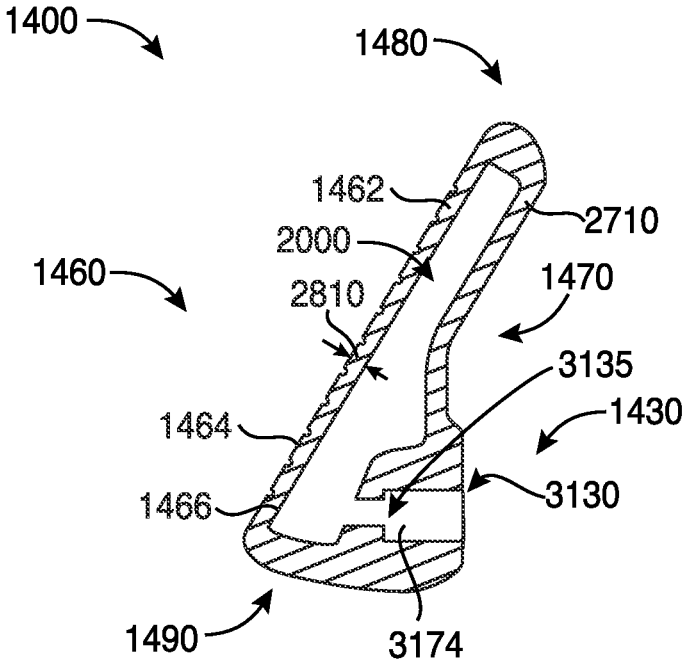
FIG. 31 depicts another cross-sectional view of the example golf club head of FIG. 4 along line 31-31.

The process 3000 may partially or entirely fill the interior cavity 2000 with an elastic polymer material (e.g., Sorbothane® material) or a polymer material (e.g., an ethylene copolymer material such as DuPont™ HPF family of materials) (block 3040). In one example, at least 50% of the interior cavity 2000 may be filled with the elastic polymer material. As mentioned above, the elastic polymer material may absorb shock, isolate vibration, and/or dampen noise in response to the golf club head 1400 striking a golf ball. In addition or alternatively, the interior cavity 2000 may be filled with a thermoplastic elastomer material and/or a thermoplastic polyurethane material. As illustrated in FIG. 31, for example, the golf club head 1400 may include one or more weight ports (e.g., one shown as 2731 in FIG. 27) with a first opening 3130 and a second opening 3135. The second opening 3135 may be used to access the interior cavity 2000. In one example, the process 3000 (FIG. 30) may fill the interior cavity 2000 with an elastic polymer material by injecting the elastic polymer material into the interior cavity 2000 from the first opening 3130 via the second opening 3135. The first and second openings 3130 and 3135, respectively, may be same or different in size and/or shape. While the above example may describe and depict a particular weight port with a second opening, any other weight ports of the golf club head 1400 may include a second opening (e.g., the weight port 2020). The apparatus, methods, and articles of manufacture described herein are not limited in this regard.

Referring back to FIG. 30, the example process 3000 is merely provided and described in conjunction with other figures as an example of one way to manufacture the golf club head 1400. While a particular order of actions is illustrated in FIG. 30, these actions may be performed in other temporal sequences. For example, two or more actions depicted in FIG. 30 may be performed sequentially, concurrently, or simultaneously. In one example, blocks 3010, 3020, 3030, and/or 3040 may be performed simultaneously or concurrently. Although FIG. 30 depicts a particular number of blocks, the process may not perform one or more blocks. In one example, the interior cavity 2000 may not be filled (i.e., block 3040 may not be performed). The apparatus, methods, and articles of manufacture described herein are not limited in this regard.

Referring back to FIGS. 14-27, the face portion 1462 may include a non-smooth back surface to improve adhesion and/or mitigate delamination between the face portion 1462 and the elastic polymer material used to fill the interior cavity 2000 (e.g., FIG. 20). Various methods and/or processes such as an abrasive blasting process (e.g., a bead blasting process, a sand blasting process, other suitable blasting process, or any combination thereof) and/or a milling (machining) process may be used to form the back surface 1466 into a non-smooth surface. For example, the back surface 1466 may have with a surface roughness (Ra) ranging from 0.5 to 250 μm (0.012 to 6.3 μm). The apparatus, methods, and articles of manufacture are not limited in this regard.

Figure 32:
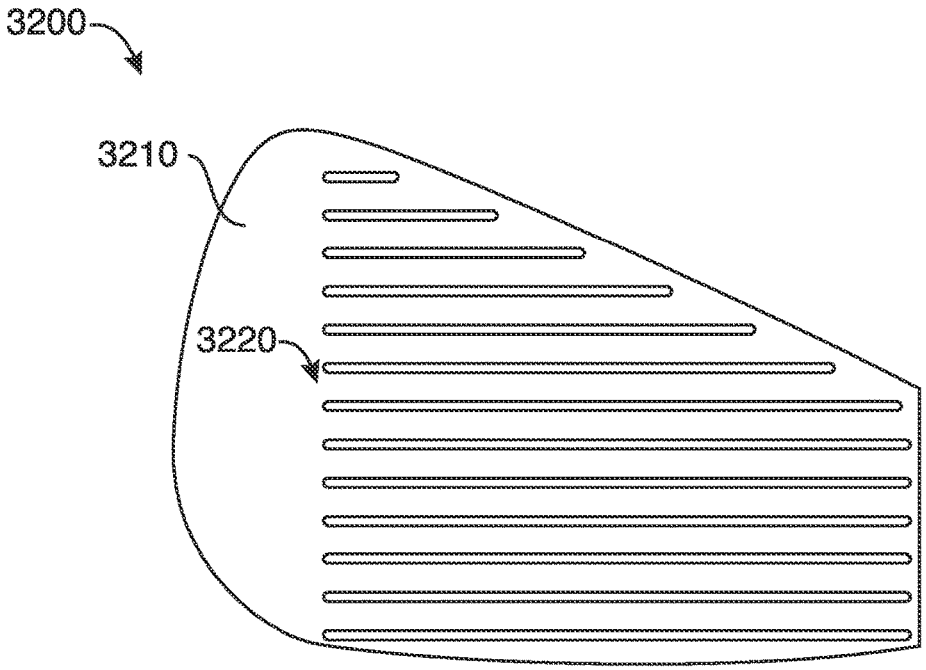
FIG. 32 depicts a front view of a face portion of the example golf club head of FIG. 32.
Figure 33:
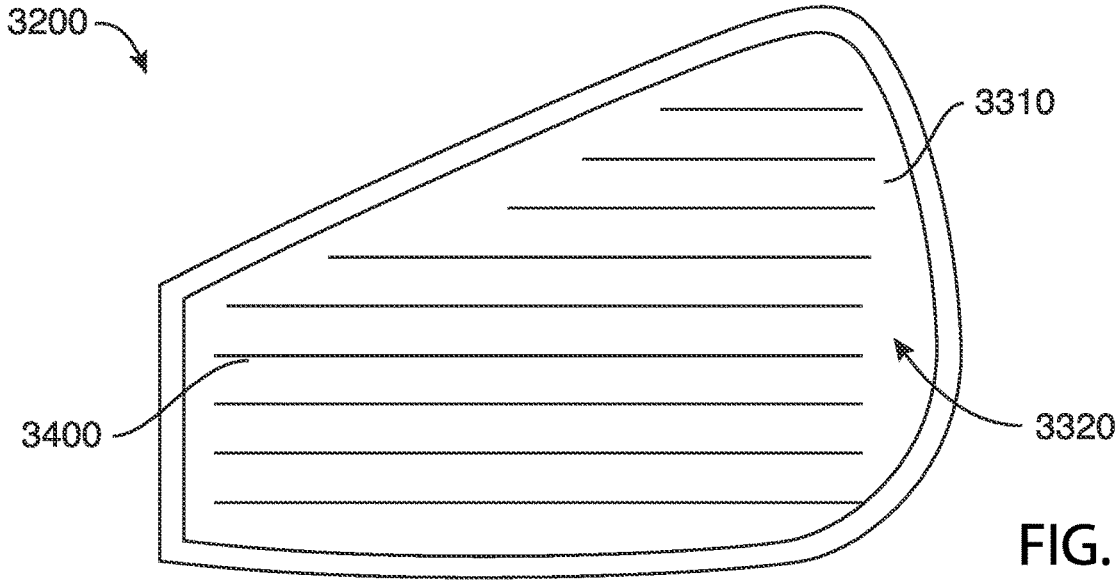
FIG. 33 depicts a back view of the face portion of FIG. 32.
Figure 34:
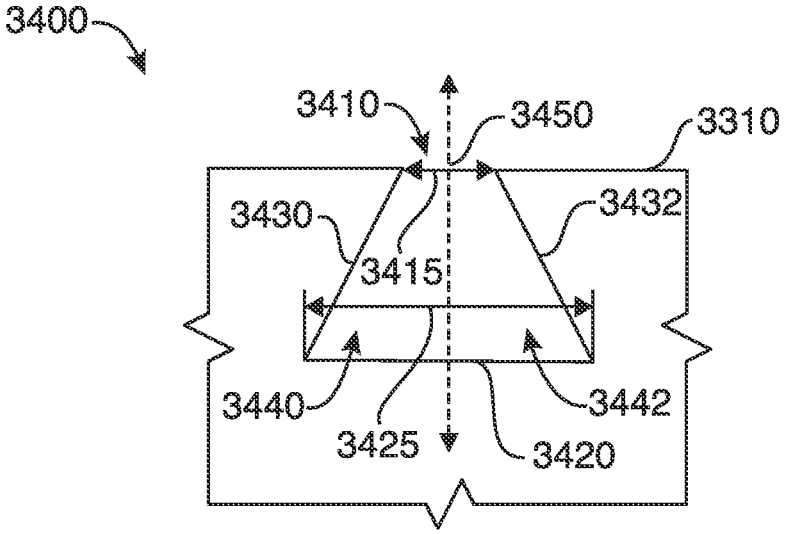
FIG. 34 depicts a cross-sectional view of an example channel of the face portion of FIG. 32.

As illustrated in FIGS. 32-34, for example, a face portion 3200 may include the front surface 3210, and the back surface 3310. The front surface 3210 may include one or more grooves, generally shown as 3220, extending longitudinally across the front surface 3210 (e.g., extending between the toe portion 1440 and the heel portion 1450 of FIG. 14). The front surface 3210 may be used to impact a golf ball (not shown).

The back surface 3310 may also include one or more channels, generally shown as 3320. The channels 3320 may extend longitudinally across the back surface 3310. The channels 3320 may be parallel or substantially parallel to each other. The channels 3320 may engage with the elastic polymer material used to fill the interior cavity 2000, and serve as a mechanical locking mechanism between the face portion 3200 and the elastic polymer material. In particular, a channel 3400 may include an opening 3410, a bottom section 3420, and two sidewalls, generally shown as 3430 and 3432. The bottom section 3420 may be parallel or substantially parallel to the back surface 3310. The two sidewalls 3430 and 3432 may be converging sidewalls (i.e., the two sidewalls 3430 and 3432 may not be parallel to each other). The bottom section 3420 and the sidewalls 3430 and 3432 may form two undercut portions, generally shown as 3440 and 3442. That is, a width 3415 at the opening 3410 may be less than a width 3425 of the bottom section 3420. A cross section of the channel 3400 may be symmetrical about an axis 3450. While FIG. 34 may depict flat or substantially flat sidewalls, the two sidewalls 3430 and 3432 may be curved (e.g., convex relative to each other).

Figure 35:
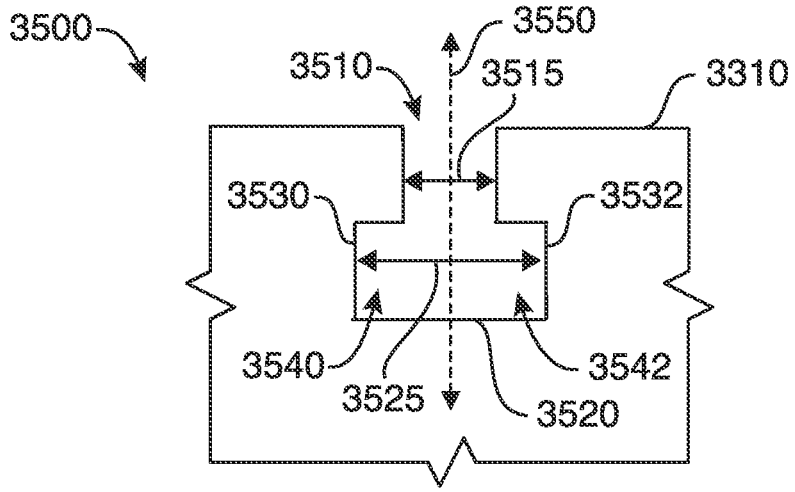
FIG. 35 depicts a cross-sectional view of another example channel of the face portion of FIG. 32.

Instead of flat or substantially flat sidewalls as shown in FIG. 34, a channel may include other types of sidewalls. As illustrated in FIG. 35, for example, a channel 3500 may include an opening 3510, a bottom section 3520, and two sidewalls, generally shown as 3530 and 3532. The bottom section 3520 may be parallel or substantially parallel to the back surface 3310. The two sidewalls 3530 and 3532 may be stepped sidewalls. The bottom section 3520 and the sidewalls 3530 and 3532 may form two undercut portions, generally shown as 3540 and 3542. That is, a width 3515 at the opening 3510 may be less than a width 3525 of the bottom section 3520. A cross section of the channel 3500 may be symmetrical about an axis 3550.

Figure 36:
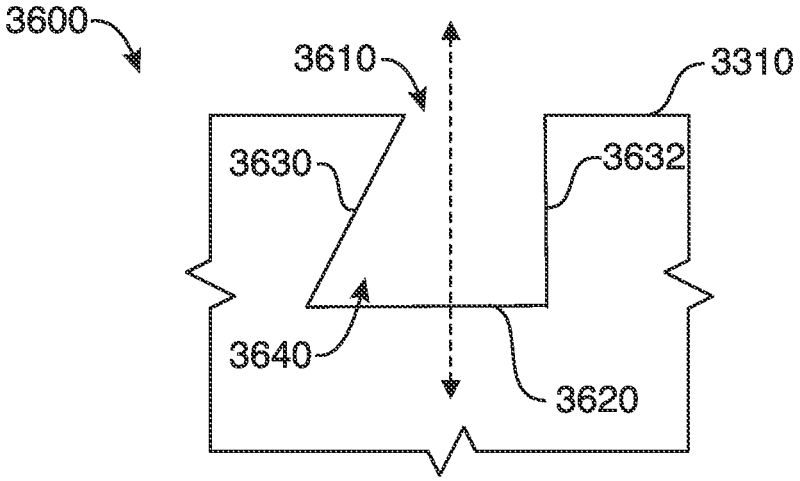
FIG. 36 depicts a cross-sectional view of yet another example channel of the face portion of FIG. 32.

Instead of being symmetrical as shown in FIGS. 34 and 35, a channel may be asymmetrical. As illustrated in FIG. 36, for another example, a channel 3600 may include an opening 3610, a bottom section 3620, and two sidewalls, generally shown as 3630 and 3632. The bottom section 3620 may be parallel or substantially parallel to the back surface 3310. The bottom section 3620 and the sidewall 3630 may form an undercut portion 3640.

Figure 37:
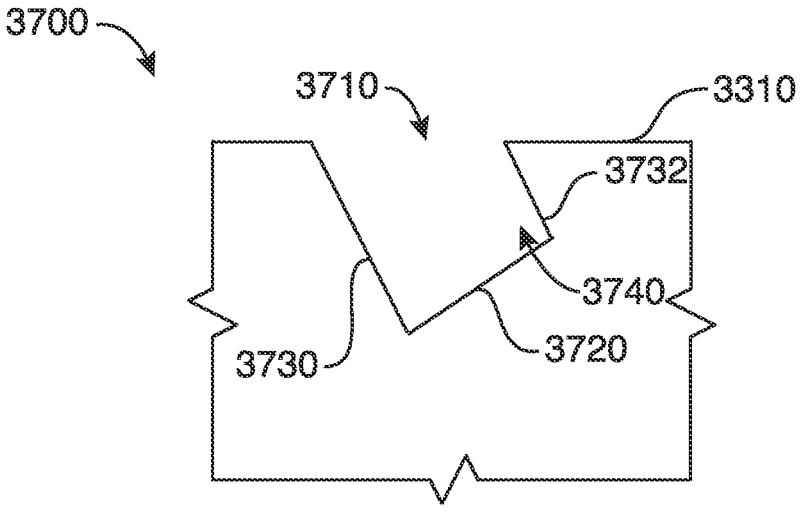
FIG. 37 depicts a cross-sectional view of yet another example channel of the face portion of FIG. 32.

Referring to FIG. 37, for example, a channel 3700 may include an opening 3710, a bottom section 3720, and two sidewalls, generally shown as 3730 and 3732. The bottom section 3720 may not be parallel or substantially parallel to the back surface 3310. The two sidewalls 3730 and 3732 may be parallel or substantially parallel to each other but one sidewall may be longer than the other sidewall. The bottom section 3720 and the sidewall 3732 may form an undercut portion 3740.

Figure 38:
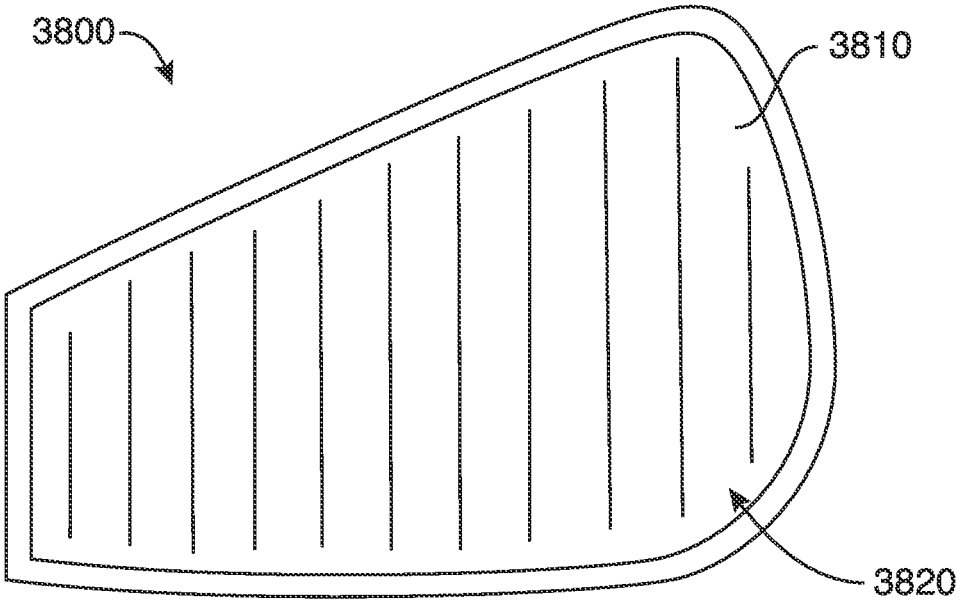
FIG. 38 depicts a back view of another example face portion of the example golf club head of FIG. 32.
Figure 39:
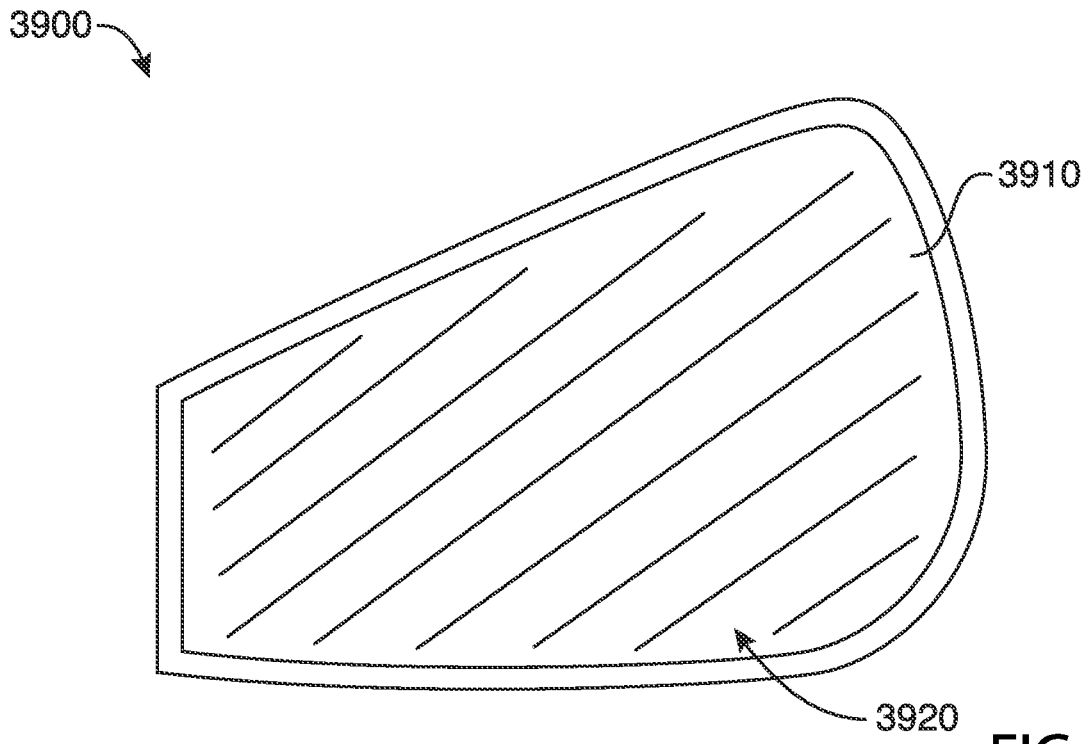
FIG. 39 depicts a back view of yet another example face portion of the example golf club head of FIG. 32.
Figure 40:
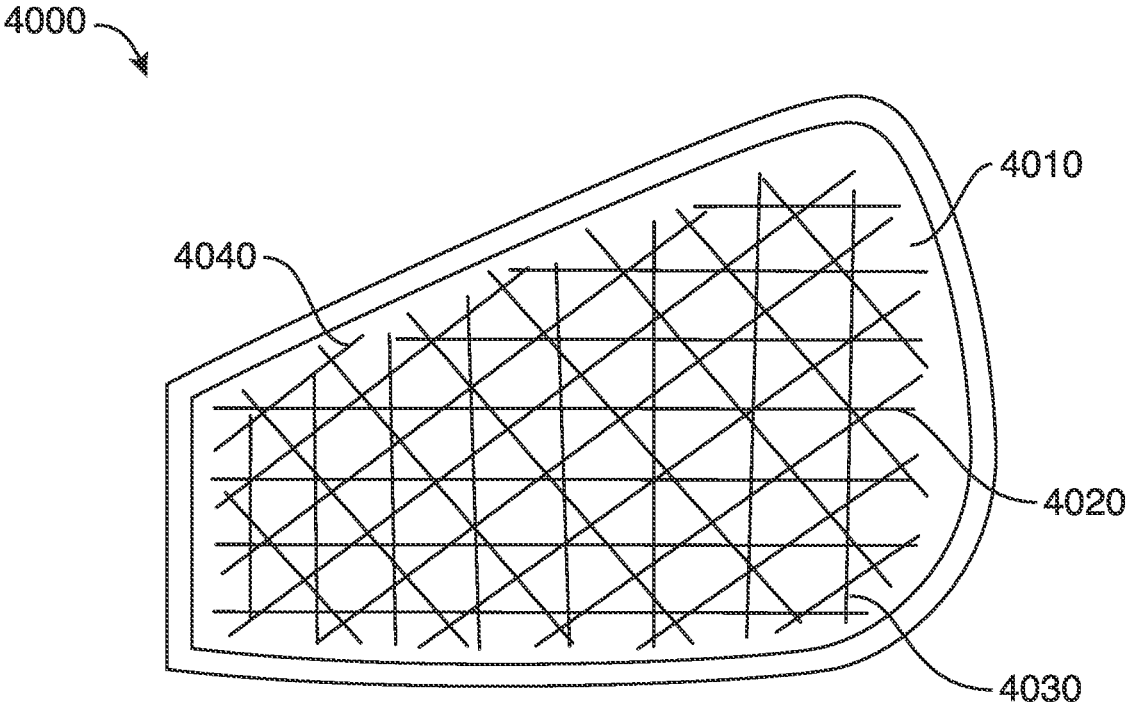
FIG. 40 depicts a back view of yet another example face portion of the example golf club head of FIG. 32.

In the example as shown in FIG. 38, a face portion 3800 may include a back surface 3810 with one or more channels, generally shown as 3820, extending laterally across the back surface 3810 (e.g., extending between the top portion 1480 and the sole portion 1490 of FIG. 1). In another example as depicted in FIG. 39, a face portion 3900 may include a back surface 3910 with one or more channels, generally shown as 3920, extending diagonally across the back surface 3910. Alternatively, a face portion may include a combination of channels extending in different directions across a back surface of the face portion (e.g., extending longitudinally, laterally, and/or diagonally). Turning to FIG. 40, for yet another example, a face portion 4000 may include a back surface 4010 with one or more channels, generally shown as 4020, 4030, and 4040, extending in different directions across the back surface 4010. In particular, the face portion 4000 may include a plurality of channels 4020 extending longitudinally across the back surface 4010, a plurality of channels 4030 extending laterally across the back surface 4010, and a plurality of channels 4040 extending diagonally across the back surface 4010.

Figure 41:
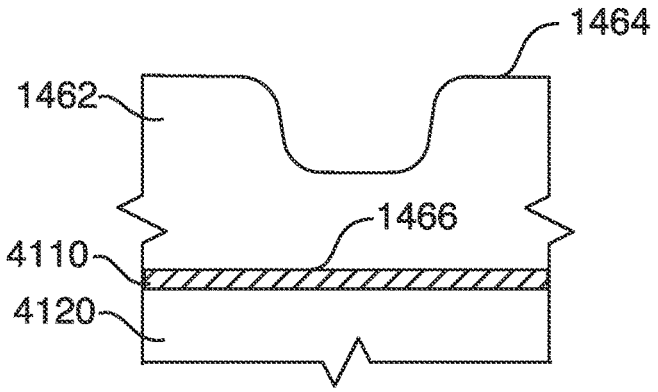
FIG. 41 depicts a cross-sectional view of the example golf club head of FIG. 32.

In addition or alternatively, the golf club head 1400 may include a bonding agent to improve adhesion and/or mitigate delamination between the face portion 1462 and the elastic polymer material used to fill the interior cavity 2000 of the golf club head 1400 (e.g., FIG. 20). Referring to FIG. 41, for example, the golf club head 1400 may include the face portion 1462, a bonding portion 4110, and an elastic polymer material 4120. In one example, the bonding portion 4110 may be low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In another example, the bonding portion 4110 may be LOCTITE® materials manufactured by Henkel Corporation, Rocky Hill, Conn. The bonding portion 4110 may be applied to the back surface 1466 to bond the elastic polymer material 4120 to the face portion 1462 (e.g., extending between the back surface 1466 and the elastic polymer material 4120). For example, the bonding portion 4110 may be applied when the interior cavity 2000 is filled with the elastic polymer material 4120 via an injection-molding process. In another example, the bonding portion 4110 may be an integral portion of the elastic polymer material 4120. Alternatively, the elastic polymer material 4120 may have adhesion properties. In other words, the elastic polymer material 4120 may adhere directly to the back surface 1466 of the face portion 1462, or the bonding portion 4110 may be included in the elastic polymer material 4120. The apparatus, methods, and articles of manufacture are not limited in this regard.

Figure 42:
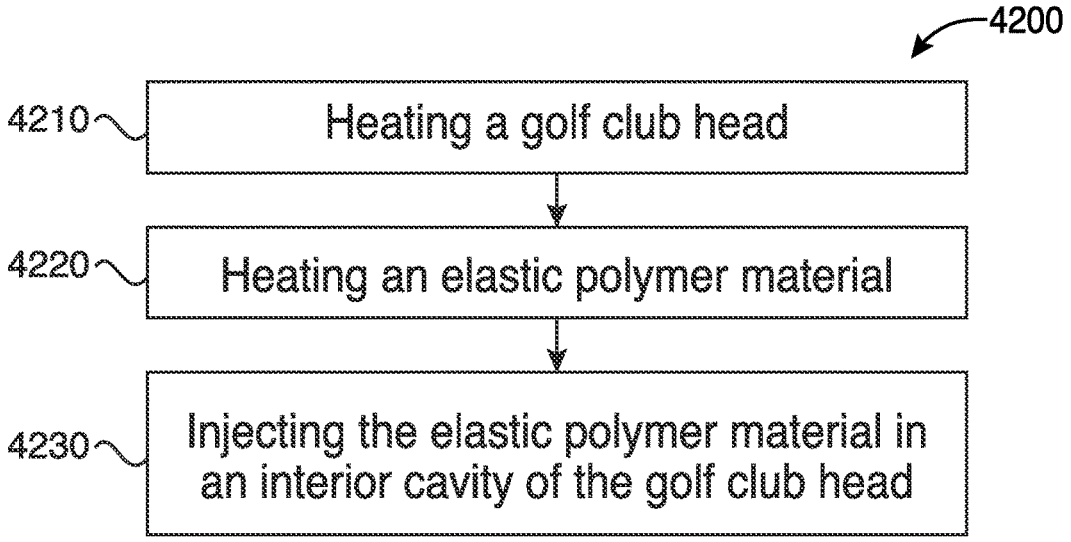
FIG. 42 depicts another manner in which an example golf club head described herein may be manufactured.

FIG. 42 depicts one manner in which the interior cavity 2000 of the golf club head 1400 or any of the golf club heads described herein is partially or entirely filled with an elastic polymer material or an elastomer material. The process 4200 may begin with heating the golf club head 1400 to a certain temperature (block 4210). In one example, the golf club head 1400 may be heated to a temperature ranging between 150° C. to 250° C., which may depend on factors such as the vaporization temperature of the elastic polymer material to be injected in the interior cavity 2000. The elastic polymer material may then be heated to a certain temperature (block 4220). The elastic polymer material may be a non-foaming and injection-moldable thermoplastic elastomer (TPE) material. Accordingly, the elastic polymer material may be heated to reach a liquid or a flowing state prior to being injected into the interior cavity 2000. The temperature to which the elastic polymer material may be heated may depend on the type of elastic polymer material used to partially or fully fill the interior cavity 2000. The heated elastic polymer material may be injected into the interior cavity 2000 to partially or fully fill the interior cavity 2000 (block 4230). The elastic polymer material may be injected into the interior cavity 2000 from one or more of the weight ports described herein (e.g., one or more weight ports of the first and second sets of weight ports 2720 and 2730, respectively, shown in FIG. 27). One or more other weight ports may allow the air inside the interior cavity 2000 displaced by the elastic polymer material to vent from the interior cavity 2000. In one example, the golf club head 1400 may be oriented horizontally as shown in FIG. 27 during the injection molding process. The elastic polymer material may be injected into the interior cavity 2000 from weight ports 2731 and 2732. The weight ports 2721, 2722 and/or 2723 may serve as air ports for venting the displaced air from the interior cavity 2000. Thus, regardless of the orientation of the golf club head 1400 during the injection molding process, the elastic polymer material may be injected into the interior cavity 2000 from one or more lower positioned weight ports while one or more upper positioned weight ports may serve as air vents. The mold (i.e., the golf club head 1400) may then be cooled passively (e.g., at room temperature) or actively so that the elastic polymer material reaches a solid state and adheres to the back surface 1466 of the face portion 1462. The elastic polymer material may directly adhere to the back surface 1466 of the face portion 1462. Alternatively, the elastic polymer material may adhere to the back surface 1466 of the face portion 1462 with the aid of the one or more structures on the back surface 1466 and/or a bonding agent described herein (e.g., the bonding portion 4110 shown in FIG. 41). The apparatus, methods, and articles of manufacture described herein are not limited in this regard.

As discussed above, the elastic polymer material may be heated to a liquid state (i.e., non-foaming) and solidifies after being injection molded in the interior cavity 2000. An elastic polymer material with a low modulus of elasticity may provide vibration and noise dampening for the face portion 1462 when the face portion 1462 impacts a golf ball. For example, an elastic polymer material that foams when heated may provide vibration and noise dampening. However, such a foaming elastic polymer material may not have sufficient rigidity to provide structural support to a relatively thin face portion because of possible excessive deflection and/or compression of the elastic polymer material when absorbing the impact of a golf ball. In one example, the elastic polymer material that is injection molded in the interior cavity 2000 may have a relatively high modulus of elasticity to provide structural support to the face portion 1462 and yet elastically deflect to absorb the impact forces experienced by the face portion 1462 when striking a golf ball. Thus, a non-foaming and injection moldable elastic polymer material with a relatively high modulus of elasticity may be used for partially or fully filling the interior cavity 2000 to provide structural support and reinforcement for the face portion 1462 in addition to providing vibration and noise dampening. That is, the non-foaming and injection moldable elastic polymer material may be a structural support portion for the face portion 1462. The apparatus, methods, and articles of manufacture are not limited in this regard.

Figure 43:
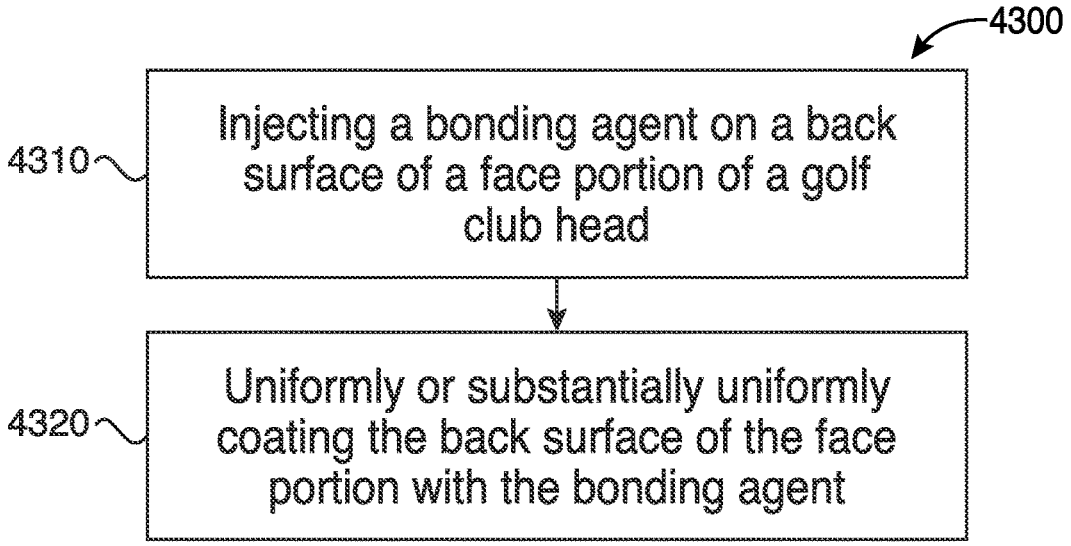
FIG. 43 depicts yet another manner in which an example golf club head described herein may be manufactured.

FIG. 43 depicts one manner in which a bonding agent as described herein may be applied to a golf club head prior to partially of fully injecting an elastic polymer in the interior cavity 2000. In the example of FIG. 43, the process 4300 may begin with injecting a bonding agent on the back surface 1466 of the face portion 1462 (block 4310). The bonding agent may be injected on the back surface 1466 prior to or after heating the golf club head as described above depending on the properties of the bonding agent. The bonding agent may be injected through one or more of the first set of weight ports 2720 and/or the second set of weight ports 2730. The bonding agent may be injected on the back surface 1466 through several or all of the first set of weight ports 2720 and the second set of weight ports 2730. For example, an injection instrument such as a nozzle or a needle may be inserted into each weight port until the tip or outlet of the instrument is near the back surface 1466. The bonding agent may then be injected on the back surface 1466 from the outlet of the instrument. Additionally, the instrument may be moved, rotated and/or swiveled while inside the interior cavity 2000 so that the bonding agent is injected onto an area of the back surface 1466 surrounding the instrument. For example, the outlet of the injection instrument may be moved in a circular pattern while inside a weight port to inject the bonding agent in a corresponding circular pattern on the back surface 1466. Each of the first set of weight ports 2720 and the second set of weight ports 2730 may be utilized to inject a bonding agent on the back surface 1466. However, utilizing all of first weight ports 2720 and/or the second set of weight ports 2730 may not be necessary. For example, using every other adjacent weight port may be sufficient to inject a bonding agent on the entire back surface 1466. In another example, weight ports 2721, 2722, 2731, 2733 and 2736 may be used to inject the bonding agent on the back surface 1466. The apparatus, methods, and articles of manufacture are not limited in this regard.

The process 4300 may also include spreading the bonding agent on the back surface 1466 (block 4320) after injection of the bonding agent onto the back surface 1466 so that a generally uniform coating of the bonding agent is provided on the back surface 1466. According to one example, the bonding agent may be spread on the back surface 1466 by injecting air into the interior cavity 2000 through one or more of the first set of weight ports 2720 and the second set of weight ports 2730. The air may be injected into the interior cavity 2000 and on the back surface 1466 by inserting an air nozzle into one or more of the first set of weight ports 2720 and the second set of weight ports 2730. According to one example, the air nozzle may be moved, rotated and/or swiveled at a certain distance from the back surface 1466 so as to uniformly blow air onto the bonding agent to spread the bonding agent on the back surface 1466 for a uniform coating or a substantially uniform coating of the bonding agent on the back surface 1466. The apparatus, methods, and articles of manufacture are not limited in this regard.

The process 4300 may include a single step of injecting and uniformly or substantially uniformly coating the back surface 1466 with the bonding agent. In one example, the bonding agent may be injected on the back surface 1466 by being converted into fine particles or droplets (i.e., atomized) and sprayed on the back surface 1466. Accordingly, the back surface 1466 may be uniformly or substantially uniformly coated with the bonding agent in one step. A substantially uniform coating of the back surface 1466 with the bonding agent may be defined as a coating having slight non-uniformities due to the injection process or the manufacturing process. However, such slight non-uniformities may not affect the bonding of the filler material to the back surface 1466 with the bonding agent as described herein. For example, spraying the bonding agent on the back surface 1466 may result in overlapping regions of the bonding agent having a slightly greater coating thickness than other regions of the bonding agent on the back surface 1466. The apparatus, methods, and articles of manufacture are not limited in this regard.

Figure 44:
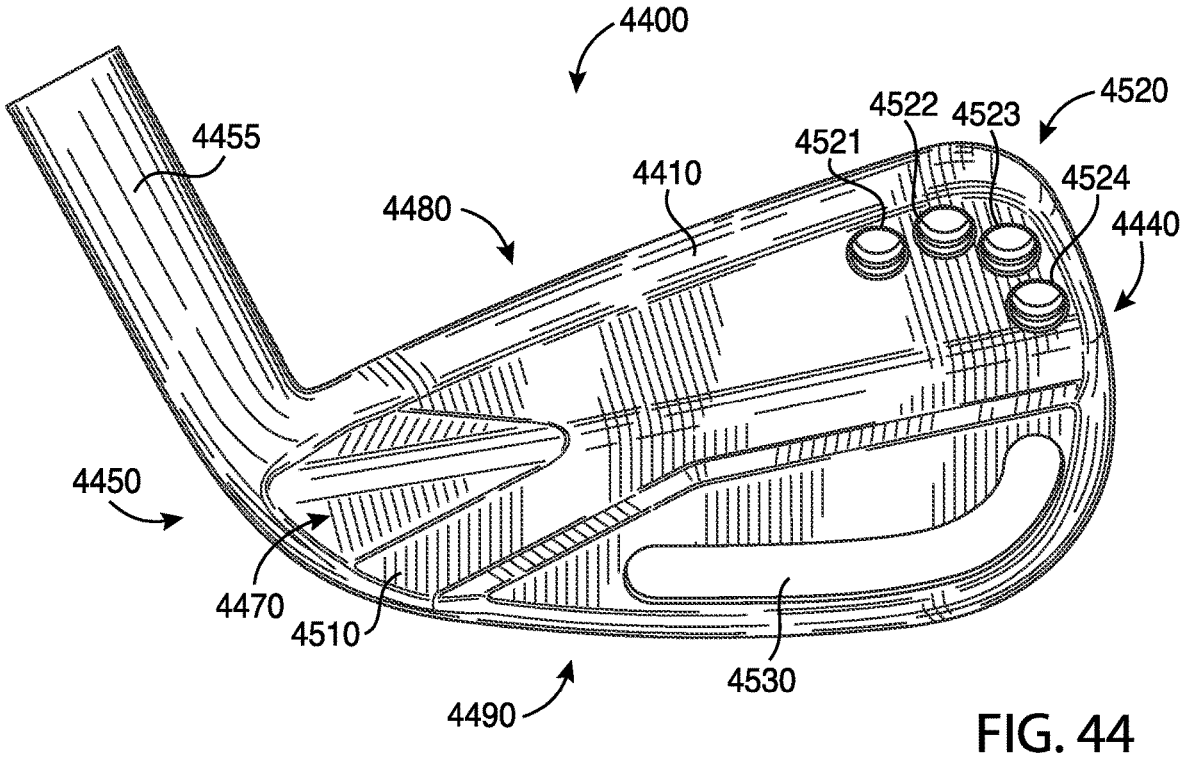
FIG. 44 depicts a rear view of a golf club head according to an embodiment of the apparatus, methods, and articles of manufacture described herein.
Figure 45:
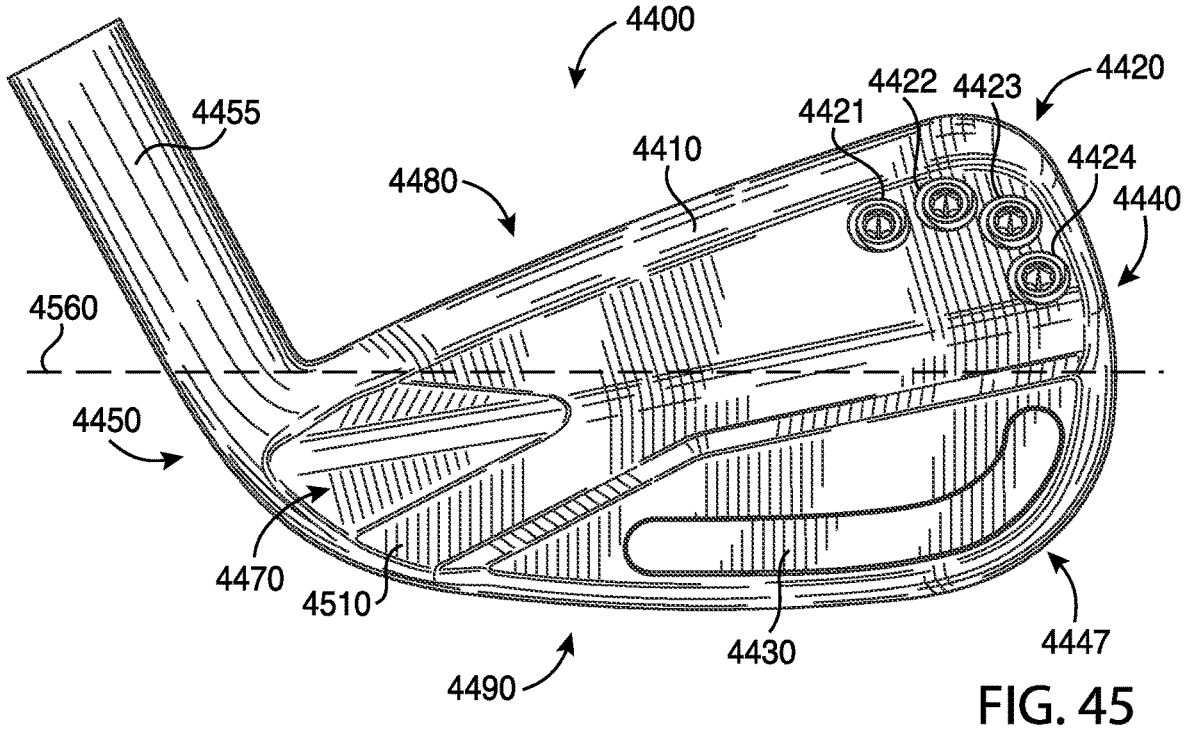
FIG. 45 depicts a rear view of the golf club head of FIG. 44.
Figure 46:
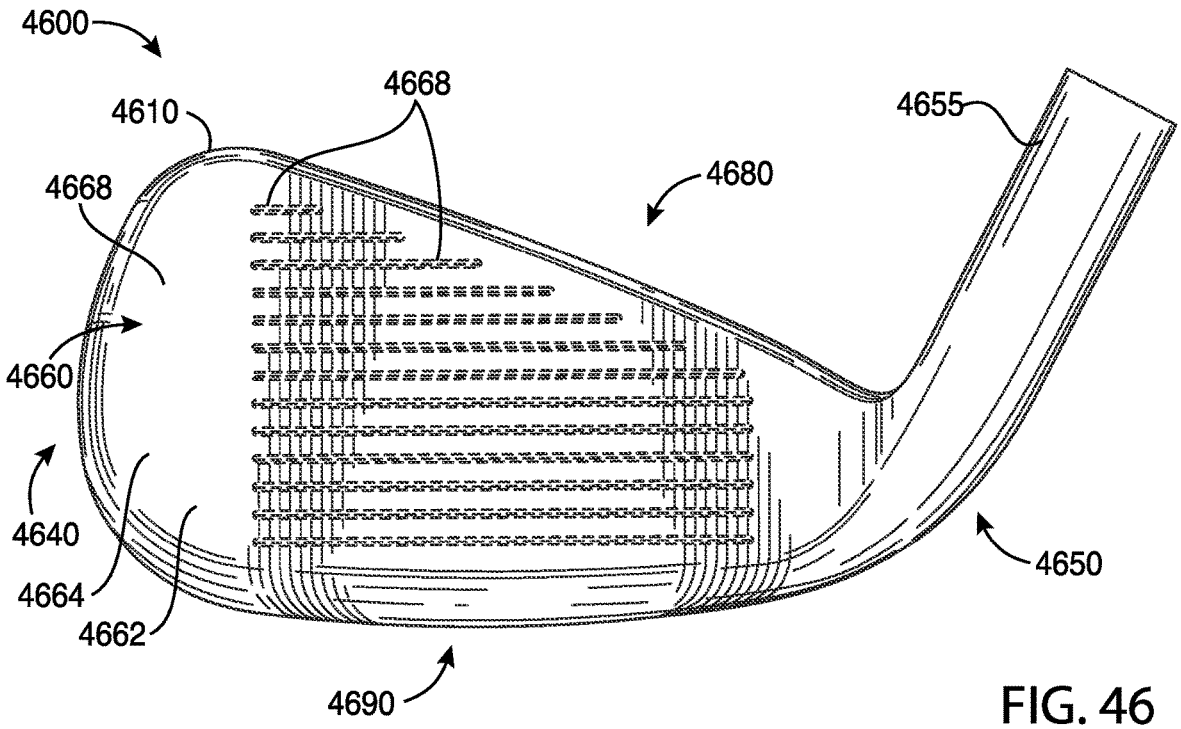
FIG. 46 depicts a front view of a golf club head according to an embodiment of the apparatus, methods, and articles of manufacture described herein.

As described herein, any two or more of the weight portions may be configured as a single weight portion. In the example of FIGS. 44 and 45, a golf club head 4400 may include a body portion 4410 and two or more weight portions, generally shown as a first set of weight portions 4420 (e.g., shown as weight portions 4421, 4422, 4423, and 4424) and a second weight portion 4430. The body portion 4410 may include a toe portion 4440, a heel portion 4450, a front portion (not shown), a back portion 4470, a top portion 4480, and a sole portion 4490. The front portion may be similar in many respects to the front portion 1460 of the golf club head 1400. Accordingly, details of the front portion of the golf club head 4400 are not provided.

The body portion 4410 may be made of a first material whereas the first set of weight portions 4420 and the second weight portion 4430 may be made of a second material. The first and second materials may be similar or different materials. For example, the body portion 4410 may be partially or entirely made of a steel-based material (e.g., 30-4 PH stainless steel, Nitronic® 50 stainless steel, maraging steel or other types of stainless steel), a titanium-based material, an aluminum-based material (e.g., a high-strength aluminum alloy or a composite aluminum alloy coated with a high-strength alloy), any combination thereof, and/or other suitable types of materials. The first set of weight portions 4420 and the second weight portion 4430 may be partially or entirely made of a high-density material such as a tungsten-based material or other suitable types of materials. Alternatively, the body portion 4410 and/or the first set of weight portions 4420 and the second weight portion 4430 may be partially or entirely made of a non-metal material (e.g., composite, plastic, etc.). The apparatus, methods, and articles of manufacture are not limited in this regard.

The golf club head 4400 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees (°), 48°, 52°, 56°, 60°, etc.). Although FIGS. 44 and 45 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The toe portion 4440 and the heel portion 4450 may be on opposite ends of the body portion 4410. The heel portion 4450 may include a hosel portion 4455 configured to receive a shaft (for example the shaft 5604) with a grip (for example the grip 5606) on one end and the golf club head 4400 on the opposite end of the shaft to form a golf club.

The back portion 4470 may include a back wall portion 4510 with one or more exterior weight ports along a periphery of the back portion 4470, generally shown as a first set of exterior weight ports 4520 (e.g., shown as weight ports 4521, 4522, 4523, and 4524) and a second weight port 4530. Each exterior weight port of the first set of weight ports 4520 may be associated with a port diameter. In one example, the port diameter may be about 0.25 inch (6.35 millimeters). Any two adjacent exterior weight ports of the first set of exterior weight ports 4520 may be separated by less than the port diameter. The first set of weight ports 4520 and the second weight port 4530 may be exterior weight ports configured to receive one or more weight portions.

Each weight portion of the first set of weight portions 4420 (e.g., shown as weight portions 4421, 4422, 4423, and 4424) may be disposed in a weight port of the first set of weight ports 4520 (e.g., shown as weight ports 4521, 4522, 4523, and 4524) located at or proximate to the toe portion 4440 and/or the top portion 4480 on the back portion 4470. For example, the weight portion 4421 may be partially or entirely disposed in the weight port 4521. In another example, the weight portion 4422 may be disposed in a weight port 4522 located in a transition region between the top portion 4480 and the toe portion 4440 (e.g., atop-and-toe transition region). The configuration of the first set of weight ports 4520 and the first set of weight portions 4420 is similar to many respects to the golf club head 1400. Accordingly, a detailed description of the configuration of the first set of weight ports 4520 and the first set of weight portions 4420 is not provided.

The second weight port 4530 may be a recess extending from the toe portion 4440 or a location proximate to the toe portion 4440 to the sole portion or a location proximate to the sole portion 4490 and through the transition region between the toe portion 4440 and the sole portion 4490. Accordingly, as shown in FIG. 44, the second weight port 4530 may resemble an L-shaped or a J-shaped recess. The second weight portion 4430 may resemble the shape of the second weight port 4530 and may be configured to be disposed in the second weight port 4530. The second weight portion 4430 may be partially or fully disposed in the weight port 4530. The second weight portion 4430 may have any shape such as oval, rectangular, triangular, or any geometric or non-geometric shape. The second weight port 4530 may be shaped similar to the second weight portion 4430. However, portions of the second weight portion 4430 that are inserted in the second weight port 4530 may have similar shapes as the weight port 4530. As described in detail herein, any of the weight portions described herein, including the weight portions 4420 and the second weight portion 4430 may be coupled to the back portion 4470 of the body portion 4410 with various manufacturing methods and/or processes (e.g., a bonding process, a welding process, a brazing process, a mechanical locking method, any combination thereof, or other suitable manufacturing methods and/or processes).

The second weight portion 4430 may be configured to place the center of gravity of the golf club head 1400 at an optimal location and optimize the moment of inertia of the golf club head about a vertical axis that extends through the center of gravity of the golf club head 4400. All or a substantial portion of the second weight portion 4430 may be generally near the sole portion 4490. For example, the second weight portion 4430 may be near the periphery of the body portion 4410 and extend from the sole portion 4490 to the toe portion 4440. As shown in the example of FIG. 45, the second weight portion 4430 may be located near the periphery of the body portion 4410 and partially or substantially extend along the sole portion 4490 to lower the center of gravity of the golf club head 4400. A portion of the second weight portion 4430 may be located near the periphery of the body portion 4410 and extend from the sole portion 4490 to the toe portion 4440 through a transition region 4447 between the sole portion 4490 and the toe portion 4440 to lower the center of gravity and increase the moment of inertia of the golf club head 4400 about a vertical axis that extends through the center of gravity. To lower the center of gravity of the golf club head 4400, all or a portion of the second weight portion 4430 may be located closer to the sole portion 4490 than to a horizontal midplane 4560 of the golf club head 4400. The location of the second weight portion 4430 (i.e., the location of the weight port 4530) and the physical properties and materials of construction of the weight portions of the second weight port 4430 may be determined to optimally affect the weight, weight distribution, center of gravity, moment of inertia characteristics, structural integrity and/or or other static and/or dynamic characteristics of the golf club head 4400. The apparatus, methods, and articles of manufacture described herein are not limited in this regard.

The weight portions of the first set of weight portions 4420 may have similar or different physical properties (e.g., color, shape, size, density, mass, volume, etc.). In the illustrated example as shown in FIG. 45, each of the weight portions of the first set of weight portions 4420 may have a cylindrical shape (e.g., a circular cross section). Alternatively, each of the weight portions of the first set of weight portions 4420 may have different shapes. Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

In the example of FIGS. 46-55, a golf club head 4600 may include a body portion 4610, and two or more weight portions, generally shown as a first set of weight portions 4620 (e.g., shown as weight portions 4621 and 4622) and a second set of weight portions 4630 (e.g., shown as weight portions 4631, 4632, 4633, 4634 and 4635). The body portion 4610 may include a toe portion 4640, a heel portion 4650, a front portion 4660, a back portion 4670, a top portion 4680, and a sole portion 4690. The heel portion 4650 may include a hosel portion 4655 configured to receive a shaft (for example the shaft 5604) with a grip (for example the grip 5606) on one end and the golf club head 4600 on the opposite end of the shaft to form a golf club.

The body portion 4610 may be made of a first material whereas the first and second sets of weight portions 4620 and 4630, respectively, may be made of a second material. The first and second materials may be similar or different materials. The materials from which the golf club head 4600, weight portions 4620 and/or weight portions 4630 are constructed may be similar in many respects to any of the golf club heads and the weight portions described herein such as the golf club head 1400. Accordingly, a detailed description of the materials of construction of the golf club head 4600, weight portions 4620 and/or weight 4630 are not described in detail. The apparatus, methods, and articles of manufacture are not limited in this regard.

The golf club head 4600 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees (°), 48°, 52°, 56°, 60°, etc.). Although FIGS. 46-55 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The front portion 4660 may include a face portion 4662 (e.g., a strike face). The face portion 4662 may include a front surface 4664 and a back surface 4666 (shown in FIG. 50). The front surface 4664 may include one or more grooves 4668 extending between the toe portion 4640 and the heel portion 4650. While the figures may depict a particular number of grooves, the apparatus, methods, and articles of manufacture described herein may include more or less grooves. The face portion 4662 may be used to impact a golf ball (not shown). The face portion 4662 may be an integral portion of the body portion 4610. Alternatively, the face portion 4662 may be a separate piece or an insert coupled to the body portion 4610 via various manufacturing methods and/or processes (e.g., a bonding process such as adhesive, a welding process such as laser welding, a brazing process, a soldering process, a fusing process, a mechanical locking or connecting method, any combination thereof, or other suitable types of manufacturing methods and/or processes). The face portion 4662 may be associated with a loft plane that defines the loft angle of the golf club head 4600. The loft angle may vary based on the type of golf club (e.g., a long iron, a middle iron, a short iron, a wedge, etc.). In one example, the loft angle may be between five degrees and seventy-five degrees. In another example, the loft angle may be between twenty degrees and sixty degrees. The apparatus, methods, and articles of manufacture described herein are not limited in this regard.

Figure 49:
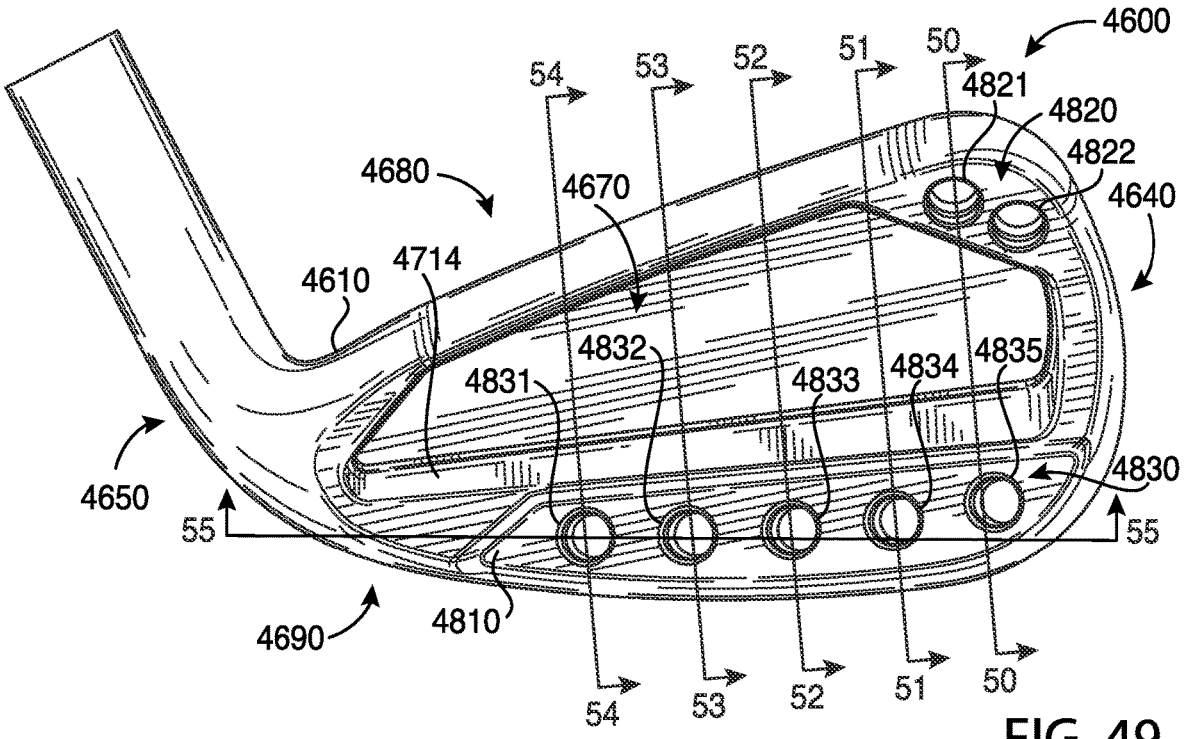
FIG. 49 depicts a rear view of the example golf club head of FIG. 46.

As illustrated in FIG. 49, the back portion 4670 may include a back wall portion 4810 with one or more exterior weight ports along a periphery of the back portion 4670, generally shown as a first set of exterior weight ports 4820 (e.g., shown as weight ports 4821 and 4822) and a second set of exterior weight ports 4830 (e.g., shown as weight ports 4831, 4832, 4833, 4834 and 4835). Each exterior weight port may be defined by an opening in the back wall portion 4810. Each exterior weight port may be associated with a port diameter. In one example, the port diameter may be about 0.25 inch (6.35 millimeters). The weight ports of the first set of exterior weight ports 4820 may be separated by less than the port diameter or the port diameter of any of the two adjacent weight ports of the first set of exterior weight ports 4820. In a similar manner, any two adjacent exterior weight ports of the second set of exterior weight ports 4830 may be separated by less than the port diameter or the port diameter of any of the two adjacent weight ports of the second set of exterior weight ports 4830. The first and second exterior weight ports 4820 and 4830, respectively, may be exterior weight ports configured to receive one or more weight portions. In particular, each weight portion of the first set of weight portions 4620 (e.g., shown as weight portions 4621 and 4622) may be disposed in a weight port located at or proximate to the toe portion 4640 and/or the top portion 4680 on the back portion 4670. For example, the weight portion 4621 may be partially or entirely disposed in the weight port 4821. In another example, the weight portion 4622 may be disposed in the weight port 4822 located in a transition region between the top portion 4680 and the toe portion 4640 (e.g., a top-and-toe transition region). Each weight portion of the second set of weight portions 4630 (e.g., shown as weight portions 4631, 4632, 4633, 4634 and 4635) may be disposed in a weight port located at or proximate to the toe portion 4640 and/or the sole portion 4690 on the back portion 4670. For example, the weight portion 4633 may be partially or entirely disposed in the weight port 4833. In another example, the weight portion 4635 may be disposed in a weight port 4835 located in a transition region between the sole portion 4690 and the toe portion 4640 (e.g., a sole-and-toe transition region). In another example, any of the weight portions of the first set of weight portions 4620 and the second set of weight portions 4630 may disposed in any of the weight ports of the first set of weight ports 4820 and the second set of weight ports 4830. As described in detail herein, the first and second sets of weight portions 4620 and 4630, respectively, may be coupled to the back portion 4670 of the body portion 4610 with various manufacturing methods and/or processes (e.g., a bonding process, a welding process, a brazing process, a mechanical locking method, any combination thereof, or other suitable manufacturing methods and/or processes).

Alternatively, the golf club head 4600 may not include (i) the first set of weight portions 4620, (ii) the second set of weight portions 4630, or (iii) both the first and second sets of weight portions 4620 and 4630. In particular, the back portion 4670 of the body portion 4610 may not include weight ports at or proximate to the top portion 4680 and/or the sole portion 4690. For example, the mass of the first set of weight portions 4620 (e.g., 3 grams) and/or the mass of the second set of weight portions 4630 (e.g., 16.8 grams) may be integral part(s) the body portion 4610 instead of separate weight portion(s). The apparatus, methods, and articles of manufacture described herein are not limited in this regard.

The first and second sets of weight portions 4620 and 4630, respectively, may have similar or different physical properties (e.g., color, shape, size, density, mass, volume, etc.). As a result, the first and second sets of weight portions 4620 and 4630, respectively, may contribute to the ornamental design of the golf club head 4600. The physical properties of the first and second sets of weight portions 4620 and 4630 may be similar in many respect to any of the weight portions described herein, such as the weight portions shown in the example of FIG. 24. Furthermore, the devices and/or methods by which the first and second set of weight portions 4620 and 4630 are coupled to the golf club head 4600 may be similar in many respects to any of the weight portions described herein, such as the weight portions shown in the example of FIGS. 25 and 26. Accordingly, a detailed description of the physical properties of the first and second sets of weight portions 4620 and 4630, and the devices and/or methods by which the first and second sets of weight portions 4620 and 4630 are coupled to the golf club head 4600 are not described in detail herein. The apparatus, methods, and articles of manufacture described herein are not limited in this regard.

Figure 47:
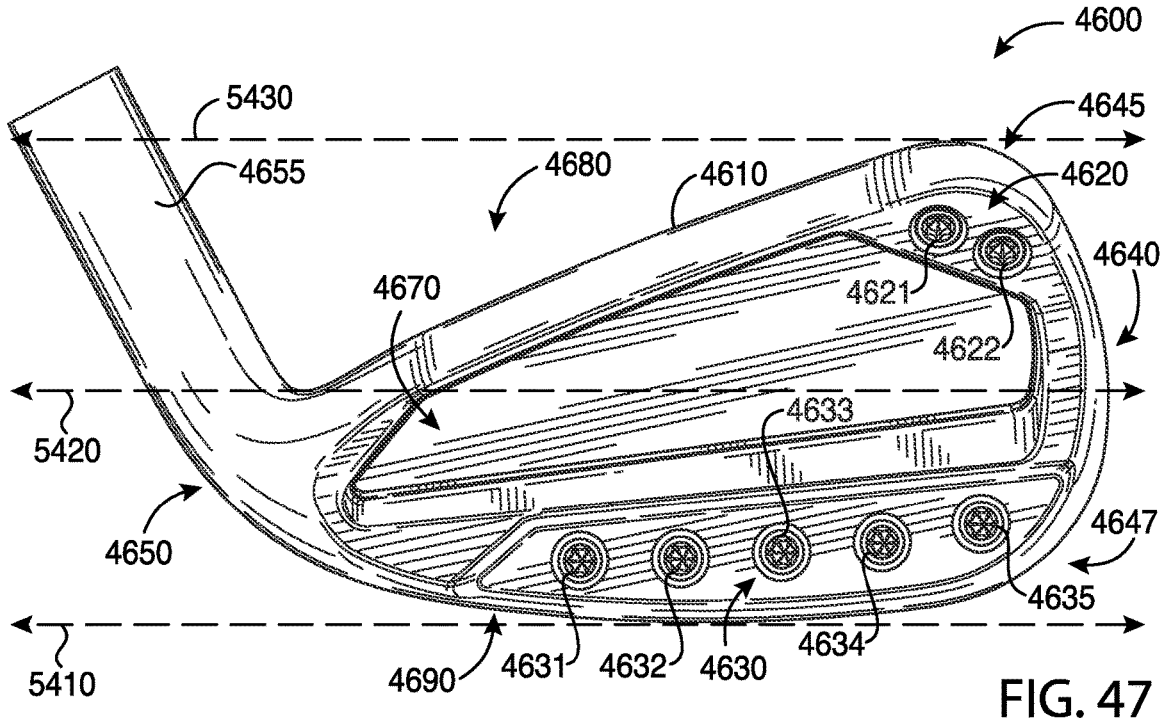
FIG. 47 depicts a rear view of the example golf club head of FIG. 46.
Figure 48:
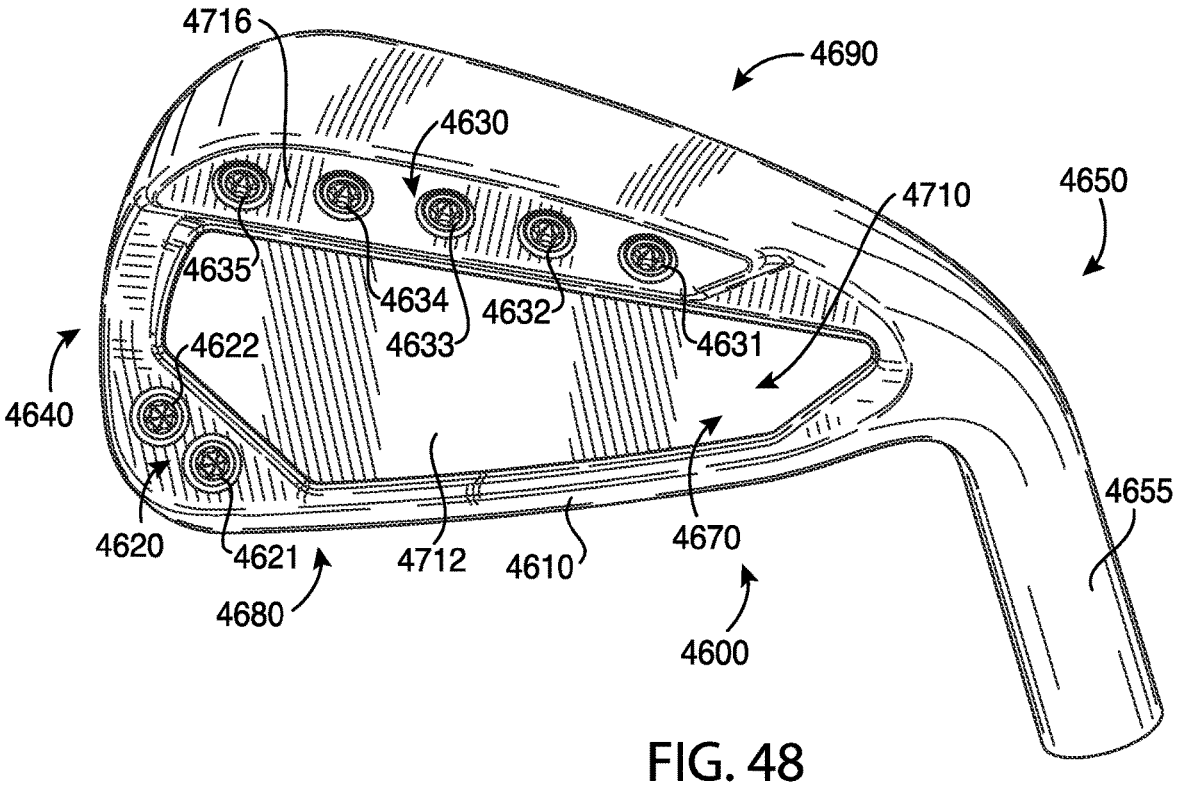
FIG. 48 depicts a rear perspective view of the example golf club head of FIG. 46.

As illustrated in FIG. 47, golf club head 4600 may be associated with a ground plane 5410, a horizontal midplane 5420, and a top plane 5430. In particular, the ground plane 5410 may be a plane that may be substantially parallel with the ground and be tangential to the sole portion 4690 of the golf club head 4600 when the golf club head 4600 is at an address position (e.g., the golf club head 4600 is aligned to strike a golf ball). A top plane 5430 may be a tangential plane to the top portion of the 4680 of the golf club head 4600 when the golf club head 4600 is at the address position. The ground and top planes 5410 and 5430, respectively, may be substantially parallel to each other. The horizontal midplane 5420 may be located at half the vertical distance between the ground and top planes 5410 and 5430, respectively.

To provide optimal perimeter weighting for the golf club head 4600, the first set of weight portions 4620 (e.g., weight portions 4621 and 4622) may be configured to counterbalance the weight of the hosel 4655 and/or increase the moment of inertia of the golf club head 4600 about a vertical axis of the golf club head 4600 that extends through the center of gravity of the golf club head 4600. For example, as shown in FIG. 47, the first set of weight portions 4620 (e.g., weight portions 4621 and 4622) may be located near the periphery of the body portion 4610 and extend in a transition region 4645 between the top portion 4680 and the toe portion 4640. In another example, the first set of weight portions 4620 (e.g., weight portions 4621 and 4622) may be located near the periphery of the body portion 4610 and extend proximate to the toe portion 4640. The locations of the first set of weight portions 4620 (i.e., the locations of the first set of weight ports 4820) and the physical properties and materials of construction of the weight portions of the first set of weight portions 4620 may be determined to optimally affect the weight, weight distribution, center of gravity, moment of inertia characteristics, structural integrity and/or or other static and/or dynamic characteristics of the golf club head 4600. The apparatus, methods, and articles of manufacture described herein are not limited in this regard.

The second set of weight portions 4630 (e.g., weight portions 4631, 4632, 4633, 4634 and 4635) may be configured to place the center of gravity of the golf club head 4600 at an optimal location and/or optimize the moment of inertia of the golf club head about a vertical axis that extends through the center of gravity of the golf club head 4600. Referring to FIG. 47, all or a substantial portion of the second set of weight portions 4630 may be near the sole portion 4690. For example, the second set of weight portions 4630 (e.g., weight portions 4631, 4632, 4633, 4634 and 4635) may extend at or near the sole portion 4690 between the toe portion 4640 and the heel portion 4650 to lower the center of gravity of the golf club head 1400. The weight portions 4634 and 4635 may be located closer to the toe portion 4640 than to the heel portion 4650 and/or at or near a transition region 4647 between the sole portion 4690 and the toe portion 4640 to increase the moment of inertia of the golf club head 4600 about a vertical axis that extends through the center of gravity. Some of the weight portions of the second set of weight portions 4630 may be located at the toe portion. To lower the center of gravity of the golf club head 4600, all or a portion of the second set of weight portions 4630 may be located closer to the sole portion 4690 than to the horizontal midplane 5420. The locations of the second set of weight portions 4630 (i.e., the locations of the second set of weight ports 4830) and the physical properties and materials of construction of the weight portions of the second set of weight portions 4630 may be determined to optimally affect the weight, weight distribution, center of gravity, moment of inertia characteristics, structural integrity and/or or other static and/or dynamic characteristics of the golf club head 4600. The apparatus, methods, and articles of manufacture described herein are not limited in this regard.

Figure 50:
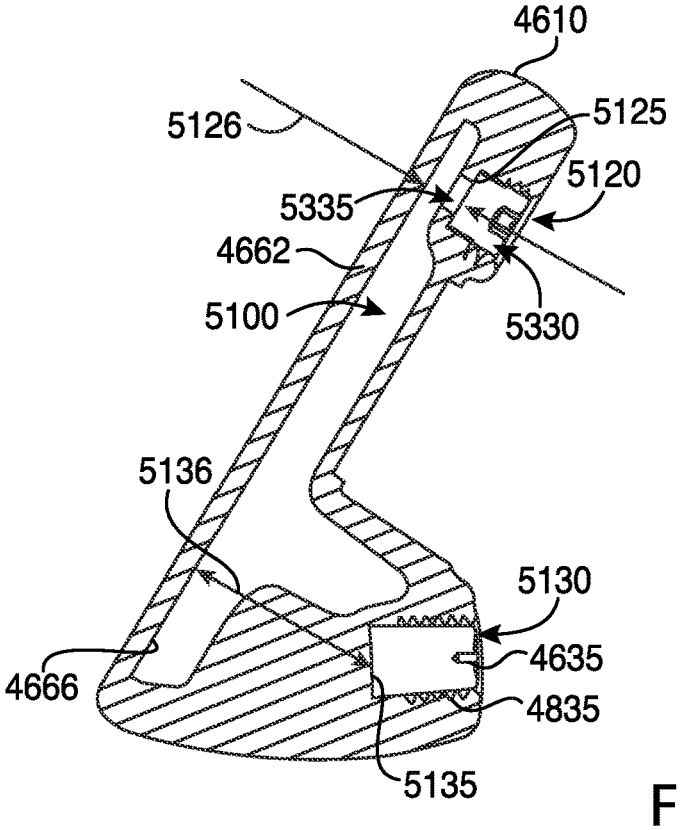
FIG. 50 depicts a cross-sectional view of the example golf club head of FIG. 46 along line 50-50 of FIG. 49.
Figure 51:
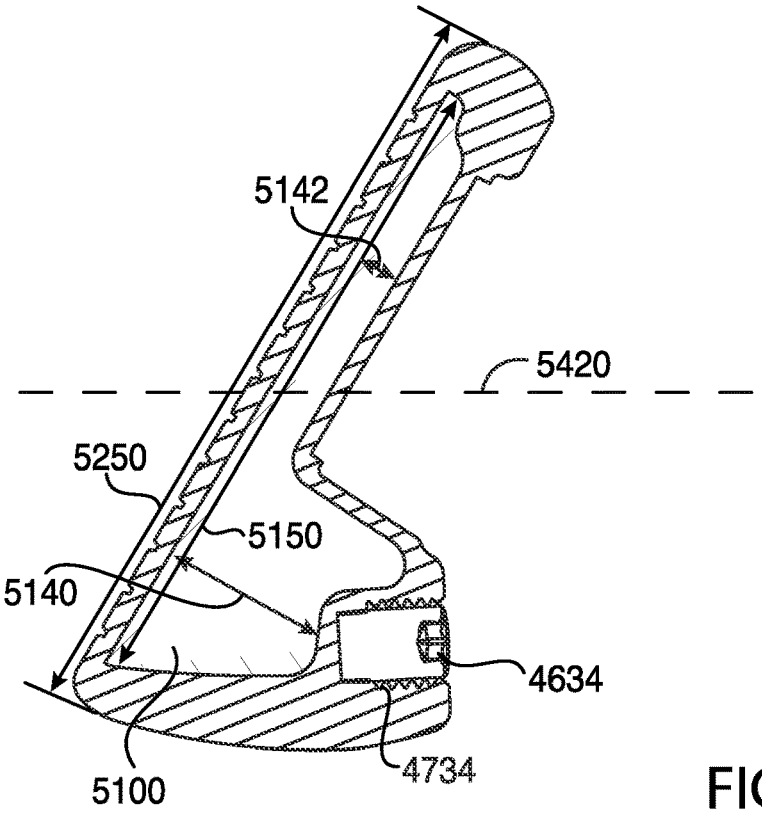
FIG. 51 depicts a cross-sectional view of the example golf club head of FIG. 46 along line 51-51 of FIG. 49.
Figure 52:
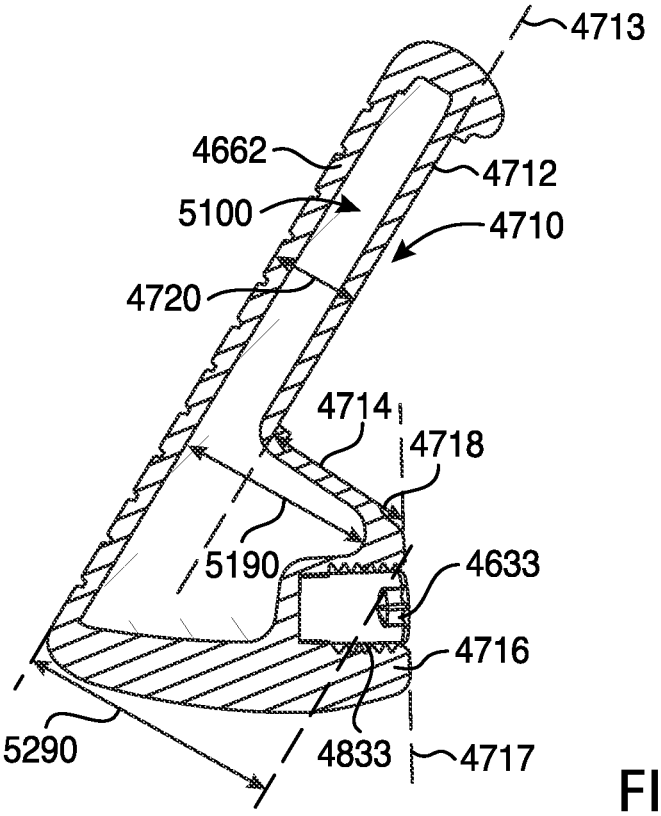
FIG. 52 depicts a cross-sectional view of the example golf club head of FIG. 46 along line 52-52 of FIG. 49.

Turning to FIG. 50, for example, the first and second sets of weight portions 4620 and 4630, respectively, may be located away from the back surface 4666 of the face portion 4662 (e.g., not directly coupled to each other). That is, the first and second sets of weight portions 4620 and 4630, respectively, and the back surface 4666 may be partially or entirely separated by an interior cavity 5100 of the body portion 4610. For example, each exterior weight port of the first and second sets of exterior weight ports 4620 and 4630 may include an opening (e.g., generally shown as 5120 and 5130) and a port wall (e.g., generally shown as 5125 and 5135). The port walls 5125 and 5135 may be integral portions of the back wall portion 4810 (e.g., a section of the back wall portion 4810). Each of the openings 5120 and 5130 may be configured to receive a weight portion such as weight portions 4621 and 4635, respectively. The opening 5120 may be located at one end of the weight port 4821, and the port wall 5125 may be located or proximate to at an opposite end of the weight port 4821. In a similar manner, the opening 5130 may be located at one end of the weight port 4835, and the port wall 5135 may be located at or proximate to an opposite end of the weight port 4835. The port walls 5125 and 5135 may be separated from the face portion 4662 (e.g., separated by the interior cavity 5100). Each port wall of the first set of weight ports 4820, such as the port wall 5125 may have a distance 5126 from the back surface 4666 of the face portion 4662 as shown in FIG. 50. Each port wall of the second set of weight ports 4830, such as the port wall 5135 may have a distance 5136 from the back surface 4666 of the face portion 4662. The distances 5126 and 5136 may be determined to optimize the location of the center of gravity of the golf club head 4600 when the first and second sets of weight ports 4820 and 4830, respectively, receive weight portions as described herein. According to one example, the distance 5136 may be greater than the distance 5126 so that the center of gravity of the golf club head 4600 is moved toward the back portion 4670 and/or lowered toward the sole portion 4690. According to one example, the distance 5136 may be greater than the distance 5126 by a factor ranging from about 1.5 to about 4. In other words, the distance 5136 may be about 1.5 times to about 4 times greater than the distance 5126. As a result, a width 5140 (shown in FIG. 51) of a portion of the interior cavity 5100 below the horizontal midplane 5420 may be greater than a width 5142 of the interior cavity 5100 above the horizontal midplane 5420. As shown in the figures (e.g., FIGS. 20, 21, 22, 31, 50, 51, 52, 53, and/or 54) the apparatus, methods, and articles of manufacture described herein may include at least a portion of at least a weight portion (e.g., the first set of weight portions or the second set of weight portions) closer to the face portion than at least a portion of a polymer material in the interior cavity. In one example as illustrated FIGS. 50-54, at least a portion of at least one of the weight portions of the first set of weight portions 4620 (e.g., one generally shown as 4621 and/or 4622) or the second set of weight portions 4630 (e.g., one generally shown as 4631, 4632, 4633, 4634, and/or 4635) may be closer to the face portion 4662 than at least a portion of a polymer material, which may partially or entirely fill the interior cavity 5100. The apparatus, methods, and articles of manufacture described herein are not limited in this regard.

As discussed herein, the center of gravity (CG) of the golf club head 4600 may be relatively farther back from the face portion 4662 and relatively lower towards a ground plane (e.g., one shown as 5410 in FIG. 47) as compared to a golf club without a width 5140 of a portion of the interior cavity 5100 being greater than a width 5142 of the interior cavity 5100 as described herein, with all or a substantial portion of the second set of weight portions 4630 being closer to the sole portion 4690 than to the horizontal midplane 5420, and the first and second sets of weight portions 4620 and 4630, respectively, being away from the back surface 4666 than if the second set of weight portions 4630 were directly coupled to the back surface 4666. The locations of the first and second sets of weight ports 4820 and 4830 and the physical properties and materials of construction of the weight portions of the first and second sets of weight portions 4620 and 4630, respectively, may be determined to optimally affect the weight, weight distribution, center of gravity, moment of inertia characteristics, structural integrity and/or or other static and/or dynamic characteristics of the golf club head 4600. The apparatus, methods, and articles of manufacture described herein are not limited in this regard.

While the figures may depict weight ports with a particular cross-section shape, the apparatus, methods, and articles of manufacture described herein may include weight ports with other suitable cross-section shapes. The weight ports of the first and/or second sets of weight ports 4820 and 4830 may have cross-sectional shapes that are similar to the cross-sectional shapes of any of the weight ports described herein. Accordingly, the detailed description of the cross-sectional shapes of the weight ports 4820 and 4830 are not described in detail. The apparatus, methods, and articles of manufacture described herein are not limited in this regard.

The first and second sets of weight portions 4620 and 4630, respectively, may be similar in mass (e.g., all of the weight portions of the first and second sets 4620 and 4630, respectively, weigh about the same). Alternatively, the first and second sets of weight portions 4620 and 4630, respectively, may be different in mass individually or as an entire set. In particular, each of the weight portions of the first set 4620 (e.g., shown as 4621 and 4622) may have relatively less mass than any of the weight portions of the second set 4630 (e.g., shown as 4631, 4632, 4633, 4634 and 4635). For example, the second set of weight portions 4630 may account for more than 50% of the total mass from exterior weight portions of the golf club head 4600. As a result, the golf club head 4600 may be configured to have at least 50% of the total mass from exterior weight portions disposed below the horizontal midplane 5420. In one example, the total mass from exterior weight portions may be greater below the horizontal midplane 5420 that the total mass from exterior weight portions above the horizontal midplane 5420. The apparatus, methods, and articles of manufacture described herein are not limited in this regard.

In one example, the golf club head 4600 may have a mass in the range of about 220 grams to about 330 grams based on the type of golf club (e.g., a 4-iron versus a lob wedge). The body portion 4610 may have a mass in the range of about 200 grams to about 310 grams with the first and second sets of weight portions 4620 and 4630, respectively, having a mass of about 20 grams (e.g., a total mass from exterior weight portions). Each of the weight portions of the first set 334620 may have a mass of about one gram (1.0 g) whereas each of the weight portions of the second set 4630 may have a mass of about 2.4 grams. The sum of the mass of the first set of weight portions 4620 may be about 3 grams whereas the sum of the mass of the first set of weight portions 4630 may be about 16.8 grams. The total mass of the second set of weight portions 4630 may weigh more than five times as much as the total mass of the first set of weight portions 4620 (e.g., a total mass of the second set of weight portions 4630 of about 16.8 grams versus a total mass of the first set of weight portions 4620 of about 3 grams). The golf club head 4600 may have a total mass of 19.8 grams from the first and second sets of weight portions 4620 and 4630, respectively (e.g., sum of 3 grams from the first set of weight portions 4620 and 16.8 grams from the second set of weight portions 4630). Accordingly, the first set of weight portions 4620 may account for about 15% of the total mass from exterior weight portions of the golf club head 4600 whereas the second set of weight portions 4630 may be account for about 85% of the total mass from exterior weight portions of the golf club head 4600. The apparatus, methods, and articles of manufacture described herein are not limited in this regard.

By coupling the first and second sets of weight portions 4620 and 4630, respectively, to the body portion 4610 (e.g., securing the first and second sets of weight portions 4620 and 4630 in the weight ports on the back portion 4670), the location of the center of gravity (CG) and the moment of inertia (MOI) of the golf club head 4600 may be optimized. In particular, the first and second sets of weight portions 4620 and 4630, respectively, may lower the location of the CG towards the sole portion 4690 and further back away from the face portion 4662. Further, the MOI may be higher as measured about a vertical axis extending through the CG (e.g., perpendicular to the ground plane 5410). The MOI may also be higher as measured about a horizontal axis extending through the CG (e.g., extending towards the toe and heel portions 4640 and 4650, respectively, of the golf club head 4600). As a result, the golf club head 4600 may provide a relatively higher launch angle and a relatively lower spin rate than a golf club head without the first and second sets of weight portions 4620 and 4630, respectively. The apparatus, methods, and articles of manufacture described herein are not limited in this regard.

Alternatively, two or more weight portions in the same set may be different in mass. In one example, the weight portion 4621 of the first set 4620 may have a relatively lower mass than the weight portion 4622 of the first set 4620. In another example, the weight portion 4631 of the second set 4630 may have a relatively lower mass than the weight portion 4635 of the second set 4630. With relatively greater mass at the top-and-toe transition region and/or the sole-and-toe transition region, more weight may be distributed away from the center of gravity (CG) of the golf club head 4600 to increase the moment of inertia (MOI) about the vertical axis through the CG.

Although the figures may depict the weight portions as separate and individual parts, each set of the first and second sets of weight portions 4620 and 4630, respectively, may be a single piece of weight portion. In one example, all of the weight portions of the first set 4620 (e.g., shown as 4621 and 4622) may be combined into a single piece of weight portion (e.g., a first weight portion). In a similar manner, all of the weight portions of the second set 4630 (e.g., 4631, 4632, 4633, 4634 and 4635) may be combined into a single piece of weight portion as well (e.g., a second weight portion) similar to the example of FIG. 45. While the figures may depict a particular number of weight portions, the apparatus, methods, and articles of manufacture described herein may include more or less number of weight portions. The apparatus, methods, and articles of manufacture described herein are not limited in this regard.

The body portion 4610 may be a hollow body including the interior cavity 5100 extending between the front portion 4660 and the back portion 4670. Further, the interior cavity 5100 may extend between the top portion 4680 and the sole portion 4690. The interior cavity 5100 may be associated with a cavity height 5150 (HC), and the body portion 4610 may be associated with a body height 5250 (HB). While the cavity height 5150 and the body height 5250 may vary between the toe and heel portions 4640 and 4650, and the top and sole portions 4680 and 4690, the cavity height 5150 may be at least 50% of a body height 5250 (HC>0.5*HB). For example, the cavity height 5150 may vary between 70%-85% of the body height 5250. With the cavity height 5150 of the interior cavity 5100 being greater than 50% of the body height 5250, the golf club head 4600 may produce relatively more consistent feel, sound, and/or result when the golf club head 4600 strikes a golf ball via the face portion 4662 than a golf club head with a cavity height of less than 50% of the body height. The apparatus, methods, and articles of manufacture described herein are not limited in this regard.

The interior cavity 5100 may be associated with a cavity width 5140 (WC), and the body portion 4610 may be associated with a body width 5290 (WB). The cavity width 5140 and the body width 5290 may vary between the top portion 4680 and the sole portion 4690 and between the toe portion 4640 and the heel portion 4650. The cavity width 5140 may be at least 50% of a body width 5290 (WC>0.5*WB) at certain regions on the body portion 4610 between the top and sole portions 4680 and 4690 and between the toe and heel portions 4640 and 4650. According to another example, the cavity width 5140 may vary between about 40%-60% of a body width 5290 at certain regions between the top and sole portions 4680 and 4690. According to another example, the cavity width 5140 may vary between about 30%-70% of a body width 5290 at certain regions between the top and sole portions 4680 and 4690. According to another example, the cavity width 5140 may vary between about 20%-80% of a body width 5290 at certain regions between the top and sole portions 4680. For example, the cavity width 5140 may vary between about 20%-80% of the body width 5290 at or below the horizontal midplane 5420. With the cavity width 5190 of the interior cavity 5100 that may vary between about 20% or more to about 80% or less of the body width 5290 at or below the horizontal midplane 5420, a substantial portion of the mass of the golf club head 4600 may be moved lower and farther back as compared to a golf club head with a cavity width of less than about 20% of the body width. Further, the golf club head 4600 may produce relatively more consistent feel, sound, and/or result when the golf club head 4600 strikes a golf ball via the face portion 4662 than a golf club head with a cavity width of less than about 20% of the body width. In one example as illustrated in FIGS. 50-54, the cavity width 5190 at or below the horizontal midplane 5420 and above at least one weight portion (e.g., one generally shown as 4631, 4632, 4633, 4634, and/or 4635) may be greater than a cavity width (e.g., one generally shown as 5142 in FIG. 51) of the interior cavity 5100 at or near the top portion 4680 of the body portion 4610 and greater than a cavity width (e.g., one generally shown as 5140 in FIG. 51) of the interior cavity 5100 at or near the sole portion 4690. The apparatus, methods, and articles of manufacture described herein are not limited in this regard.

To provide an interior cavity 5100 having cavity a width 5140 that may vary between about 20%-80% of a body width 5290 at or below the horizontal midplane 5420, to lower the CG of the golf club head 4600, and/or to move the CG of the golf club head 4600 farther back relative to the face portion 4662, the back portion 4670 may have a recessed portion 4710 (shown in FIGS. 48, 49 and 52) that may extend between a location near the horizontal midplane 5420 and a location at or near the top portion 4680. The recessed portion 4710 may be defined by an upper wall 4712 of the back portion 4670 and a ledge portion 4714. The upper wall 4712 of the back portion 4670 may extend from a location at or near the horizontal midplane 5420 to a location at or near the top portion 4680. The ledge portion 4714 may extend from the upper wall 4712 of the back portion 4670 to a lower wall 4716 of the back portion 4670. The lower wall 4716 of the back portion 4670 may extend from a location at or near the horizontal midplane 5420 to a location at or near the sole portion 4690. The ledge portion 4714 may extends from the upper wall 4712 in a direction away from the face portion 4662. Accordingly, the ledge portion 4714 facilitates a transition from the upper wall 4712 to the lower wall 4716 by which the width of the body portion 4610 is substantially increased at or near the horizontal midplane 5420 as compared to the width of the body portion 4610 above the horizontal midplane. The ledge portion 4714 may have a ledge portion width 4718 (shown in FIG. 52) that is greater than an upper body width 4720 of the body portion 4610. In one example, the ledge portion width 4718 may be defined as a width of a surface on the back portion 4670 that extends between a plane 4713 generally defining the upper wall 4712 of the back portion 4670 and a plane 4717 generally defining the lower wall 4716 of the back portion 4670. The upper body width 4720 may be defined as a width of the body portion 4610 at or above the horizontal midplane 5420. According to one example, the ledge portion width 4718 may be wider than the upper body width 4720 by a factor of between about 0.5 to about 1.0. According to another example, the ledge portion width 4718 may be wider than the upper body width 4720 by a factor of about 1.5. According to another example, the ledge portion width 4718 may be wider than the upper body width 4720 by a factor of about 3.0. Accordingly, a golf club according to the examples described herein may have a ledge portion width 4718 that is wider than the upper body width 4720 by a factor of greater than or equal to about 0.5 to less than or equal to about 3.0. Accordingly, the body width 5290 at, near or below the horizontal midplane 5420 may be substantially greater than the upper body width 4720, which may provide for a cavity width 5140 that may be around 20% to 80% of the body width 5290 at, near or below the horizontal midplane 5420. Further, the recessed portion 4710 allows the golf club head 4600 to generally have a greater mass below the horizontal midplane 5420 than above the horizontal midplane 5420. In other words, the mass that is removed from the golf club head 4600 to define the recessed portion 4710 may be moved to aft or back portions of the body portion 4610 that are around and below the horizontal midplane 5420.

Figure 53:
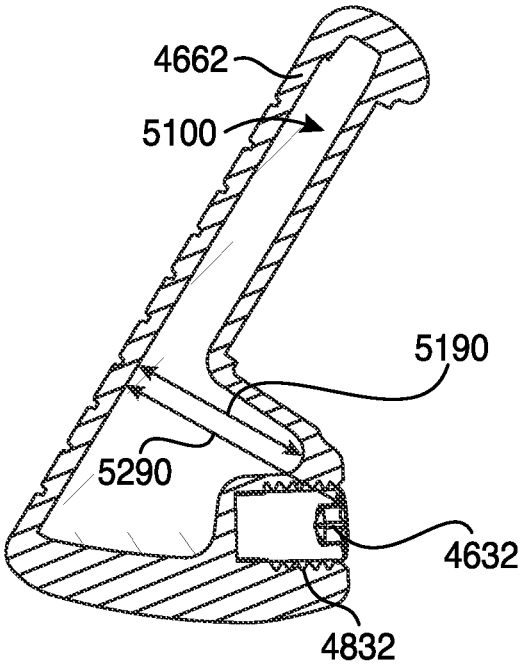
FIG. 53 depicts a cross-sectional view of the example golf club head of FIG. 46 along line 53-53 of FIG. 49.

To generally maintain a cavity width 5140 that may be around 20%-80% of the body width 5290, the cavity width 5140 may be greater near the sole portion 4690 or below the horizontal midplane 5420 than near the top portion 4680 or above the horizontal midplane 5420. According to one example, the cavity width 5140 may generally vary according to a variation in the body width 5290 at certain regions of the body portion 4610 between the top portion 4680 and the sole portion 4690 and between the toe portion 4640 and the heel portion 4650. For example, as shown in FIG. 53, the cavity width 5140 may generally vary according to the body width 5290 in certain regions of the body portion 4610 between the top portion 4680 and the sole portion 4690. The apparatus, methods, and articles of manufacture described herein are not limited in this regard.

In one example, the interior cavity 5100 may be unfilled (i.e., empty space). The body portion 4610 with the interior cavity 5100 may weight about 100 grams less than the body portion 4610 without the interior cavity 5100. Alternatively, the interior cavity 5100 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 5100 may be filled with a TPE material to absorb shock, isolate vibration, and/or dampen noise when the golf club head 4600 strikes a golf ball via the face portion 4662.

In another example, the interior cavity 5100 may be partially or entirely filled with a polymer material such as an ethylene copolymer material to absorb shock, isolate vibration, and/or dampen noise when the golf club head 4600 strikes a golf ball via the face portion 4662. In particular, at least 50% of the interior cavity 5100 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 3300), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

As described herein, the cavity width 5140 may vary between about 20%-80% of a body width 5290 at or below the horizontal midplane 5420. According to one example, at least 50% of the elastic polymer or elastomer material partially or filling the interior cavity 5100 may be located below the horizontal midplane 5420 of the golf club head 4600. Accordingly, the center of gravity of the golf club head 4600 may be further lowered and moved farther back as compared to a golf club head with a cavity width of less than about 20% of the body width and that is partially or fully filled with an elastic polymer or elastomer material. Further, the golf club head 4600 may produce relatively more consistent feel, sound, and/or result when the golf club head 4600 strikes a golf ball via the face portion 4662 as compared to a golf club head with a cavity width of less than about 20% of the body width that is partially or fully filled with an elastic polymer material. In one example as illustrated in FIGS. 50-54, the elastic polymer material or the elastomer material in the interior cavity 5100 may have a first portion located above the horizontal midplane 5420, a second portion located below the horizontal midplane 5420, and a third portion located between the first portion and the second portion. The first portion may have a first width, the second portion may have a second width greater than the first width, and the third portion may have a third width greater than the first width and greater than the second width. In one example, the third portion may be located between at least one weight portion (e.g., one generally shown as 4631, 4632, 4633, 4634, and/or 4635) and the top portion 4680 of the body portion 4610. In another example, the third portion may be located between at least one weight portion (e.g., one generally shown as 4631, 4632, 4633, 4634, and/or 4635) and the horizontal midplane 5420. In yet another example, at least a portion of at least one weight portion (e.g., one generally shown as 4631, 4632, 4633, 4634, and/or 4635) may be closer to the face portion 4662 than at least a portion of the elastic polymer material or the elastomer material in the interior cavity 5100.

The thickness of the face portion 4662 may vary between the top portion 4680 and the sole portion 4690 and between the toe portion 4640 and the heel portion 4650 as discussed in detail herein and shown in the examples of FIGS. 28 and 29. According, a detailed description of the variation in the thickness of the face portion 4662 is not provided. The apparatus, methods, and articles of manufacture described herein are not limited in this regard.

Different from other golf club head designs, the interior cavity 5100 of the body portion 4610 and the location of the first and second sets of weight portions 4620 and 4630, respectively, along the perimeter of the golf club head 4600 may result in a golf ball traveling away from the face portion 4662 at a relatively higher ball launch angle and a relatively lower spin rate. As a result, the golf ball may travel farther (i.e., greater total distance, which includes carry and roll distances).

The golf club head 4600 may be manufactured by any of the methods described herein and illustrated in FIG. 30. Accordingly, a detailed description of the method of manufacturing the golf club head 4600 is not provided.

Figure 54:
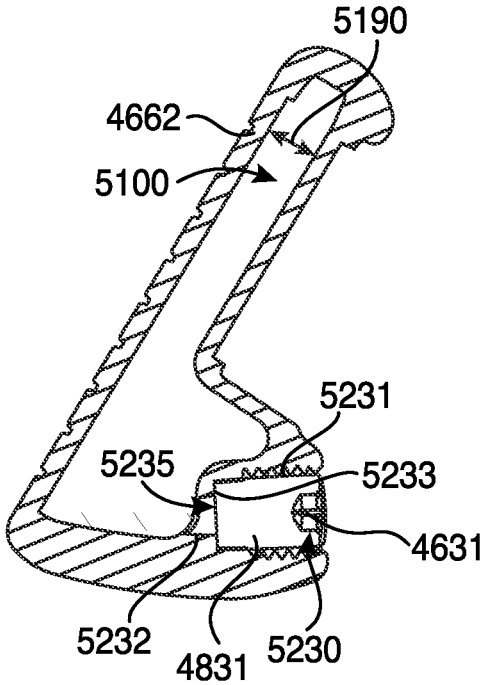
FIG. 54 depicts a cross-sectional view of the example golf club head of FIG. 46 along line 54-54 of FIG. 49.
Figure 55:
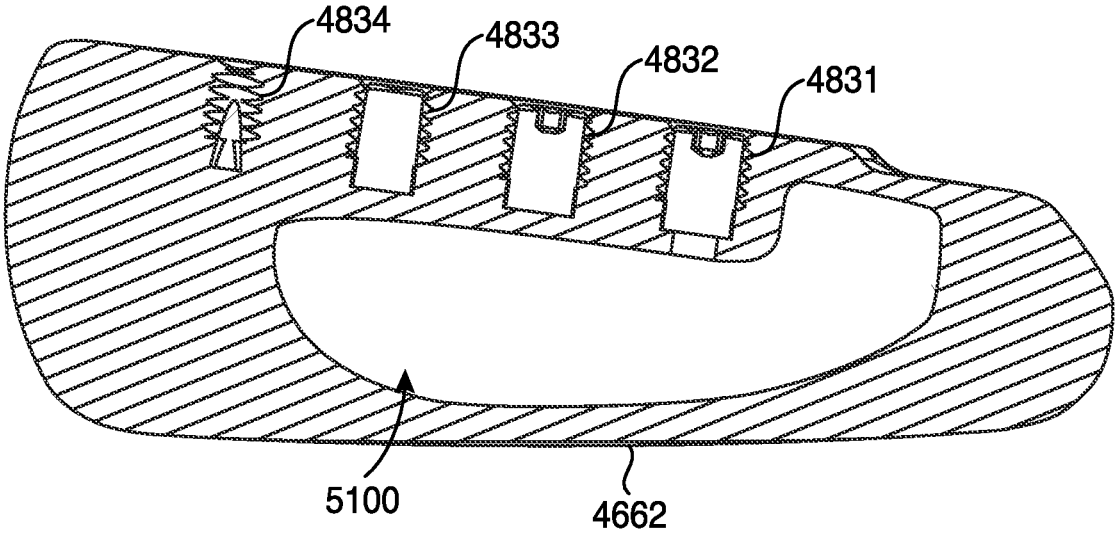
FIG. 55 depicts a cross-sectional view of the example golf club head of FIG. 46 along line 55-55 of FIG. 49.

As illustrated in FIGS. 50 and 54, for example, the golf club head 4600 may include one or more weight ports (e.g., one shown as weight ports 4821 and 4831) that may open to the to the interior cavity 5100. The weight port 4831 may include a first opening 5230 and a second opening 5235. As shown in FIG. 54, the weight port 4831 may include a first port wall 5231 that extends from the first opening 5230 to the second opening 5235 and a second port wall 5232 that extends from the second opening to the interior cavity 5100. As shown in FIG. 54, the first port wall 5231 includes a threaded portion to complementarily engage a threaded outer surface of the weight portion 4631 as described herein. The second opening 5235 may be used to access the interior cavity 5100. The first and second openings 5230 and 5235, respectively, may be same or different in size and/or shape. In one example, as shown in FIG. 54, the inner diameter of the weight port 4831 at the first port wall 5231 may be greater than the inner diameter of the weight port 4831 at the second port wall 5232. Accordingly, as shown in FIG. 54, the second opening 5235 may be smaller in diameter than the first opening 5230 to define a shoulder 5233 in the weight port 4831. As shown in FIG. 54, the weight portion 4631 abuts the shoulder 5233 and is prevented by the shoulder 5233 from further insertion into the weight port 4831 past the second opening 5235. As is further shown in FIG. 54, the height of the weight portion 4631 may be similar or substantially similar to a distance between the first opening 5231 and the second opening 5232. Accordingly, as shown in FIG. 54, when the weight portion 4631 is fully secured in the weight port 4831 (i.e., weight portion 4631 abutting the shoulder 5233) such that a threaded portion of the weight portion 4631 is complementarily engaged with a threaded portion of the first port wall 5231 as shown in FIG. 54, the weight portion 4631 extends from the second opening 5235 to a location at or proximate to the first opening 5230, and as further shown in FIGS. 47 and 48, the weight portion 4631 may partially define an outer surface of the lower wall 3416 of the back portion 4670. The weight port 4821 may include a first opening 5230 and a second opening 5235. The second opening 5235 may be used to access the interior cavity 5100. As shown in FIG. 50, the configuration of the weight port 4821 may be similar in many respects to the configuration and function of the weight port 4831 (i.e., having a first port wall, a second port wall, and a shoulder) as described herein. In one example, the process 3000 (FIG. 30) may fill the interior cavity 5100 with an elastic polymer material by injecting the elastic polymer material into the interior cavity 5100 from the first opening 5230 via the second opening 5235 of the weight port 4831. As the elastic polymer fills the interior cavity 5100, the air inside the interior cavity 5100 that is displaced by the elastic polymer material may exit the interior cavity from the weight port 4821 through the second opening 5235 and then the first opening 5230. After the cavity is partially or fully filled with the elastic polymer material, the weight ports 4831 and 4821 may be closed by inserting and securing weight portions therein as described in detail herein. Alternatively, the elastic polymer material may be injected into the interior cavity 5100 from the weight port 4821. Accordingly, the weight port 4831 may function as an exit port for the displaced air inside the interior cavity 5100. While the above example may describe and depict particular weight ports with second openings, any other weight ports of the golf club head 4600 may include a second opening (e.g., the weight port 4832). The apparatus, methods, and articles of manufacture described herein are not limited in this regard.

The body portion and/or any other portion of a golf club head according to any of the examples described herein may be constructed from stainless steel so as to resist corrosion or to be corrosion resistant. In some embodiments, all or portions of the body portion and/or any other portion of the golf club head may be constructed by a forging process. Accordingly, in some embodiments, the stainless steel from which all or portions of the body portion and/or any other portion of the golf club head are constructed may be a forgeable stainless steel. However, the apparatus, methods, and articles of manufacture described herein are not limited in this regard.

In embodiments in which stainless steel is used, various ranges of material properties, such as density, tensile strength, yield strength, hardness, elongation, etc., may be used. For any given embodiment, certain material properties may produce more desirable results in certain application or conditions. It should be understood, however, that the disclosed golf club heads and method for manufacturing may not be limited to the exemplary ranges.

In some embodiments, the density of the stainless steel may be between and including 7.0 g/cm3 and 8.3 g/cm3. In one example, the density of the stainless steel may be between and including 7.2 g/cm3 and 7.8 g/cm3. In another example, the density of the stainless steel may be between and including 7.3 g/cm3 and 7.7 g/cm3. In one example, the density of the stainless steel may be between and including 7.1 g/cm3 and 7.6 g/cm3. In another example, the density of the stainless steel may be between and including 7.4 g/cm3 and 8.3 g/cm3. The apparatus, methods, and articles of manufacture described herein are not limited in this regard.

In some embodiments, the tensile strength of the stainless steel from which all of portions of the body portion may be constructed may be between and including 600 MPa and 800 MPa (106 Pascal=106 N/m2). In one example, the tensile strength of the stainless steel from which all of portions of the body portion may be constructed may be between and including 620 MPa and 780 MPa. In another example, the tensile strength of the stainless steel from which all of portions of the body portion may be constructed may be between and including 660 MPa and 720 MPa. In one example, the tensile strength of the stainless steel from which all of portions of the body portion may be constructed may be between and including 680 MPa and 790 MPa. In another example, the tensile strength of the stainless steel from which all of portions of the body portion may be constructed may be between and including 640 MPa and 760 MPa. In one example, the tensile strength of the stainless steel from which all of portions of the body portion may be constructed may be between and including 670 MPa and 770 MPa. The apparatus, methods, and articles of manufacture described herein are not limited in this regard.

In some embodiments, the yield strength of the stainless steel from which all of portions of the body portion may be constructed may be between and including 500 MPa and 700 MPa. In one example, the yield strength of the stainless steel from which all of portions of the body portion may be constructed may be between and including 520 MPa and 680 MPa. In another example, the yield strength of the stainless steel from which all of portions of the body portion may be constructed may be between and including 560 MPa and 620 MPa. In one example, the yield strength of the stainless steel from which all of portions of the body portion may be constructed may be between and including 580 MPa and 690 MPa. In one example, the yield strength of the stainless steel from which all of portions of the body portion may be constructed may be between and including 540 MPa and 660 MPa. In one example, the yield strength of the stainless steel from which all of portions of the body portion may be constructed may be between and including 570 MPa and 670

MPa. The apparatus, methods, and articles of manufacture described herein are not limited in this regard.

In some embodiments, the hardness of the stainless steel from which all of portions of the body portion may be constructed may be between and including 10 and 40 HRC (Rockwell Hardness in the C scale). In one example, the hardness of the stainless steel from which all of portions of the body portion may be constructed may be between and including 15 and 35 HRC. In one example, the hardness of the stainless steel from which all of portions of the body portion may be constructed may be between and including 22 and 28 HRC. In one example, the hardness of the stainless steel from which all of portions of the body portion may be constructed may be between and including 12 and 38 HRC. In one example, the hardness of the stainless steel from which all of portions of the body portion may be constructed may be between and including 17 and 33 HRC. In one example, the hardness of the stainless steel from which all of portions of the body portion may be constructed may be between and including 11 and 31 HRC. The apparatus, methods, and articles of manufacture described herein are not limited in this regard.

In some embodiments, the elongation of the stainless steel from which all of portions of the body portion may be constructed may be between and including 5% and 40%. In one example, the elongation of the stainless steel from which all of portions of the body portion may be constructed may be between and including 10% and 32%. In one example, the elongation of the stainless steel from which all of portions of the body portion may be constructed may be between and including 13% and 28%. In one example, the elongation of the stainless steel from which all of portions of the body portion may be constructed may be between and including 18% and 37%. In one example, the elongation of the stainless steel from which all of portions of the body portion may be constructed may be between and including 14% and 33%. In one example, the elongation of the stainless steel from which all of portions of the body portion may be constructed may be between and including 7% and 36%. The apparatus, methods, and articles of manufacture described herein are not limited in this In one example, any of the filler materials described herein (i.e., the one or more materials that may be used to partially or fully fill any internal cavity of a golf club head) may be an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties (e.g., one or more adhesive or epoxy materials). A material may also absorb shock, isolate vibration, and/or dampen noise when a golf club head as described herein strikes a golf ball. Further, a filler material may be an epoxy material that may be flexible or slightly flexible when cured. In another example, a filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, a filler material may include 3M™ Scotch-Weld™ DP100 Plus Clear adhesive. In another example, a filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In yet another example, a filler material may be LOCTITE® materials manufactured by Henkel Corporation, Rocky Hill, Conn. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont' High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience, i.e., relatively high coefficient of restitution (COR). The apparatus, methods, and articles of manufacture described herein are not limited in this regard. A filler material not specifically described in detail herein may include one or more similar or different types of materials described herein and in any of the incorporated by reference applications. The apparatus, methods, and articles of manufacture described herein are not limited in this regard.

In another example, any of the filler materials described herein (i.e., the one or more materials that may be used to partially or fully fill any internal cavity of a golf club head) may be a polymer material including rubber or a rubber compound that may provide certain COR and compression properties as may be described herein or in any of the incorporated by reference applications. In one example, a filler material may include rubber and at least another compound that may provide increased softness or firmness to the filler material to maximize the COR of the filler material while maintaining compression values within a certain range as may be described herein or in any of the incorporated by reference applications. In one example, the filler material may include rubber and Zinc Diacrylate (ZDA), which may increase the compression value of the filler material and hence the COR of the filler material. The amount of Zinc Diacrylate (ZDA) in the filler material may be varied to achieve certain COR and/or compression values as may be described herein or in any of the incorporated by reference applications. The apparatus, methods, and articles of manufacture described herein are not limited in this regard.

In another example, any of the filler materials described herein (i.e., the one or more materials that may be used to partially or fully fill any internal cavity of a golf club head) may be a rubber-type of material such as a compound including a mixture of polybutadiene as a base polymer material, and a vulcanizing agent, which may be based on sulfur, peroxides, metallic oxides, acetoxysilane, or urethane crosslinkers. The added vulcanizing agent may facilitate cross linkage between polybutadiene chains to vulcanize or cure the polybutadiene polymer. The amount of vulcanizing agent may be directly related to the resilience of the resulting vulcanized polymer, which may be measured by Yerzley method, ASTM D945-59. In one example, the filler material may be formed from a compound including between 3 parts by weight and 7.5 parts by weight of sulfur per 100 parts by weight of polybutadiene. In another example, the filler material may be formed from a compound including between 4 parts by weight and 6.25 parts by weight of a vulcanizing agent such as sulfur per 100 parts by weight of polybutadiene. In yet another example, the filler material may be formed from a compound including between 4.75 parts by weight and 5.75 parts by weight of sulfur per 100 parts by weight of polybutadiene. The amounts of polybutadiene and sulfur as described herein may yield a compound having a Yerzley resilience of (1) between 75% and 85%, (2) between 80% and 90%, or (3) greater than 90%. The filler material and the mixture composition thereof may be similar to any of the compounds described in U.S. Pat. No. 3,241,834, which is incorporated by reference herein. The apparatus, methods, and articles of manufacture described herein are not limited in this regard.

Other additives may be combined with the mixture of polybutadiene and the vulcanizing agent to initiate the curing cycle. In particular, an activating agent such as zinc oxide and/or stearic acid may be used to initiate the curing cycle of the mixture of polybutadiene and the vulcanizing agent. In one example, the amount of zinc oxide used may be between 2 parts by weight and 5 parts by weight per 100 parts by weight of polybutadiene, and/or the amount of stearic acid used may be between 0.5 parts by weight and 4 parts by weight per 100 parts by weight of polybutadiene. In another example, the amount of zinc oxide used may be between 2.5 parts by weight and 4.5 parts by weight per 100 parts by weight of polybutadiene, and/or the amount of stearic acid used may be between 1 part by weight and 2 parts by weight per 100 parts by weight of polybutadiene. In yet another example, the amount of zinc oxide used may be between 3.5 parts by weight and 4.5 parts by weight per 100 parts by weight of polybutadiene, and/or the amount of stearic acid used may be between 1.5 parts by weight and 2.5 parts by weight per 100 parts by weight of polybutadiene. The apparatus, methods, and articles of manufacture described herein are not limited in this regard.

Further, other additives may be combined with the mixture of polybutadiene and the vulcanizing agent to accelerate the rate of vulcanization. Accelerating the rate of vulcanization may shorten the length of the molding cycle of the filler material and may also equalize the heat throughout the mixture during the curing cycle. In one example, any one or a combination of N-oxydiethylene benzothiazole 2 sulfenamide (referred to under the trade name AMAX), di-orthotolylguanidine (referred to under the trade name DOTG) and bismuth dimethyldithio-carbonate (referred to under the trade name Bismate) may be used to accelerate the vulcanization process. The activation of these accelerators may occur as the mixture reaches a specific temperature. For Bismate and DOTG, the activation temperature is approximately 230° F., whereas the activation temperature of AMAX is approximately 260° F. By ensuring that the heat of reaction is equalized throughout the mixture a more uniform rate of vulcanization and improved consistency in the end product is obtained. In one example, the amount of each of AMAX, DOTG, and Bismate may be between 0.25 and 4 parts by weight per 100 parts by weight of polybutadiene. In another example, the amount of each of AMAX, DOTG, and Bismate may be between 1 and 3 parts by weight per 100 parts by weight of polybutadiene. In yet another example, the amount of each of AMAX, DOTG, and Bismate may be between 1.5 and 2.75 parts by weight per 100 parts by weight of polybutadiene. The apparatus, methods, and articles of manufacture described herein are not limited in this regard.

Fillers may be added to the mixture of polybutadiene and the vulcanizing agent. In one example, hydrated silica may be added to the mixture as a filler. The added filler material(s) may perform the function of providing tear and abrasion resistance. The filler material may be selected to include to improve the durability of polybutadiene without unduly increasing the specific gravity. In another example, carbon black may be used as a filler material. In yet another example, lithium oxide may be used as a filler material. In one example, the amount of filler material used may be between 4 and 16 parts by weight per 100 parts by weight of polybutadiene. In another example, the amount of filler material used may be between 5 and 10 parts by weight per 100 parts by weight of polybutadiene. In yet another example, the amount of filler material used may be between 7 and 8 parts by weight per 100 parts by weight of polybutadiene.

The amount of filler material may affect the specific gravity of the resulting polymer material, which in turn may affect the resilience of the resulting polymer material. In one example, the amount of filler material used in the polybutadiene and the vulcanizing agent mixture may provide a specific gravity of between 1.0 and 1.5 to optimize resilience of the resulting polymer material (i.e. the filler material). In another example, the amount of filler material used in the polybutadiene and the vulcanizing agent mixture may provide a specific gravity of between 1.1 and 1.4 to optimize resilience of the resulting polymer material. In yet another example, the amount of filler material used in the polybutadiene and the vulcanizing agent mixture, the amount of filler material may provide a specific gravity of between 1.0 and 1.05 to optimize resilience of the resulting polymer material. The apparatus, methods, and articles of manufacture described herein are not limited in this regard.

One or more anti-oxidation materials may be added to the polymer mixture to prevent oxidation and staining, and/or to inhibit aging of the resulting polymer compound. In one example, 4 methyl-6 tertiary-butyl phenol (referred to under the trade name Antioxidant 2246) may be added to the mixture at an amount of between 0.25 and 3 parts by weight per 100 parts by weight of polybutadiene. Other examples anti-oxidant materials that may be used include phenyl β naphthylamine, alkyl diphenylamine, and/or hindered alkyl phenols. The apparatus, methods, and articles of manufacture described herein are not limited in this regard.

The various elements of the polymer mixture described herein may be sufficiently mixed to provide uniform distribution of the elements throughout the mixture. In one example, the mixture may then be placed in a mold and subjected to a pressure of between 500 and 3000 pounds per square inch (psi) for a period of approximately 10 to 30 minutes, while concurrently, the temperature of the mixture may be raised to approximately 285-340° F. In another example, the mixture may then be placed in a mold and subjected to a pressure of between 750 and 2000 psi for a period of approximately 12 to 25 minutes, while concurrently, the temperature of the mixture may be raised to approximately 300-330° F. In yet another example, the mixture may then be placed in a mold and subjected to a pressure of between 900 and 1100 psi for a period of approximately 15 to 20 minutes, while concurrently, the temperature of the mixture may be raised to approximately 315-325° F. Various aspects of the treatment of the mixture (e.g., the length of each of the molding operation, the pressure, and/or the temperature) may be adjusted to compensate for any variation in other aspects of the treatment the mixture. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all of the heating and cooling processes may be performed by using heating or cooling systems that employ conveyor belts that move a golf club head described herein through a heating or cooling environment for a period of time as described herein. The processes of manufacturing a golf club head with one or more filler materials may be similar to any of the processes described in any of the incorporated by reference applications. The apparatus, methods, and articles of manufacture described herein are not limited in this regard.

Any of the golf club heads described herein may be manufactured by casting from metal such as steel. However, other techniques for manufacturing a golf club head as described herein may be used such as 3D printing, or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters (cm3 or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above described ranges. The apparatus, methods, and articles of manufacture described herein are not limited in this regard.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may describe an iron-type or a wedge-type golf club head, the apparatus, methods, and articles of manufacture described herein may be applicable to other types of golf club heads (e.g., a driver-type golf club head, a fairway wood-type golf club head, a hybrid-type golf club head, a putter-type golf club head, etc.). Further, although the above examples may describe steel-based material, the apparatus, methods, and articles of manufacture described herein may be applicable to other types of metal materials, non-metal materials, or both.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "a," "an," and/or "the" used in the context of describing various embodiments the present disclosure are to be construed to cover both the singular and the plural, unless otherwise indicated herein or clearly contradicted by context. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein. The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having an interior cavity, a front portion, a back portion, a toe portion with a toe portion edge, a heel portion with a heel portion edge, a top portion with a top portion edge, and a sole portion with a sole portion edge;

a face portion attached to the front portion to enclose the interior cavity, the face portion comprising a front surface configured to strike a ball, and a back surface facing the interior cavity, the back surface comprising:

a first plurality of channels in the back surface of the face portion, each channel of the first plurality of channels being spaced apart from an adjacent channel of the first plurality of channels in a first direction and extending continuously from a location at or proximate to the top portion edge to a location at or proximate to the sole portion edge; and a second plurality of channels in the back surface of the face portion, each channel of the second plurality of channels being spaced apart from an adjacent channel of the second plurality of channels in a second direction; and a filler material at least partially filling the interior cavity, wherein at least one channel of the first plurality of channels or at least one channel of the second plurality of channels includes an undercut portion at least partially filled with the filler material, wherein at least one channel of the first plurality of channels and at least one channel of the second plurality of channels have at least one different property, and wherein at least one channel of the first plurality of channels intersects with at least one channel of the second plurality of channels.

2. A golf club head as defined in claim 1, wherein each channel of the first plurality of channels is independent from an adjacent channel of the first plurality of channels in the first direction, and wherein each channel of the second plurality of channels is independent from an adjacent channel of the second plurality of channels in the second direction.

3. A golf club head as defined in claim 1, wherein each channel of the first plurality of channels and each channel of the second plurality of channels are configured to engage the filler material to prevent or substantially prevent detachment of the filler material from a section of the back surface of the face portion.

4. A golf club head as defined in claim 1, wherein the first plurality of channels are spaced apart by a first distance, wherein the second plurality of channels are spaced apart by a second distance different from the first distance.

5. A golf club head as defined in claim 1 further comprising at least one port connected to the interior cavity, wherein the filler material is injected into the interior cavity from the at least one port.

6. A golf club head comprising:

a body portion having an interior cavity, a front portion, a back portion, a toe portion with a toe portion edge, a heel portion with a heel portion edge, a top portion with a top portion edge, and a sole portion with a sole portion edge;

a face portion attached to the front portion to enclose the interior cavity, the face portion comprising:

a front surface configured to strike a ball, the front surface comprising a plurality of grooves, each groove extending in a first direction; and a back surface facing the interior cavity, the back surface including a plurality of channels, each continuous channels therein having a length and a width, the width being substantially smaller than the length; and a filler material at least partially filling the interior cavity, wherein the length of at least one channel of the plurality of channels extends in a second direction different from the first direction, wherein at least one channel of the plurality of channels includes an undercut portion at least partially filled with the filler material and is configured to engage the filler material to adhere the filler material to the back surface of the face portion wherein the length of a first channel of the plurality of channels extends in the second direction, wherein the length of a second channel of the plurality of channels extends in a third direction, wherein the width of each of the at least one channel, the first channel and the second channel is uniform along the length of the channel, wherein the second direction is different from the third direction, wherein the third direction is different from the first direction, and wherein the first channel of the plurality of channels intersects with the second channel of the plurality of channels.

7. A golf club head as defined in claim 6, wherein the second direction is a diagonal direction on the back surface of the face portion.

8. A golf club head as defined in claim 6, wherein the second direction is a vertical direction on the back surface of the face portion.

9. A golf club head as defined in claim 6 further comprising at least one port connected to the interior cavity, wherein the filler material is injected into the interior cavity from the at least one port.

10. A golf club head as defined in claim 6, wherein a thickness of the face portion is greater than or equal to 0.02 inch (0.5 millimeters) and less than or equal to 0.12 inch (3.0 millimeters).

11. A golf club head as defined in claim 6, wherein a cross sectional shape of at least one groove of the plurality of grooves is different from a cross sectional shape of at least one channel of the plurality of channels.

12. A golf club comprising:

a shaft having a first end coupled to a grip and a second end;

a golf club head coupled to the second end of the shaft, the golf club head comprising:

a body portion having an interior cavity, a front portion, a back portion, a toe portion with a toe portion edge, a heel portion with a heel portion edge, a top portion with a top portion edge, and a sole portion with a sole portion edge;

a face portion attached to the front portion to enclose the interior cavity, the face portion comprising a front surface configured to strike a ball, and a back surface facing the interior cavity, the back surface comprising:

a first plurality of channels in the back surface of the face portion, each channel of the first plurality of channels being spaced apart from an adjacent channel of the first plurality of channels in a first direction and extending continuously from a location at or proximate to the top portion edge to a location at or proximate to the sole portion edge; and a second plurality of channels in the back surface of the face portion, each channel of the second plurality of channels being spaced apart from an adjacent channel of the second plurality of channels in a second direction; and a filler material at least partially filling the interior cavity, wherein at least one channel of the first plurality of channels or at least one channel of the second plurality of channels includes an undercut portion at least partially filled with the filler material, wherein at least one channel of the first plurality of channels and at least one channel of the second plurality of channels have at least one different property, and wherein at least one channel of the first plurality of channels intersects with at least one channel of the second plurality of channels.

13. A golf club as defined in claim 12, wherein each channel of the first plurality of channels is independent from an adjacent channel of the first plurality of channels in the first direction, and wherein each channel of the second plurality of channels is independent from an adjacent channel of the second plurality of channels in the second direction.

14. A golf club as defined in claim 12, wherein each channel of the first plurality of channels and each channel of the second plurality of channels are configured to engage the filler material to prevent or substantially prevent detachment of the filler material from a section of the back surface of the face portion.

15. A golf club as defined in claim 12, wherein the first plurality of channels are spaced apart by a first distance, wherein the second plurality of channels are spaced apart by a second distance different from the first distance.

16. A golf club as defined in claim 12 further comprising at least one port connected to the interior cavity, wherein the filler material is injected into the interior cavity from the at least one port.

* * * * *